US009504889B2

(12) United States Patent
Mitzel et al.

(10) Patent No.: US 9,504,889 B2
(45) Date of Patent: Nov. 29, 2016

(54) GOLF CLUB WITH MULTI-COMPONENT CONSTRUCTION

(71) Applicant: Cobra Golf Incorporated, Carlsbad, CA (US)

(72) Inventors: Steven M. Mitzel, Carlsbad, CA (US); Ryan L. Roach, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 14/522,232

(22) Filed: Oct. 23, 2014

(65) Prior Publication Data

US 2015/0045134 A1 Feb. 12, 2015

Related U.S. Application Data

(63) Continuation of application No. 13/545,329, filed on Jul. 10, 2012, now abandoned, which is a continuation-in-part of application No. 13/185,324, filed on Jul. 18, 2011, now Pat. No. 8,226,499, which (Continued)

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/0466* (2013.01); *A63B 53/08* (2013.01); *A63B 60/52* (2015.10); *A63B 53/02* (2013.01); *A63B 53/047* (2013.01); *A63B 53/0487* (2013.01);

(Continued)

(58) Field of Classification Search
CPC ..... A63B 53/0466; A63B 53/08; A63B 2053/0416; A63B 2053/0491; A63B 2209/00; A63B 2209/10; A63B 2053/0437; A63B 53/047; A63B 53/0487; A63B 53/06; A63B 49/06; A63B 2053/042; A63B 53/02; A63B 2053/0433; A63B 2209/02; A63B 2053/045; A63B 59/0092
USPC ..... 473/324–350, 287–292; 446/120–122
See application file for complete search history.

(56) References Cited

U.S. PATENT DOCUMENTS 713,845 A 11/1902 Braid et al.
1,253,700 A 1/1918 Mclaughlin
(Continued)

FOREIGN PATENT DOCUMENTS

JP 8-089603 A 4/1996
JP 9-192269 A 7/1997
(Continued)

OTHER PUBLICATIONS

European Search Report for European Application No. 10013627.4-2318, dated Mar. 11, 2011, in 8 pages.
(Continued)

*Primary Examiner* — Sebastiano Passaniti
(74) *Attorney, Agent, or Firm* — Brown Rudnick LLP; Mark S. Leonardo

(57) ABSTRACT

The present invention relates to a golf club, and more particularly to a wood-type club head with a separable body component. In certain aspects, the invention provides a golf club head with a face and hosel body member and one or more of an interchangeable aft body member. The invention further provides a variety of insights and mechanisms for coupling the interchangeable member to the body member.

6 Claims, 58 Drawing Sheets

Related U.S. Application Data is a continuation of application No. 12/696,468, filed on Jan. 29, 2010, now Pat. No. 7,980,964, which is a continuation of application No. 11/110,733, filed on Apr. 21, 2005, now Pat. No. 7,658,686, said application No. 13/545,329 is a continuation-in-part of application No. 13/539,958, filed on Jul. 2, 2012, and a continuation-in-part of application No. 13/407,087, filed on Feb. 28, 2012, now abandoned, which is a continuation-in-part of application No. 12/643,154, filed on Dec. 21, 2009, now Pat. No. 8,147,354.

(60) Provisional application No. 61/513,509, filed on Jul. 29, 2011.

(51) Int. Cl.
*A63B 53/08* (2015.01)
*A63B 53/02* (2015.01)

(52) U.S. Cl.
CPC ..... *A63B 60/54* (2015.10); *A63B 2053/042* (2013.01); *A63B 2053/045* (2013.01); *A63B 2053/0416* (2013.01); *A63B 2053/0433* (2013.01); *A63B 2053/0437* (2013.01); *A63B 2053/0491* (2013.01); *A63B 2209/00* (2013.01); *A63B 2209/02* (2013.01); *A63B 2209/08* (2013.01); *A63B 2209/10* (2013.01)

(56) References Cited

U.S. PATENT DOCUMENTS 1,349,806 A 8/1920 Booth
1,361,258 A 12/1920 Horton
1,412,650 A 4/1922 Booth
1,452,845 A 4/1923 Pryde
1,455,379 A 5/1923 Allen
1,552,297 A 9/1925 Harness
1,559,299 A 10/1925 Barach
1,574,213 A 2/1926 Tyler
1,575,364 A 3/1926 Hodgkins
1,665,523 A 4/1928 Boyce
1,705,997 A 3/1929 Williams
1,879,117 A 9/1932 Davidson
2,076,340 A 4/1937 William
2,163,091 A 6/1939 Held
2,171,383 A 8/1939 Wettlaufer
3,096,982 A 7/1963 Bassin
3,166,320 A 1/1965 Onions
3,524,646 A 8/1970 Wheeler
3,556,533 A 1/1971 Hollis
3,640,534 A 2/1972 Mills
3,692,306 A 9/1972 Glover
3,866,348 A * 2/1975 Roby ..... A63H 3/16 273/276
3,941,390 A 3/1976 Hussey
3,966,210 A 6/1976 Rozmus
D240,644 S 7/1976 Manfrin
3,979,123 A 9/1976 Belmont
3,985,363 A 10/1976 Jepson et al.
4,021,047 A 5/1977 Mader
4,043,563 A 8/1977 Churchward
4,052,075 A 10/1977 Daly
4,063,737 A 12/1977 Tom et al.
4,067,572 A 1/1978 Coleman
4,085,934 A 4/1978 Churchward
4,193,601 A 3/1980 Reid, Jr. et al.
4,194,739 A 3/1980 Thompson
D262,049 S 11/1981 Simmons
4,313,607 A 2/1982 Thompson
4,325,553 A 4/1982 Taylor
4,340,230 A 7/1982 Churchward
4,385,467 A * 5/1983 Samuels ..... A63F 9/1011 273/157 R
4,432,549 A 2/1984 Zebelean
4,438,931 A 3/1984 Motomiya
4,502,687 A 3/1985 Kochevar
4,653,756 A 3/1987 Sato
4,714,577 A 12/1987 Nagamoto et al.
4,762,322 A 8/1988 Molitor et al.
4,767,298 A 8/1988 Bocchicchio et al.
4,792,140 A 12/1988 Yamaguchi et al.
4,869,507 A 9/1989 Sahm
4,872,683 A 10/1989 Doran et al.
4,872,685 A 10/1989 Sun
4,883,275 A 11/1989 Boone
4,895,371 A 1/1990 Bushner
4,930,781 A 6/1990 Allen
5,039,098 A 8/1991 Pelz
5,050,879 A 9/1991 Sun et al.
5,135,227 A 8/1992 Okumoto et al.
5,186,465 A 2/1993 Chorne
5,205,560 A 4/1993 Hoshi et al.
5,213,328 A 5/1993 Long et al.
5,255,913 A 10/1993 Tsuchida
5,272,802 A 12/1993 Stites, III
5,294,037 A 3/1994 Schmidt
5,310,186 A 5/1994 Karsten
5,328,176 A 7/1994 Lo
5,346,217 A 9/1994 Tsuchiya et al.
5,388,827 A 2/1995 Reynolds, Jr.
5,429,365 A 7/1995 McKeighen
5,433,442 A 7/1995 Walker
5,435,558 A 7/1995 Iriarte
5,447,309 A 9/1995 Vincent
5,464,216 A 11/1995 Hoshi et al.
5,474,297 A 12/1995 Levin
5,482,281 A 1/1996 Anderson
5,484,155 A 1/1996 Yamawaki et al.
5,509,660 A 4/1996 Elmer
5,518,240 A 5/1996 Igarashi
5,518,243 A 5/1996 Redman
5,540,435 A 7/1996 Kawasaki
5,547,188 A 8/1996 Dumontier et al.
5,582,553 A 12/1996 Ashcraft et al.
5,586,944 A 12/1996 Nagamoto et al.
5,620,378 A * 4/1997 Fritz ..... A63B 47/002 206/315.9
5,624,331 A 4/1997 Lo et al.
5,665,014 A 9/1997 Sanford et al.
5,683,309 A 11/1997 Reimers
5,769,736 A 6/1998 Sato
5,776,011 A 7/1998 Su et al.
5,785,609 A 7/1998 Sheets et al.
5,788,587 A 8/1998 Tseng
5,797,176 A 8/1998 Rose et al.
5,807,188 A 9/1998 Serrano et al.
5,816,927 A 10/1998 Taylor
5,842,935 A 12/1998 Nelson
5,871,784 A 2/1999 Assink et al.
5,911,638 A 6/1999 Parente et al.
5,916,042 A 6/1999 Reimers
5,935,020 A 8/1999 Stites et al.
5,947,840 A 9/1999 Ryan
5,971,867 A 10/1999 Galy
5,997,415 A 12/1999 Wood
D418,885 S 1/2000 Wanchena
6,012,989 A 1/2000 Saksun, Sr.
6,033,318 A 3/2000 Drajan, Jr. et al.
6,059,669 A 5/2000 Pearce
6,074,308 A 6/2000 Domas
6,077,171 A 6/2000 Yoneyama
6,089,994 A 7/2000 Sun
6,102,813 A 8/2000 Dill
6,123,627 A 9/2000 Antonious
6,139,446 A 10/2000 Wanchena
6,149,534 A 11/2000 Peters et al.
6,162,133 A 12/2000 Peterson
6,183,377 B1 2/2001 Liang
6,217,461 B1 4/2001 Galy
6,248,025 B1 6/2001 Murphy et al.
6,248,026 B1 6/2001 Wanchena
6,254,494 B1 7/2001 Hasebe et al.

(56) References Cited

U.S. PATENT DOCUMENTS 6,277,032 B1 8/2001 Smith
6,280,349 B1 * 8/2001 Cook ..... A63B 53/04 473/345
6,296,470 B1 10/2001 Lanser et al.
6,306,048 B1 10/2001 McCabe et al.
6,332,848 B1 12/2001 Long et al.
6,340,337 B2 1/2002 Hasebe et al.
6,354,962 B1 3/2002 Galloway et al.
6,354,963 B1 3/2002 Kodama et al.
6,379,265 B1 4/2002 Hirakawa et al.
6,409,612 B1 6/2002 Evans et al.
6,422,951 B1 7/2002 Burrows
6,440,009 B1 8/2002 Guibaud et al.
6,442,951 B1 9/2002 Maeda et al.
6,471,604 B2 10/2002 Hocknell et al.
6,482,106 B2 11/2002 Saso
6,514,154 B1 2/2003 Finn
6,547,673 B2 4/2003 Roark
6,558,271 B1 5/2003 Beach et al.
6,565,425 B1 5/2003 Wuensch
6,565,452 B2 5/2003 Helmstetter et al.
6,572,491 B2 6/2003 Hasebe et al.
6,575,845 B2 6/2003 Galloway et al.
6,592,468 B2 7/2003 Vincent et al.
6,592,469 B2 7/2003 Gilbert
6,602,149 B1 8/2003 Jacobson
6,623,378 B2 9/2003 Beach et al.
6,645,086 B1 11/2003 Chen
6,648,773 B1 11/2003 Evans
6,695,608 B2 2/2004 Murphy et al.
6,716,114 B2 4/2004 Nishio
6,739,982 B2 5/2004 Murphy et al.
6,739,983 B2 5/2004 Helmstetter et al.
6,739,984 B1 5/2004 Ciasullo
6,769,996 B2 8/2004 Tseng
6,773,360 B2 8/2004 Willett et al.
6,776,723 B2 8/2004 Bliss et al.
6,840,755 B1 1/2005 Cook
6,860,818 B2 3/2005 Mahaffey
6,860,823 B2 3/2005 Lee
6,863,620 B2 3/2005 Tucker, Sr.
6,872,152 B2 3/2005 Beach et al.
6,890,267 B2 5/2005 Mahaffey
6,896,625 B2 5/2005 Grace
6,902,497 B2 6/2005 Deshmukh et al.
6,913,542 B1 7/2005 Hu et al.
6,913,546 B2 7/2005 Kakiuchi
6,921,343 B2 7/2005 Solheim
6,926,615 B1 8/2005 Souza et al.
6,929,565 B2 8/2005 Nakahara et al.
6,932,875 B2 8/2005 Cheng et al.
6,955,612 B2 10/2005 Lu
6,988,956 B2 1/2006 Cover et al.
6,991,555 B2 1/2006 Reese
6,991,558 B2 1/2006 Beach et al.
7,004,852 B2 2/2006 Billings
7,008,332 B2 3/2006 Liou
7,022,030 B2 4/2006 Best et al.
7,025,692 B2 4/2006 Erickson et al.
7,041,005 B2 5/2006 Beach et al.
7,063,629 B2 6/2006 Nakahara et al.
7,070,517 B2 7/2006 Cackett et al.
7,094,159 B2 8/2006 Takeda
7,108,609 B2 9/2006 Stites et al.
7,128,664 B2 10/2006 Onoda et al.
7,140,974 B2 11/2006 Chao et al.
7,147,573 B2 12/2006 DiMarco
7,156,752 B1 1/2007 Bennett
7,160,040 B2 1/2007 Matsushima
7,163,468 B2 1/2007 Gibbs et al.
7,166,038 B2 1/2007 Williams et al.
7,166,040 B2 1/2007 Hoffman et al.
7,169,060 B2 1/2007 Stevens et al.
7,175,541 B2 2/2007 Lo
7,186,190 B1 3/2007 Beach et al.
7,204,768 B2 4/2007 Nakahara et al.
7,217,199 B2 5/2007 Nakahara et al.
7,244,188 B2 7/2007 Best
7,252,599 B2 8/2007 Hasegawa
7,258,624 B2 8/2007 Kobayashi
7,258,625 B2 8/2007 Kawaguchi et al.
7,281,993 B2 10/2007 Oyama
7,297,072 B2 11/2007 Meyer et al.
7,303,487 B2 12/2007 Kumamoto
7,338,390 B2 3/2008 Lindsay
D567,888 S 4/2008 Soracco
7,371,191 B2 5/2008 Sugimoto
7,377,860 B2 5/2008 Breier et al.
7,419,441 B2 9/2008 Hoffman et al.
7,491,131 B2 2/2009 Vinton
7,524,149 B2 4/2009 Heule et al.
7,524,249 B2 4/2009 Breier et al.
7,530,901 B2 5/2009 Imamoto et al.
7,549,933 B2 6/2009 Kumamoto
7,566,279 B2 7/2009 Nakashima
7,625,298 B2 12/2009 Bennett
7,632,195 B2 12/2009 Jorgensen
7,658,686 B2 2/2010 Soracco
7,753,809 B2 7/2010 Cackett et al.
7,758,451 B2 7/2010 Liang et al.
7,771,290 B2 8/2010 Bezilla et al.
7,789,766 B2 9/2010 Morris et al.
7,803,065 B2 9/2010 Breier et al.
7,806,782 B2 10/2010 Stites et al.
7,819,754 B2 10/2010 Evans et al.
7,854,665 B2 12/2010 Dewhurst et al.
7,938,740 B2 5/2011 Breier et al.
7,959,522 B2 6/2011 North, III et al.
7,980,964 B2 7/2011 Soracco
8,007,371 B2 8/2011 Breier et al.
8,033,930 B2 10/2011 Tavares et al.
8,038,545 B2 10/2011 Soracco
8,057,323 B2 11/2011 Liang et al.
8,062,151 B2 11/2011 Boyd et al.
8,133,128 B2 3/2012 Boyd et al.
8,133,129 B2 3/2012 Boyd et al.
8,162,776 B2 4/2012 Boyd et al.
8,206,243 B2 6/2012 Stites
8,303,433 B2 11/2012 Roach et al.
8,337,319 B2 12/2012 Sargent et al.
8,376,873 B2 2/2013 Golden et al.
8,382,607 B2 2/2013 Burnett et al.
8,435,135 B2 5/2013 Stites et al.
8,523,705 B2 9/2013 Breier et al.
8,585,514 B2 11/2013 Boyd et al.
8,834,294 B1 9/2014 Seluga et al.
9,067,110 B1 6/2015 Seluga et al.
2001/0001302 A1 5/2001 Murphy et al.
2001/0049310 A1 12/2001 Cheng et al.
2002/0045490 A1 4/2002 Ezawa et al.
2002/0077195 A1 6/2002 Carr et al.
2002/0137576 A1 9/2002 Dammen
2002/0160858 A1 10/2002 Lee
2003/0045371 A1 3/2003 Wood et al.
2003/0100381 A1 5/2003 Murphy et al.
2003/0130059 A1 7/2003 Billings
2003/0134690 A1 7/2003 Chen
2003/0134693 A1 7/2003 Nakahara et al.
2003/0144078 A1 7/2003 Setokawa et al.
2003/0162608 A1 8/2003 Chen
2004/0116207 A1 6/2004 De Shiell et al.
2004/0116208 A1 6/2004 De Shiell et al.
2004/0138002 A1 7/2004 Murray
2004/0176177 A1 9/2004 Mahaffey et al.
2004/0192468 A1 9/2004 Onoda et al.
2004/0224790 A1 11/2004 Lu
2004/0242343 A1 12/2004 Chao et al.
2004/0254030 A1 12/2004 Nishitani et al.
2005/0026723 A1 2/2005 Kumamoto
2005/0090330 A1 4/2005 Kumamoto
2005/0101408 A1 5/2005 Sanchez et al.
2005/0119070 A1 6/2005 Kumamoto
2005/0159243 A1 7/2005 Chuang
2005/0170907 A1 8/2005 Saso

(56) References Cited

U.S. PATENT DOCUMENTS

| | | | | |
|---|---|---|---|---|
| 2005/0215354 | A1 | 9/2005 | Kumamoto | |
| 2005/0272527 | A1 | 12/2005 | Sugimoto | |
| 2006/0014592 | A1 | 1/2006 | Sugimoto | |
| 2006/0052177 | A1 | 3/2006 | Nakahara et al. | |
| 2006/0052181 | A1 | 3/2006 | Serrano et al. | |
| 2006/0084525 | A1 | 4/2006 | Imamoto et al. | |
| 2006/0100032 | A1 | 5/2006 | Imamoto et al. | |
| 2006/0105855 | A1 | 5/2006 | Cackett et al. | |
| 2006/0116218 | A1 | 6/2006 | Burnett et al. | |
| 2006/0240907 | A1 | 10/2006 | Latiri | |
| 2007/0054751 | A1 | 3/2007 | Breier et al. | |
| 2007/0060414 | A1 | 3/2007 | Breier et al. | |
| 2007/0249432 | A1 | 10/2007 | Wu | |
| 2007/0265109 | A1 | 11/2007 | Elmer | |
| 2008/0058117 | A1 | 3/2008 | Roach | |
| 2008/0070721 | A1 | 3/2008 | Chen et al. | |
| 2008/0102975 | A1 | 5/2008 | Chen | |
| 2008/0102978 | A1 | 5/2008 | Burnett et al. | |
| 2008/0227564 | A1 | 9/2008 | Breier et al. | |
| 2008/0230948 | A1 | 9/2008 | Salvador et al. | |
| 2008/0242445 | A1 | 10/2008 | Mergy et al. | |
| 2008/0261715 | A1 | 10/2008 | Carter | |
| 2008/0268980 | A1 | 10/2008 | Breier et al. | |
| 2008/0293510 | A1 | 11/2008 | Yamamoto | |
| 2009/0105010 | A1 | 4/2009 | De La Cruz et al. | |
| 2009/0118034 | A1 | 5/2009 | Yokota | |
| 2009/0186717 | A1 | 7/2009 | Stites et al. | |
| 2009/0203465 | A1 | 8/2009 | Stites et al. | |
| 2010/0041490 | A1 | 2/2010 | Boyd et al. | |
| 2010/0041493 | A1 | 2/2010 | Clausen et al. | |
| 2010/0041495 | A1* | 2/2010 | North, III et al. . | A63B 53/0466 473/346 |
| 2010/0105499 | A1 | 4/2010 | Roach et al. | |
| 2010/0130304 | A1 | 5/2010 | Soracco | |
| 2010/0130305 | A1 | 5/2010 | Soracco | |
| 2010/0160091 | A1 | 6/2010 | Boyd et al. | |
| 2010/0261543 | A1 | 10/2010 | Breier et al. | |
| 2010/0331103 | A1 | 12/2010 | Takahashi et al. | |
| 2011/0021282 | A1 | 1/2011 | Sander | |
| 2011/0045921 | A1 | 2/2011 | Evans | |
| 2011/0053706 | A1 | 3/2011 | Breier et al. | |
| 2011/0081986 | A1 | 4/2011 | Stites | |
| 2011/0098128 | A1 | 4/2011 | Clausen et al. | |
| 2011/0111885 | A1 | 5/2011 | Golden et al. | |
| 2011/0159986 | A1 | 6/2011 | Chao et al. | |
| 2011/0207547 | A1 | 8/2011 | Sander et al. | |
| 2011/0312437 | A1 | 12/2011 | Sargent et al. | |
| 2012/0064991 | A1 | 3/2012 | Evans | |
| 2012/0129621 | A1 | 5/2012 | Boyd et al. | |
| 2013/0178306 | A1 | 7/2013 | Beno et al. | |

FOREIGN PATENT DOCUMENTS

| | | | |
|---|---|---|---|
| JP | 2000-024149 | A | 1/2000 |
| JP | 2002-336389 | A | 11/2002 |
| JP | 2003-093554 | A | 4/2003 |
| JP | 2003-310808 | A | 11/2003 |
| JP | 2004-121744 | A | 4/2004 |
| JP | 2004-159680 | A | 6/2004 |
| JP | 2004-337327 | A | 12/2004 |
| JP | 2006-25929 | | 2/2006 |
| JP | 2006-025929 | A | 2/2006 |
| JP | 2006-130065 | A | 5/2006 |
| WO | 2004/052472 | A1 | 6/2004 |
| WO | 2007/101350 | A1 | 9/2007 |

OTHER PUBLICATIONS

Final Office Action dated Oct. 1, 2008 of corresponding U.S. Appl. No. 11/110,733.

Jackson, Jeff, The Modern Guide to Golf Clubmaking, Ohio: Dynacraft Golf Products, Inc. copyright 1994, p. 239.

Japanese Office Action for Application No. 2007-311561, dated Jun. 30, 2010, in 7 pages.

Japanese Office Action titled Pretrial Reexamination Report for Japanese Application No. 2007-085624, (Appeal Trial No. 2010-009497), dated Jul. 7, 2010, in 6 pages.

Non-Final Office Action dated Dec. 31, 2007 of corresponding U.S. Appl. No. 11/110,733.

Non-Final Office Action dated Dec. 7, 2009 of corresponding U.S. Appl. No. 11/898,756.

Non-Final Office Action dated Jun. 12, 2008 of corresponding U.S. Appl. No. 11/363,098.

Non-Final Office Action dated Jun. 5, 2007 of corresponding U.S. Appl. No. 11/110,733.

Non-Final Office Action dated May 20, 2009 of corresponding U.S. Appl. No. 11/110,733.

Non-Final Office Action dated Nov. 13, 2009 of corresponding U.S. Appl. No. 11/600,081.

Non-Final Office Action dated Oct. 27, 2009 of corresponding U.S. Appl. No. 11/591,588.

Notice of Allowance dated Dec. 31, 2008 of corresponding U.S. Appl. No. 11/363,098.

Notice of Allowance dated Sep. 28, 2009 of corresponding U.S. Appl. No. 11/110,733.

* cited by examiner

GOLF CLUB WITH MULTI-COMPONENT CONSTRUCTION

CROSS-REFERENCE TO RELATED APPLICATIONS

This application is a continuation of U.S. patent application Ser. No. 13/545,329, filed Jul. 10, 2012, which is a continuation-in-part of U.S. patent application Ser. No. 13/185,324, filed Jul. 18, 2011, now issued as U.S. Pat. No. 8,226,499, which is a Continuation of U.S. patent application Ser. No. 12/696,468, filed Jan. 29, 2010, now issued as U.S. Pat. No. 7,980,964, which is a continuation of U.S. patent application Ser. No. 11/110,733, filed Apr. 21, 2005, now issued as U.S. Pat. No. 7,658,656, the contents of each of which are herein incorporated by reference in their entirety. U.S. patent application Ser. No. 13/545, is also a continuation-in-part of U.S. patent application Ser. No. 13/539,958, filed Jul. 2, 2012, which claims priority to U.S. Provisional patent application Ser. No. 61/503,509, filed Jul. 30, 2011, the contents of each of which are herein incorporated by reference in their entirety. U.S. patent application Ser. No. 13/545,329 is also continuation-in-part of U.S. patent application Ser. No. 13/407,807, filed Feb. 28, 2012, which is a continuation-in-part of U.S. patent application Ser. No. 12/643,154, filed Dec. 21, 2009, now issued as U.S. Pat. No. 8,147,354, the contents of each of which are herein incorporated by reference in their entirety.

FIELD OF THE INVENTION

The present invention relates to a golf club, and more particularly to a wood-type club head with separable components.

BACKGROUND

Historically, an engineer will design a golf club in way that seeks to optimize multiple properties of the finished club. The engineer will chose a shape and size for a club head based on aerodynamics, PGA rules, manufacturing capabilities, and consumer preferences. Within a club head, the engineer will design a mass distribution that provides an acceptable overall compromise of moment of inertia, center of gravity, and weight for the variety of customers who may purchase the club. Once the structure of the club head is designed, it will be finished with colors, surface treatments, logos, and trim in hopes that wide range of people will find the club head attractive. Sometimes a golf company will offer a club in two or a few different finishes and trim levels, in hopes of appealing to more golfers.

Because a number of properties of a club head are influenced by mass distribution and materials, designing a golf club has traditionally been a one-size-fits-all exercise. While some clubs are offered with adjustable weight members or shafts, many properties such as mass distribution, color, aerodynamics, and turf interaction reflect a lowest-common-denominator design paradigm. To offer consumers variety in these properties, golf companies generally must design an entirely new club.

SUMMARY

The invention provides a club head with interchangeable components or body members. Components of the invention can be interchanged manually or through the use of tools. In some embodiments, components may be assembled without the use of adhesives, screws, and/or welding. Providing club heads with interchangeable components allows a golf company to provide personalized clubs. Each club can be made to appeal to an individual golfer, and the qualities of the club can rise to meet the individual golfer's highest standards, rather than reflecting the lowest-common-denominator found in integrally formed, mass-produced club heads.

Further, the invention includes the insight that the hosel and a fore portion of the ball-striking area embody core structural functionality and are well-suited to being provided as a body component to be coupled to interchangeable aft body components. Further, by extending the fore body component or face body component rearwards in the sole area, the aft body components can be provided with lightweight materials such as plastics or composites yielding a desirable distribution of strength and mass within a club head. The connection between the hosel and the ball-striking area is strong, and mass is distributed to lower a center of gravity, optimize a moment of inertia, or both.

Further, the invention adopts the insight that modern club heads may benefit from releasable functional components, such as weight elements or face-angle adjusters on a sole, and that these components offer an unexpected benefit in terms of a fastening mechanism for releasable/interchangeable aft bodies and similar components. Similarly, the invention provides the insight that mechanisms associated with interchangeable and repositionable shafts can be developed to provide a fastening mechanism for an interchangeable component.

In certain aspects, the invention provides a golf club head with a first body member and a second body member interchangeably coupleable to the first body member at an attachment perimeter to create a playable club. The invention further provides a variety of insights and mechanisms for coupling the interchangeable member to the body member. For example, a first body member can include a boss for receiving a releasable shaft and the second body member can include a portion, such as an extended tab with a shaft screw bore, that is adapted so that the second body member is fastened in place by fastening the shaft to the first body member. In some embodiments, the first and second bodies are coupled by mating a plurality of posts on one of the two bodies with a plurality of corresponding holes on the other of the two bodies.

In some embodiments, the second body member is coupled to the first through the use of a functional component that releasably couples to the club head. The functional component can be, for example, a weight screw with a threaded post dimensioned to pass through a hole in the second body member and be screwed into a threaded hole in the first body member.

A strong club head is provided with good sound characteristics and a good coefficient of restitution by optimizing the distribution of material between the components. For example, in certain embodiments, the second body member is an aft body member with a majority of a crown of the club head, a majority of a heel-side skirt of the club head, and a majority of a toe-side skirt of the club head. In such embodiments, the aft body couples to the main body to provide a driver. The main body member includes a face cup, a hosel, and a majority of a sole of the club head.

An aft body member can connect to, and separate from, a fore body member at an attachment perimeter that circumscribes the club head. For example, the attachment perimeter can define a "clean break"—i.e., the attachment perimeter can lie substantially within a plane. In some embodiments, the attachment perimeter lies substantially with a plane that is substantially vertical when the club is at address, such that the aft body pulls cleanly away from the fore body.

Further, the invention provides attachment lines, or seams, that need not be straight. The invention includes the insight that non-straight coupling edges exhibit functional benefits not expected to be found in straight coupling edges. For example, attachment along a wavy edge ensures that two components come together in a proper orientation and gives a user a visual clue as to which components will fit together.

In related aspects, the invention provides a fore body member comprising a hosel, a portion of a sole, and at least a portion of a ball-striking face and one or more interchangeable aft body members releasably couplable to the fore body member by a mechanism. The mechanism can include a snap-fit mechanism, such as a cantilever with a protruding tip and a corresponding a recess to receive the protruding tip. In certain embodiments, the mechanism includes barbed posts, adhesives, slots with corresponding press-fit tabs, magnets, or other suitable mechanisms. In some embodiments, the invention provides a cam-based mechanism for coupling the aft body to the fore body.

A cam can provide the leverage needed so that a golfer can manually create a powerful press-fit between two components. In some embodiments, operation of a cam causes engagement hooks to engage with a receiving portion to fasten the aft body member to the fore body member. A cam can include a tool engagement surface or can be adapted to be fully manually operated.

In another aspect, the invention provides a kit for assembling a golf club head. The kit includes a fore body having a hosel, part of a ball-striking face, and an attachment mechanism. The kit further includes multiple aft bodies that can be interchanged.

Another aspect of at least one of the embodiments described herein includes the realization that it would be advantageous to have a club head with a removable insert panels that include materials of different weights and densities so that different panels can be interchanged to distribute mass differently. This allows weight to be distributed within a club head according to a golfer's individual desires.

In certain aspects, the invention provides a club head in which a body member has an opening for a crown insert and an attachment feature (such as a flange) with a crown insert attached there. The crown insert can be a lightweight material (e.g., plastic). In some embodiments, a crown insert is divided by strut-like divider elements, which can modulate the club head physics properties. For example, the dividers may be flexible, non-plastic ribs that divide the crown insert into four plastic sections.

In some embodiments, a club includes a releasably attached weight member that can be added or interchanged with one another to adjust the club head weight, center of gravity, moment of inertia, or a combination thereof. The weight members may have threaded posts that can be screwed into corresponding threaded holes in the club head.

In certain aspects, the invention provides a club head having a body with an opening to receive an insert panel. An attachment feature (such as a flange) at the opening presents a surface for attaching the insert panel. The surface may optionally have holes on or through it. The holes can increase surface area and thus increase bonding strength of an adhesive used to attach the insert. Alternatively, the insert may have a plurality of protrusions to extend through the holes for attachment (e.g., posts that exhibit a tight press-fit; barbed posts; threaded posts to receive a nut element; etc.). A gasket may be positioned at the flange to dampen vibration or modulate weight.

In some embodiments, the insert is attached to the body by a snap-fit assembly, without the use of adhesives or welding. For example, the snap-fit assembly can include cantilevers with protruding tips and a recess corresponding to each tip (e.g., cantilevers on body member and recesses on insert, or vice versa). In some embodiments, the snap-fit assembly includes a collar adapted to be swaged onto a post for attachment and unscrewed with a wrench for removal.

Different inserts can be provided as a set, or as a variety of individual items to be purchased at a store, thus allowing a golfer to customize their club.

In certain aspects, the invention provides a large wood-type golf club head with a concave insert. The club head is formed of a plurality of body members that define an interior volume. A first body member is made of an optionally metallic material and includes a sole portion and a face portion. A second body portion is made of a light weight material, such as plastic, composite, or a very thin sheet of low density metallic material. The second body portion makes up at least a portion of the club head skirt, and includes one or more concave indentations that extend into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

DETAILED DESCRIPTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
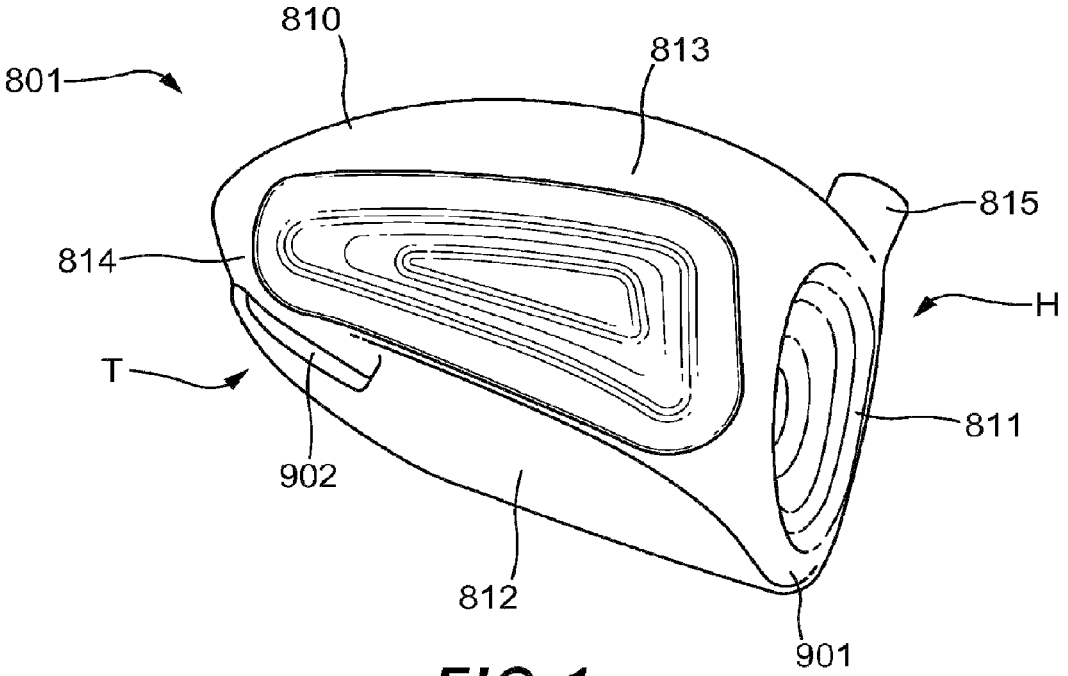
FIG. 1 shows a golf club head of the present invention.

FIG. 1 shows a golf club head 801 of the present invention. The club head 801 includes a body 810 having a strike face 811, a sole 812, a crown 813, a skirt 814, and a hosel 815. The body 810 defines a hollow, interior volume 816. Foam or other material may partially or completely fill the interior volume 816. Weights may optionally be included within the interior volume 816. The face 811 maybe provided with grooves or score lines therein of varying design. The club head 801 has a toe T and a heel H.

Figure 2:
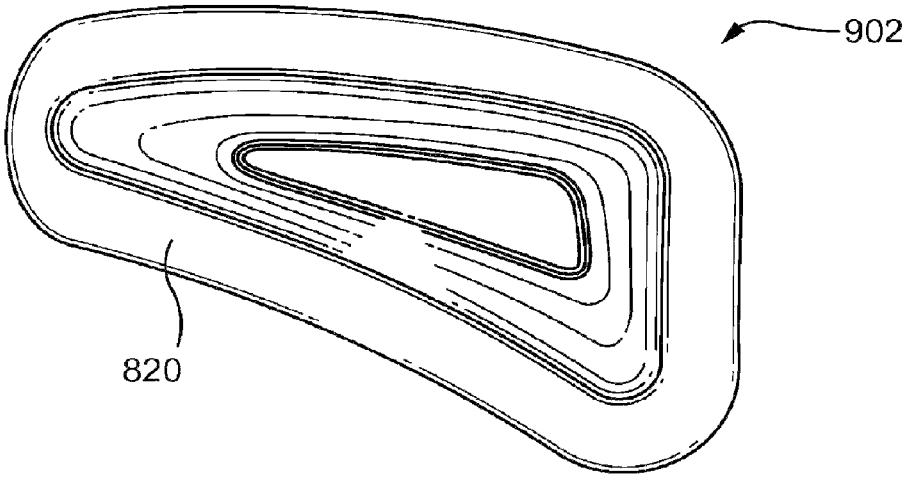
FIG. 2 shows a body member of the golf club head of FIG. 1.

The club head 801 is comprised of a plurality of body members that cooperatively define the interior volume 816. In certain embodiments, a first body member 901 includes a sole portion and a face portion (i.e., is a fore body member). The first body member may include a complete face 811 and sole 812. Alternatively, either or both the face 811 and the sole 812 can be inserts coupled to the first body member 901. The club head 801 also includes at least one second body member 902 coupled to the first body member 901 along the skirt 814 in known fashion. The crown 813 can be unitarily a portion of either body member 901, 902 or it may be an insert coupled to either of the body members 901, 902. The second body member 902 includes a concave portion 820 that, when the body members 901, 902 are coupled together, extends inward into the interior volume 816. FIG. 2 shows an isolated view of an exemplary second body member 902.

The first body member 901 preferably is formed of a metallic material such as stainless steel, aluminum, or titanium. The material of the first body member 901 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 801, such as the skirt 814, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 801. These portions of the club head 801 can also be made thinner, enhancing the weight savings. Exemplary uses for this redistributed weight include increasing the overall size of the club head 801, expanding the size of the club head "sweet spot," which is a term that refers to the area of the face 811 that results in a desirable golf shot upon striking a golf ball, repositioning the club head 801 center of gravity, and/or produce a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 801, such as the heel H, the toe T, or the sole 812, maximizes the opportunity to enlarge the sweet spot or produce a greater MOI, making the golf club hotter and more forgiving.

FIG. 2 shows second body member 902, which is preferably light-weight, which gives the opportunity to displace the club head center of gravity downward and to free weight for more beneficial placement elsewhere without increasing the overall weight of the club head 801. When the wall thickness of the second body member 902 is at the minimum range of the preferred thickness, a reinforcing body layer can be added in the critical areas in case the member shows deformations. These benefits can be further enhanced by making the second body member 902 thin. To ensure that the structural integrity of the club head 801 is maintained, these thin panels may preferably include a concave portion 820. Inclusion of these concave portions 820 allow the second body member 902 to withstand greater stress—both longitudinally and transversely—without sustaining permanent deformation, ensuring the structural integrity of the club head 801 is maintained. In some embodiments, thicknesses for the first body member 901 include from 0.03 inch to 0.05 inch, while thicknesses for the second body member 902 include from 0.015 inch to 0.025 inch. Preferably, the concave portion 820 displaces at least 10 cubic centimeters. More preferably, the concave portion 820 displaces at least 25 cubic centimeters. While the club head 801 can be virtually any size, preferably it is a legal club head. A plurality of concave portions 820 may be used with the club head 801. For example, concave portions 820 of uniform or varying size may be positioned in the toe, heel, back, etc.

Figure 3:
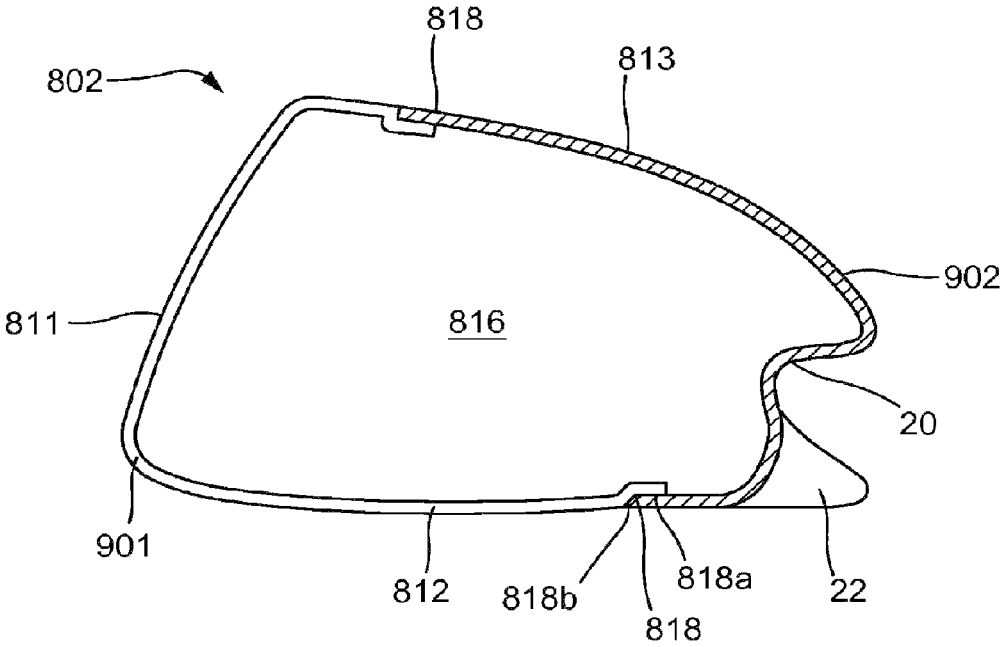
FIG. 3 shows a second club head of the present invention.

FIG. 3 shows a cross-sectional view taken substantially perpendicular to the face 811 of a second club head 802 of the present invention. In this illustrative embodiment, the concave portion 820 is positioned at the back of the club head 802.

Figure 4:
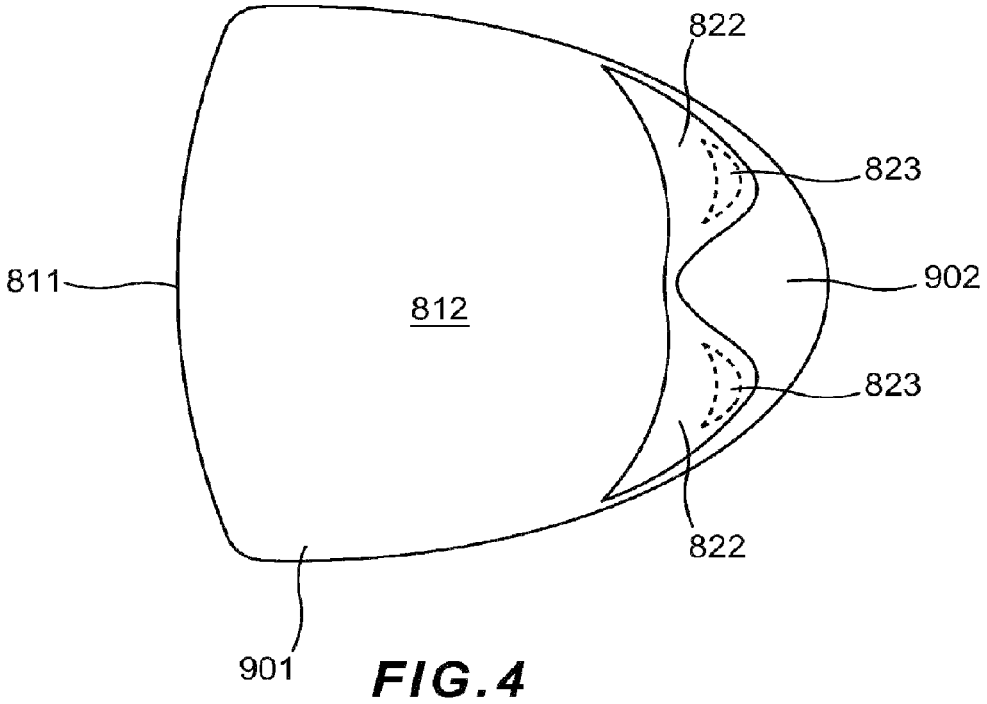
FIG. 4 shows a bottom view of the club head of FIG. 3.

FIG. 4 shows a bottom view of the club head 802. The concave portion 820 preferably is not visible to the golfer at address. In addition to the concave portion 820, the second body member 902 further includes a convex bulge 822 that extends generally away from the interior volume 816. An insert 823 may be positioned within the convex bulge.

In certain embodiments, insert 823 is not visible from outside the club head 802. In a preferred embodiment, the insert 823 is a weight insert. The convex nature of the bulge 823 allows the weight to be positioned to maximize the mechanical advantage it lends to the club head 802. As shown in FIG. 4, the club head 802 may include a plurality of convex bulges 822, such as on a heel side and on a toe side of the club head 802. The club designer may place inserts 823 as desired within the bulges 822. The masses of the inserts may be substantially equal. Alternatively, one of the inserts may have a greater mass than the other. This may be beneficial to design the club to correct a hook swing or a slice swing. A preferred mass range for the weight insert 823 is from 1 gram to 50 grams.

As shown in FIG. 3, the first body member 901 may comprise a majority of the sole 812 and the second body member 902 may include a majority of the crown 813. This beneficially removes a large majority of the mass from the upper part of the club head 802. In this embodiment the first body member 901 includes an attachment perimeter 818 that extends around its edge. The second body member 902 is coupled to the first body member 901 along the attachment perimeter 818. The first and second body members 901, 902 cooperatively define the interior volume 816. The attachment perimeter 818 preferably may contain a step defining two attachment surfaces 818*a*, 818*b*. As illustrated, the second body member 902 maybe coupled to both of these surfaces 818*a*, 818*b* to help ensure a strong bond between the body members 901, 902.

While the body members 901, 902 may be formed in a variety of manners, some embodiments include forming a complete club head shell (first body member 901) in known manner and removing material to create openings to which the second body member 902 can be coupled. The opening may be created in any desired manner, such as with a laser. The second body member 902 may be joined to the first body member 901 in a variety of manners, such as through bonding or through a snap-fit in conjunction with bonding. If a composite material is used for the concave inserts, molding six plies of 0/90/45/-45/90/0 is preferred.

Figure 5A:
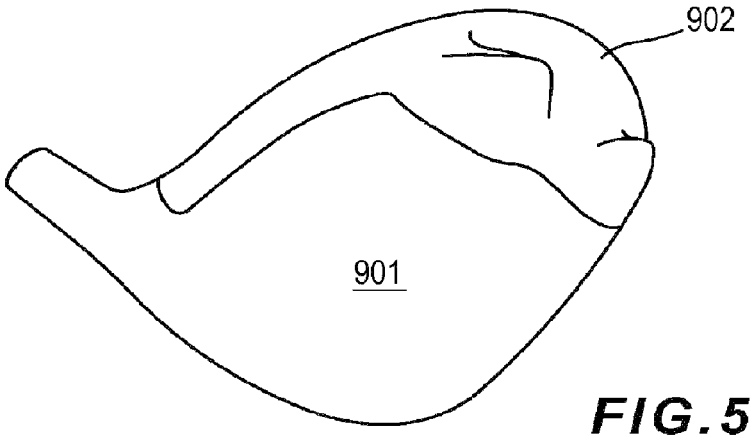
FIGS. 5A-5C give additional views of the club head shown in FIGS. 3 and 4.
Figure 5B:
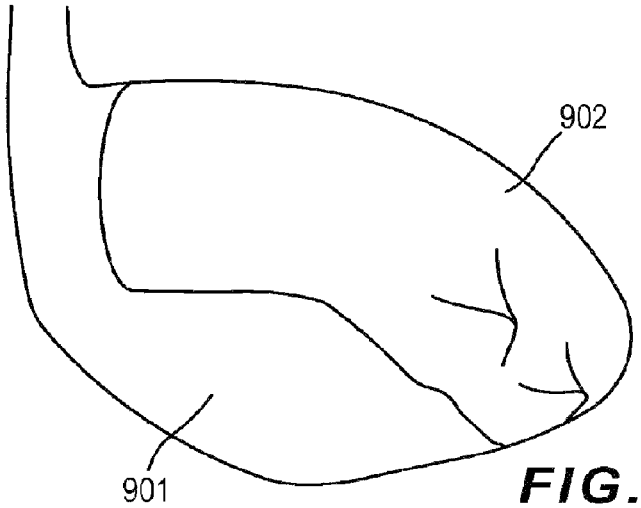
Figure 5C:
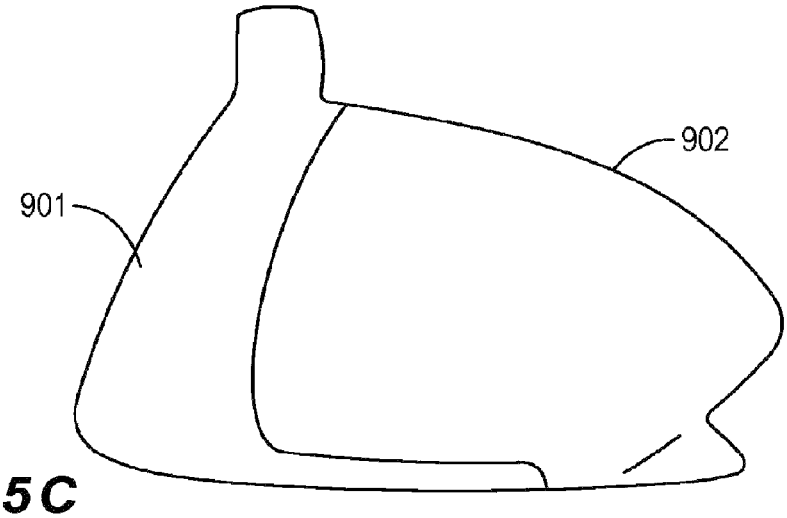

FIGS. 5A-5C give several views of the club head shown in FIGS. 3 and 4 to aid in seeing the relation of a fore body member 901 to an interchangeable aft body 902 in certain embodiments. In some embodiments, one of the body members includes a protruding flange around the attachment perimeter such that the club head can be assembled with a press fit by simply pressing the two body members together. In other embodiments, a first and second body member are coupled by a mechanical fastening system.

Figure 6A:
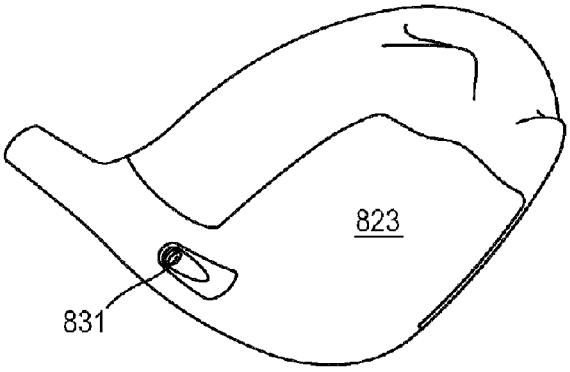
FIGS. 6A and 6B show a club head with concave component as separable aft body.
Figure 6B:
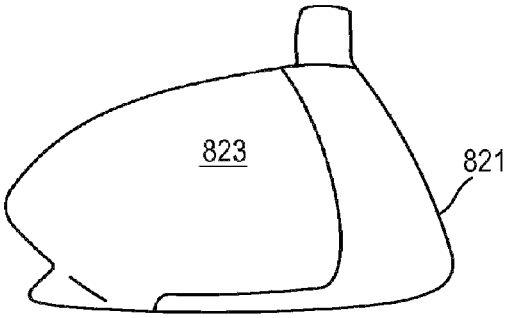

FIGS. 6A and 6B show mechanical fastening system adaptable for use in a club head with an interchangeable or repositionable shaft. Fore body member 823 includes a recess 831 in a heel-sole area where a shaft sleeve screw is inserted to engage an end of a shaft.

Figure 7:
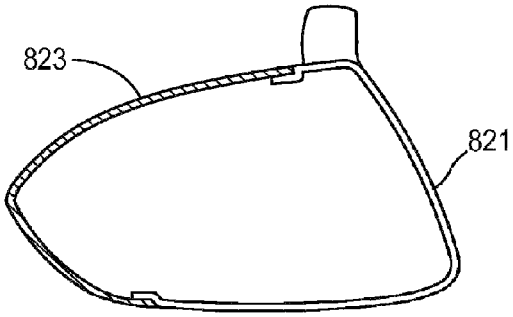
FIG. 7 is a cross-section of the club shown in FIGS. 6A and 6B.

FIG. 7 is a cross-section of the club shown in FIGS. 6A and 6B. The shaft engagement mechanism is primarily provided by fore body member 821 and can be seen in FIG. 8.

Figure 8:
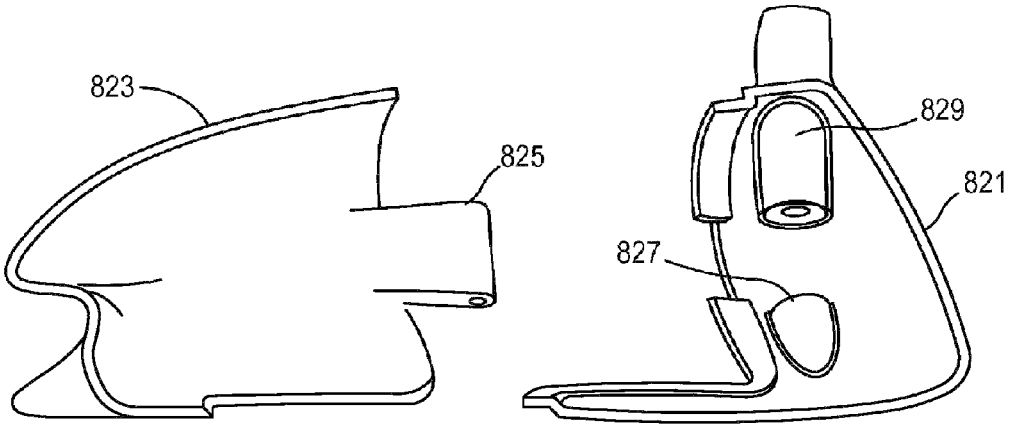
FIG. 8 is a cutaway view of the club shown in FIGS. 6A and 6B.

FIG. 8 is a cutaway view of the club shown in FIGS. 6A and 6B. Aft body member 823 includes a protruding arm 825 with a hole therethrough. Fore body member 821 includes hosel boss 829 and insert boss 827 (i.e., the inside shell of recess 831). When aft body member 823 is mated to fore body member 821, the body members come together to form a club head substantially as shown in FIGS. 5A-5C, but with recess 831. Arm 825 slips between hosel boss 829 and insert boss 827. When a shaft is attached to the club head, a shaft sleeve screw passes through the bore hole through arm 825. In certain embodiments, pressing aft body 823 into fore body 821 substantially provides an assembled club head in which the two components have a firm attachment to one another via a press-fit attributable to flanges at the attachment perimeter. Assembly of the interchangeable/repositionable shaft provides an additional securing mechanism to fully fasten the club head together with ample strength to withstand high-impact drives.

A fastening mechanism of the invention can be used alone or in combination with others. As discussed above, a press-fit can cooperate with a shaft fastening mechanism. Further, in some embodiments, a mechanism includes deformable cantilevers for assembly.

Figure 9:
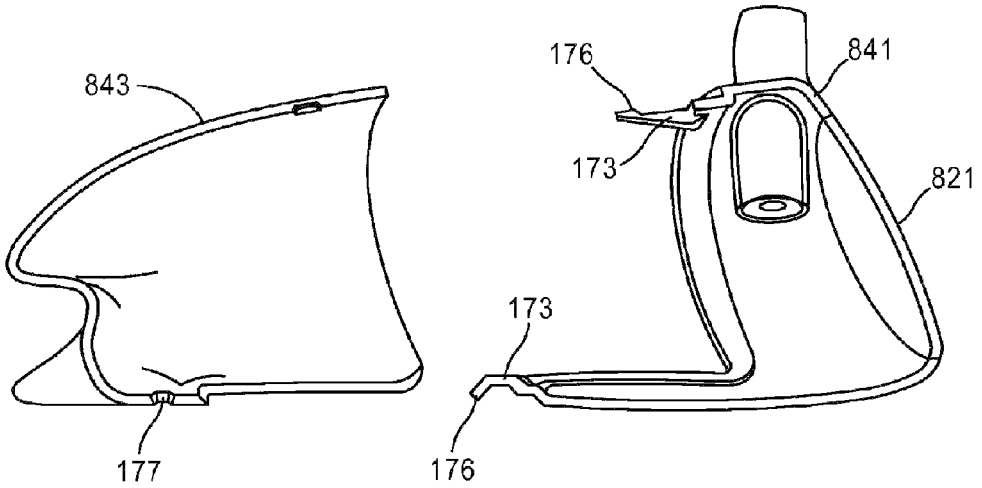
FIG. 9 shows a cutaway view of a club head with separable aft body and cantilevers.

FIG. 9 shows a cutaway view of a club head with separable aft body and cantilevers. Two of cantilever 173 are depicted, but any number is possible. As seen in FIG. 9, aft body 843 includes a recess 177 in a crown area that does not extend entirely through the body shell (i.e., a depression). Aft body 843 also includes a recess 177 in a sole area that does extend as a hole through the body shell (i.e., a hole). Any combination of depressions and holes is possible. When aft body 843 is mated with fore body 841, they snap together when protruding tips 176 on cantilevers 173 engage with recesses 177.

Figure 10:
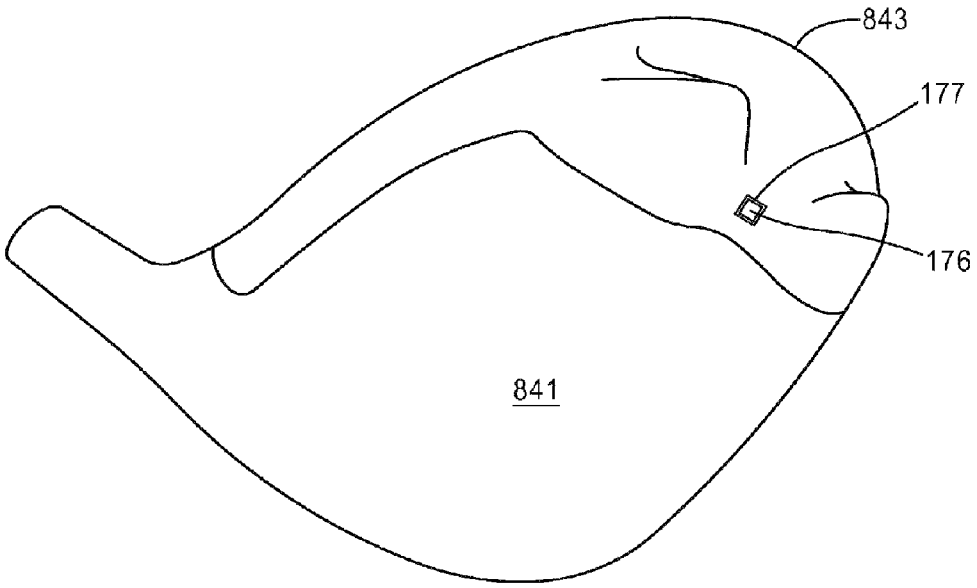
FIG. 10 is a perspective view of the club head shown in FIG. 9.

FIG. 10 is a perspective view of an assembled club head including aft body 843 and fore body 841 as were shown in FIG. 9. As can be seen, protruding tip 176 is visible through hole 177. Further, aft body 843 can be disengaged from fore body 841 by pressing in on tip 176. In certain embodiments, hole 177 and tip 176 are dimensioned so that aft body 853 can be disengaged manually (e.g., without a tool). In alternative embodiments, hole 177 is dimensioned so that a tool must be inserted.

In some embodiments, a club head can be provided along with a specialized tool for uncoupling an aft body. A specialized tool can be used to uncouple a cantilever-based fastening mechanism, or other mechanisms. In some embodiments, a club head with a separable aft body is assembled and fastened through the use of a functional component, which can optionally be formed to interact with a specialized tool.

Figure 11A:
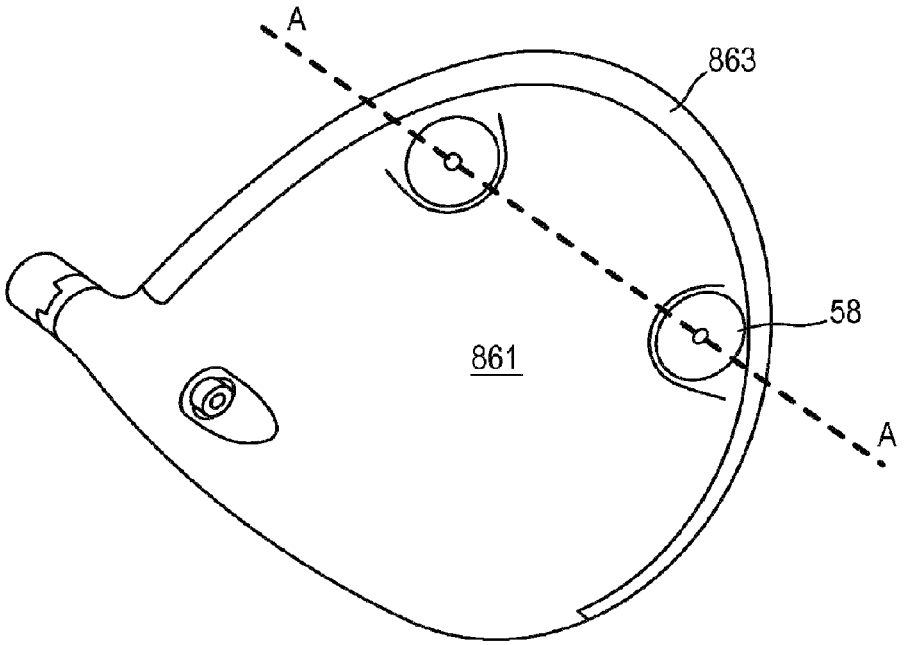
FIGS. 11A and 11B show a club head with separable aft body fastened by weight members.
Figure 11B:
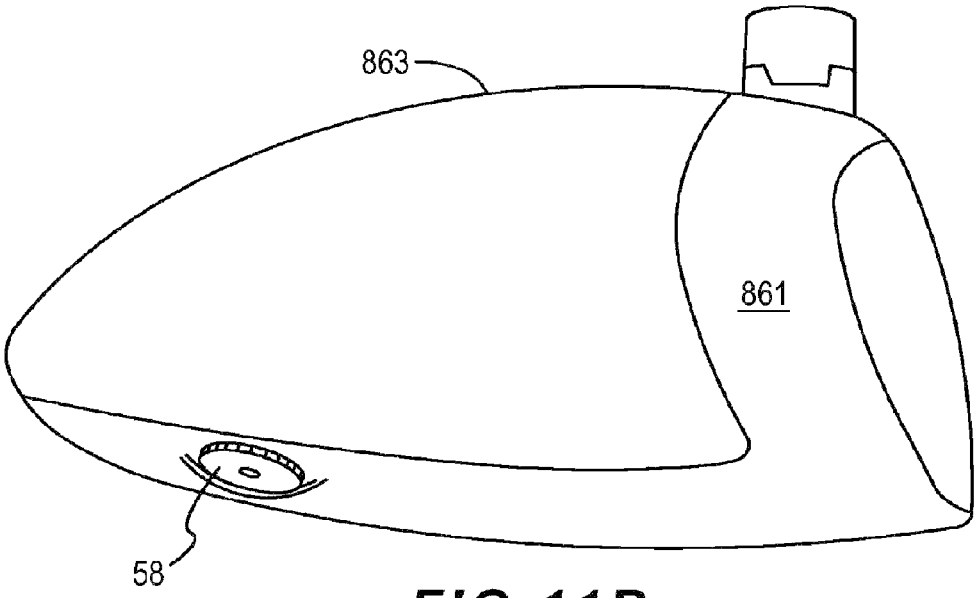

FIGS. 11A and 11B show a club head with separable aft body 863 fastened by a functional component 58. As shown in FIG. 11A, fore body 861 includes a portion of a sole of the club head. Aft body 863 completes the overall morphology of the club head. Two of functional component 58 are provided in optional recessed areas on the sole of fore body 861.

A functional component 58 can be any component that adds a feature or tunes the mass distribution or affects the environmental interaction of a club head. For example, in some embodiments, a functional component has a non-uniformly dimensioned morphology and modulates a face angle or a lie angle or a loft angle (effective angle) by being positioned on the club head in different ways. In certain embodiments, a functional component is rotated to modulate an effective angle. Portions of the component that have different thicknesses interact differently with the ground to tune the effective angle. In alternative or additional embodiments, a functional component is a weight. For example, a club head as shown in FIG. 11A can be provided with a number of components 58, having a variety of different masses. A golfer can tune a mass distribution of a club head by interchanging components 58. A particular insight of the invention is that such a system provides an unexpectedly good way to fasten an interchangeable aft body to a club head.

FIG. 11B shows a side view of the club head shown in 11A. On the depicted toe side, one of functional component 58 is visible and can be seen to fit into a shallow, semi-circular recess, although any recess or no recess is possible.

Figure 12:
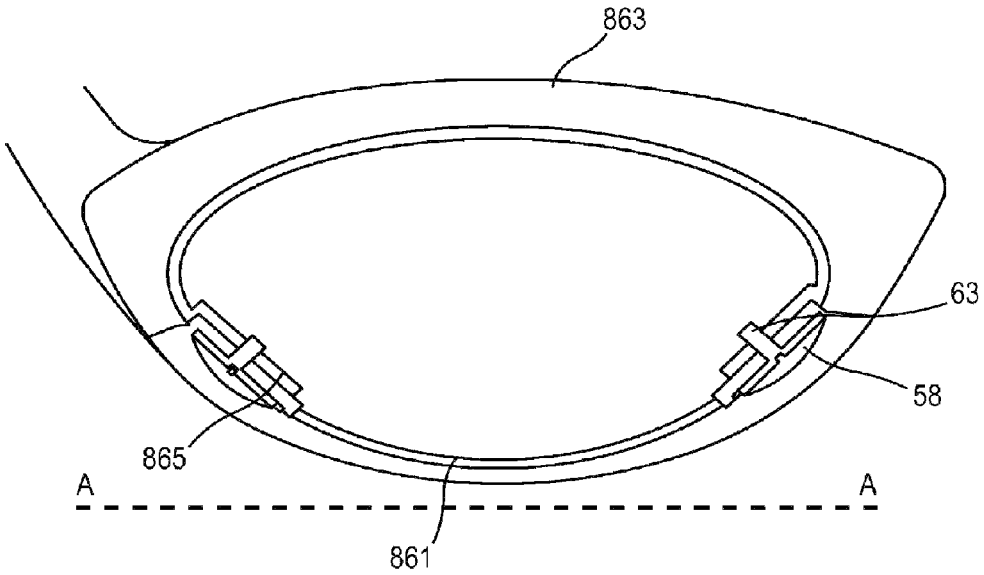
FIG. 12 is a cutaway view of the club head shown in FIGS. 11A and 11B.

FIG. 12 is a cutaway view of the club head shown in FIG. 11A along line A-A. In the depicted embodiment, functional members 58 each include a threaded post 63 that threads into a corresponding hole in aft body member 863.

Figure 13:
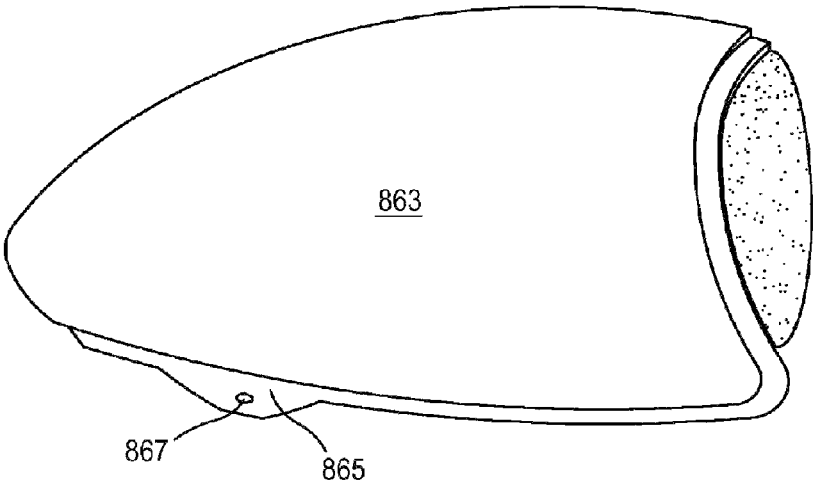
FIG. 13 shows the aft body of the club head in FIG. 12.

FIG. 13 shows the aft body 863 of the club head in FIG. 12. Aft body 863 is substantially surrounded at its edge by an attachment perimeter that includes a flange. At two portions, the flange extends into tabs 865. Each of tab 865 includes threaded hole 867. When aft body 863 is coupled to fore body 861, functional components 58 thread through holes in fore body 861 and into threaded holes 867. When the functional components 58 are tightened into place, the club head is fastened together.

This attachment mechanism using functional components can be employed for body components or insert panels in any of a number of dimensions, morphologies, and placements around a club head.

Figure 14:
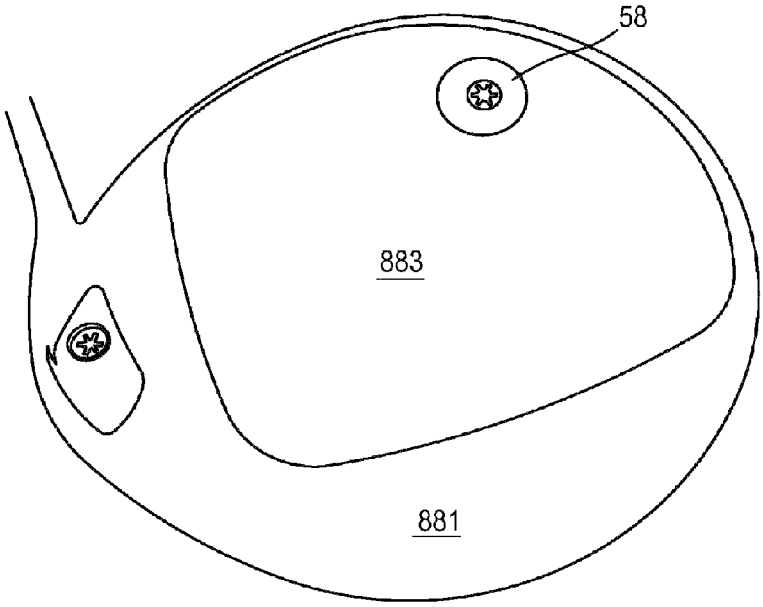
FIG. 14 shows a club head with a removable aft sole panel.

FIG. 14 shows a club head with an interchangeable aft sole panel 883 fastened into place through the use of functional component 58. As depicted in FIG. 14, a functional component 58 can include a tool engagement surface. In certain embodiments, a tool engagement surface of a functional component 58 is provided to be operated by a tool that is also the tool for coupling and releasing a shaft. By these means, a golfer may interchange components of a club head and also interchange shafts.

Figure 15:
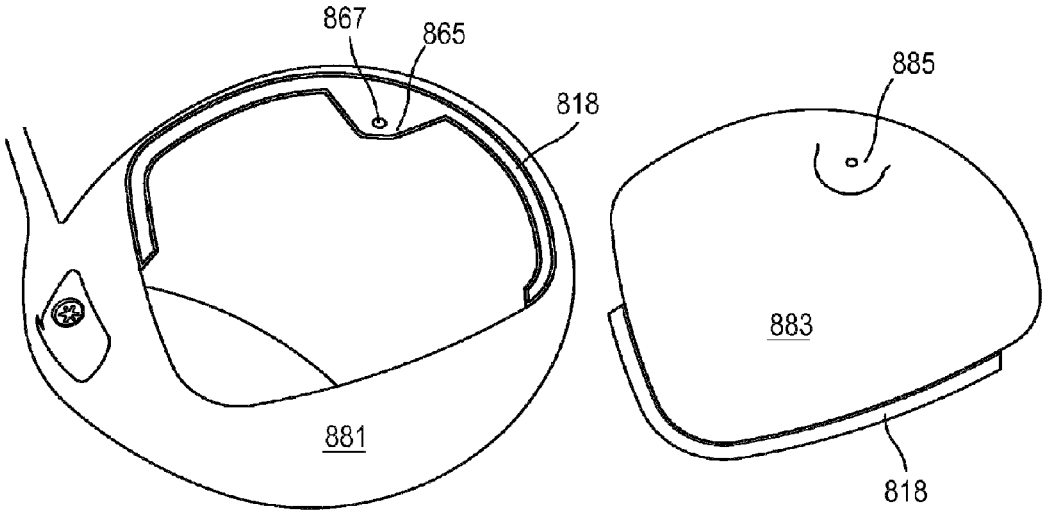
FIG. 15 shows components of the club head shown in FIG. 14.

FIG. 15 shows body member 881 including a crown, face, and hosel of a club head, and having a cutaway void dimensioned to receive sole panel 883. Sole panel 883, the cutaway void of body member 881, or both have engaging flange portions 818. As shown in FIG. 15, a portion of flange 818 on fore body 881 extends into tab 865 with threaded hole 867 where functional component 58 can be fastened. As depicted in FIG. 15, sole panel 883 includes optional component recess 885. The fastening mechanism depicted in FIGS. 14 and 15 is not limited to use with a sole panel. A single (or multiple) functional component 58 can be employed to couple interchangeable components of a club head even where each component provides a substantial portion of the overall exterior area of the club head (e.g., a first component and a second component each provide over 25% or over 40% of an overall exterior area of an assembled club head).

Figure 16A:
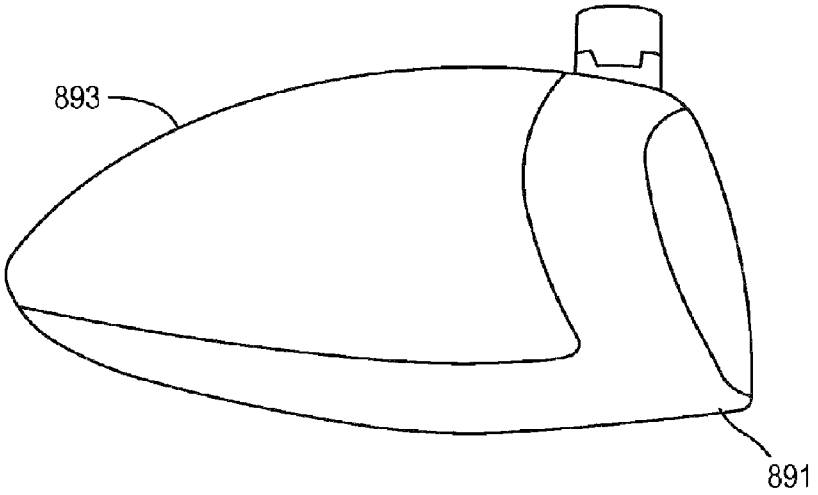
FIGS. 16A-16C show a club head with separable aft body.
Figure 16B:
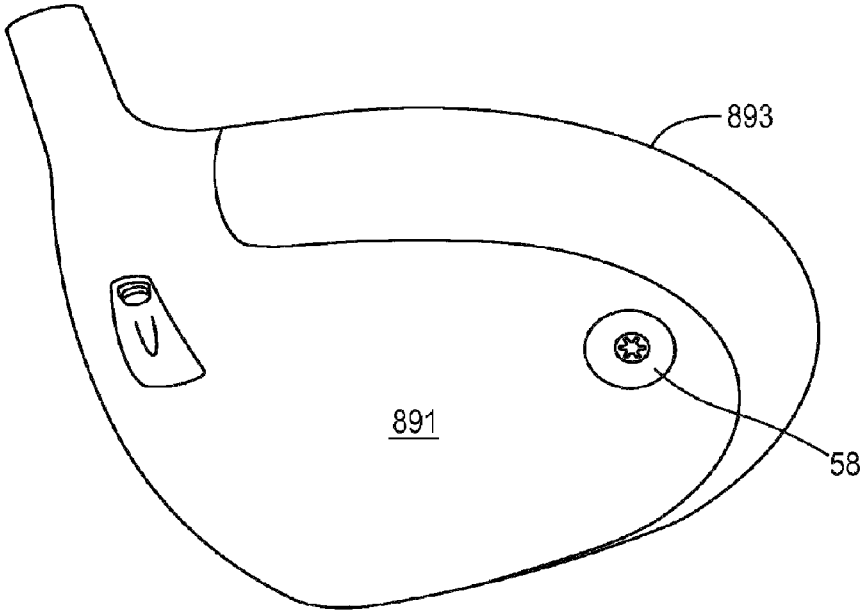
Figure 16C:
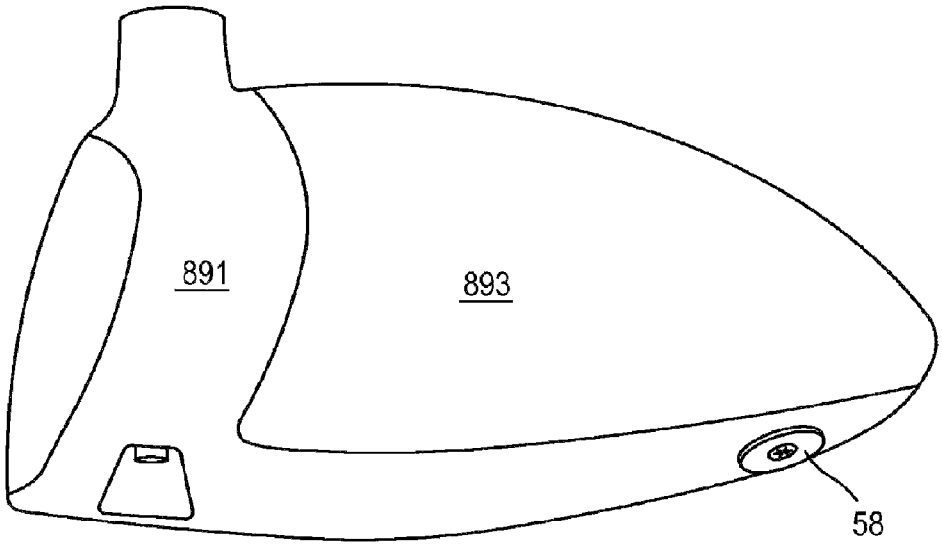

FIGS. 16A-16C show a club head with separable aft body 893 in which each of aft body 893 and fore body 891 provide a substantial portion of the exterior surface area of the assembled club head (here, each provides at least more than about 35%). As shown in FIG. 16B and in FIG. 16C, aft body 893 is fastened to fore body 891 through a single functional component 58.

Figure 17:
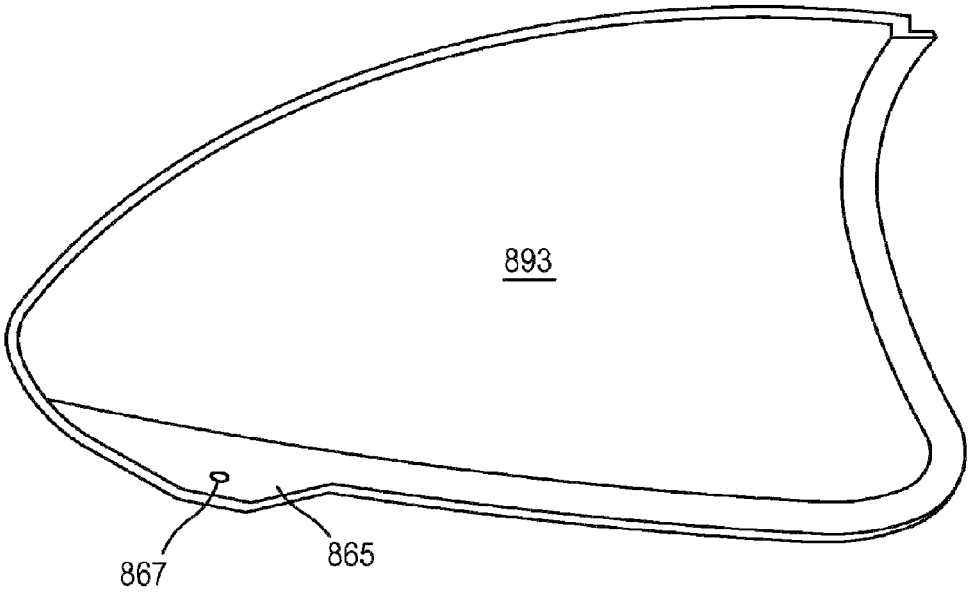
FIG. 17 shows a cutaway view of the aft body of the club head in FIGS. 16A-16C.

FIG. 17 shows a cutaway view of the aft body of the club head in FIGS. 16A-16C. Aft body 893 has a flange at an edge that extends into tab portion 865 with hole 867 to receive functional component 58.

In certain embodiments, the invention provides golf club heads with multi-component structures. While the embodiments disclosed herein include club heads for wood-type clubs, it is contemplated that one or more of the concepts described herein can further be used for other types of club heads, including but not limited to irons and putters.

With reference to FIGS. 18-21, a golf club head 10 can comprise a ball striking face 12, a crown 14, a sole 16, and a hosel 18. The golf club 10 can further comprise a body member 20, a face insert 22, at least one sole insert 24, and at least one crown insert 26. In some embodiments, the body member 20 can comprise a metallic member that includes a plurality of openings for receiving the face insert 22, sole insert 24, and/or crown insert 26. In some embodiments, the body member 20 can be comprised, at least in part, of a 6-4 titanium alloy, though other types of material are also possible. As illustrated in FIGS. 18-21, in some embodiments the body member 20 can comprise a portion or portions of the ball striking face 12, crown 14, and/or sole 16.

Figure 20:
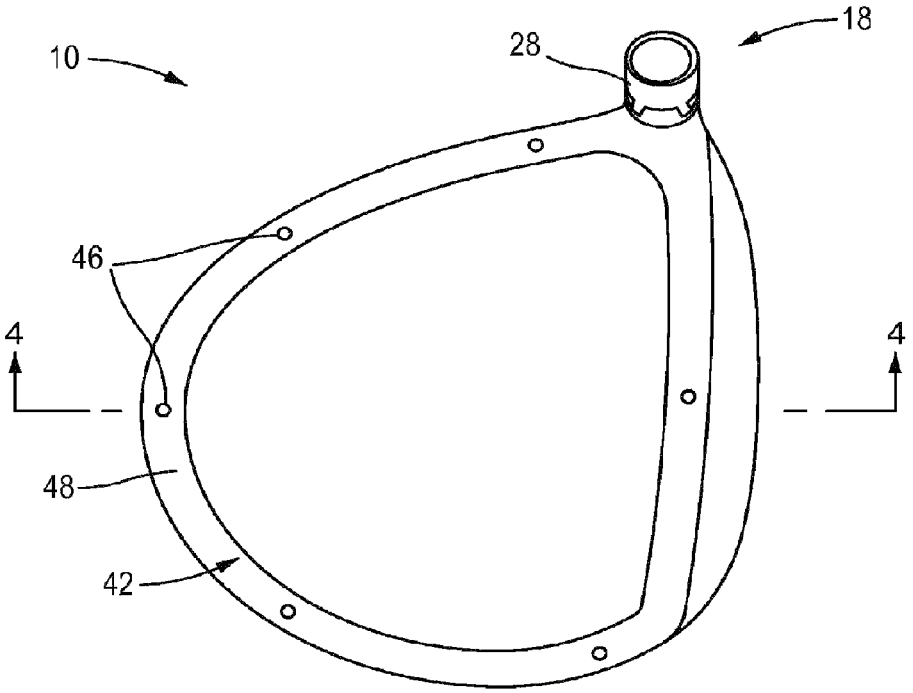
FIG. 20 is a top view of the club head of FIG. 18 with a crown portion removed.

With reference to FIG. 20, in some embodiments the hosel 18 can comprise a sleeve 28 that permits interchangeability and/or adjustability of a golf club shaft. In some embodiments the sleeve 28 can be comprised of 6062 aluminum, though other types of materials are also possible. In some embodiments, the sleeve 28 can be adjusted so as to adjust the lie angle of the club head 10. Other types of material and/or structure can also be used for the sleeve 28. U.S. Pat. No. 7,789,766, the entire contents of which are incorporated by reference herein, describes various adjustability features of a sleeve similar to sleeve 28.

Figure 18:
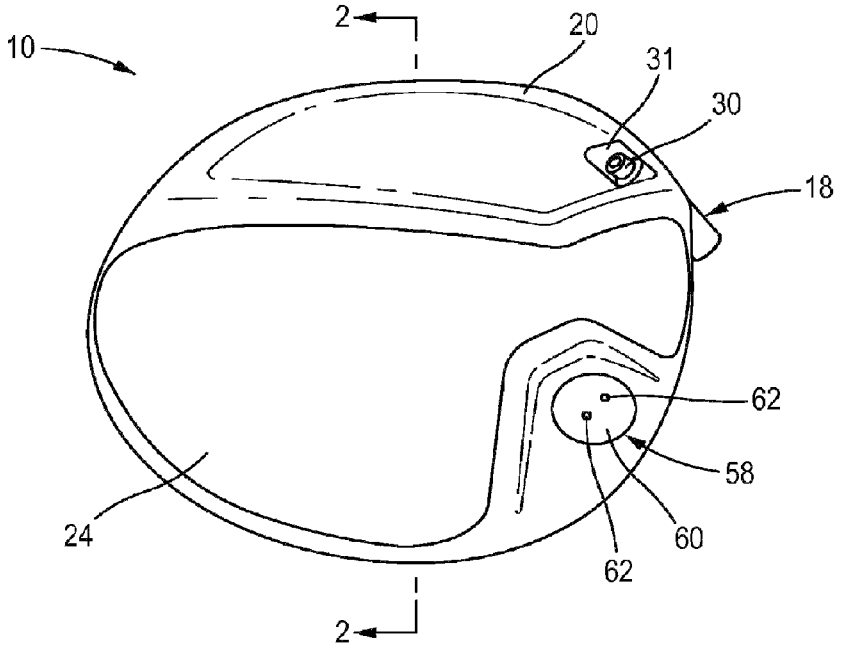
FIG. 18 is a bottom perspective view of a golf club head of the invention.

FIG. 18 shows an embodiment in which hosel 18 of club head 10 includes a hosel sleeve screw 30 configured to releasably attach one or more components of the hosel 18 to the club head 10. The screw 30 can be comprised, for example, of 304 stainless steel produced using a traditional screw machine with a T20 head, though other types of materials and screws are also possible. Additionally, other types of fasteners besides screws can be utilized. In some embodiments, the screw 30 can be inserted within a recess 31 in the body member 20.

Figure 19:
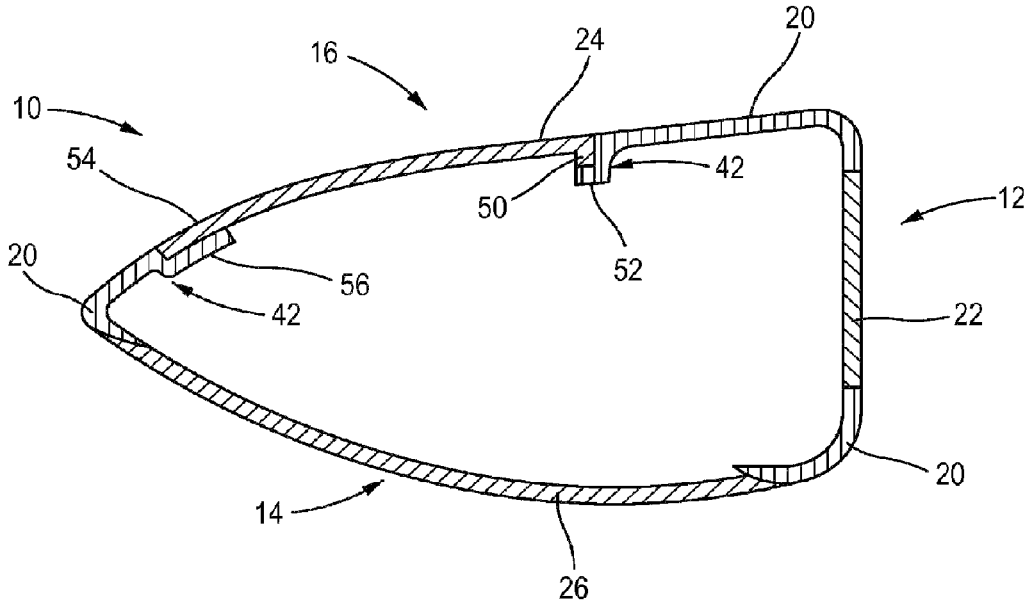
FIG. 19 is a cross-sectional view, taken along line 2-2, of the golf club head of FIG. 18.

FIG. 19 is a cross-sectional view showing face insert 22 in club head 10. Face insert 22 can comprise at least a majority, for example by volume and/or mass, of the ball striking face 12. In some embodiments, the face insert 22 can form approximately 60 percent of the volume and/or mass of the ball striking face 12. In some embodiments, the face insert 22 can form approximately 70 percent of the volume and/or mass of the ball striking face 12. In some embodiments, the face insert 22 can form approximately 80 percent of the volume and/or mass of the ball striking face 12.

The face insert 22 can be comprised of metal, or other suitable material. In some embodiments the face insert 22 can be comprised of the same material as the body member 20. In some embodiments the face insert 22 can be comprised of 6-4 titanium. In some embodiments the face insert 22 can be comprised of more than one type of material and/or more than one layer of material.

In some embodiments, the face insert 22 and/or ball striking face 12 can transition into the crown 14 and sole 16 at a transition point or area. The transition point or area can be a location where a line drawn perpendicular to a tangent line extending along the surface of the club head 10 at the transition point or area forms an approximately 45 degree angle relative to a vertical plane passing through the club head 10.

FIG. 19 shows crown insert 26 in club head 10 in cross-sectional view.

FIG. 20 is a top view of club head 10 showing a mounting surface 48 for receiving crown insert 26.

Figure 21:
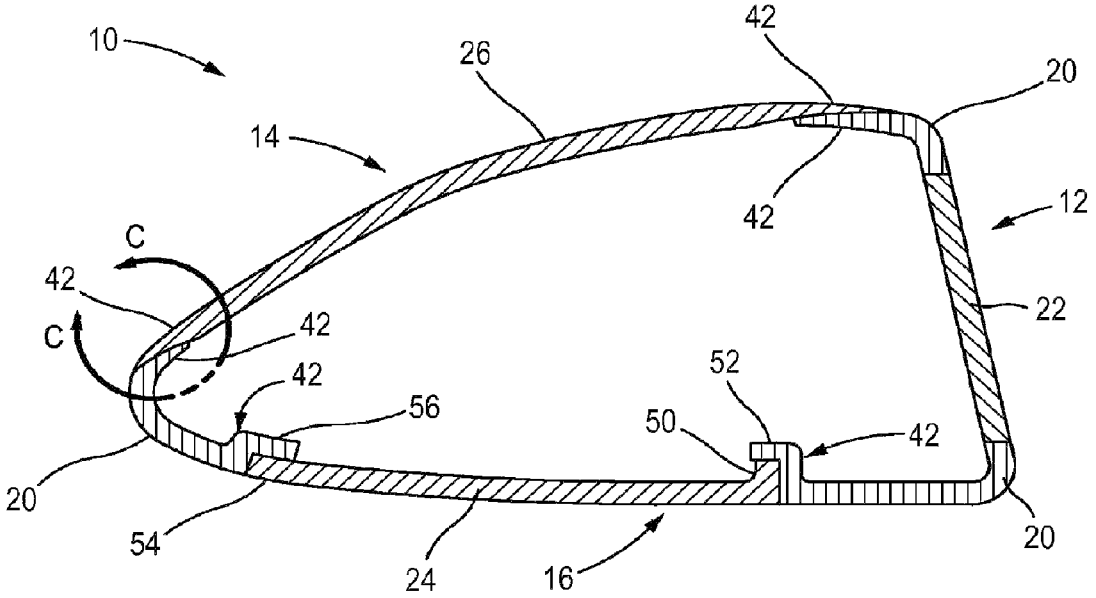
FIG. 21 is a cross-sectional view, taken along line 4-4 of FIG. 20, of the golf club body member of FIG. 18, with the crown member attached.

FIG. 21 shows crown insert 26 in cross-sectional view. In some embodiments the crown insert 26 can comprise at least a majority, for example by volume and/or weight, of the crown 14. In some embodiments, the face insert 22 can form approximately 60 percent of the volume and/or mass of the ball striking face 12. In some embodiments, the face insert 22 can form approximately 70 percent of the volume and/or mass of the ball striking face 12. In some embodiments, the face insert 22 can form approximately 80 percent of the volume and/or mass of the ball striking face 12.

Figure 22:
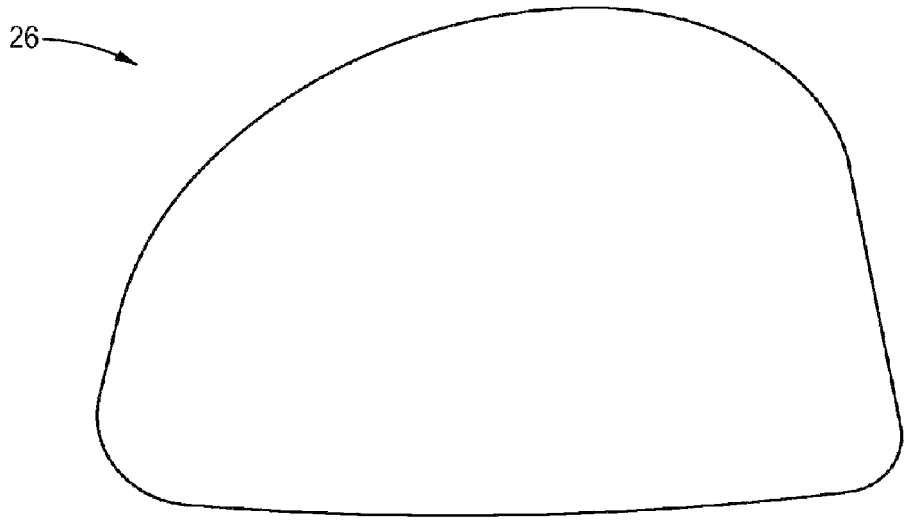
FIG. 22 is a top plan view of a plastic crown insert.

The crown insert 26 can be comprised of composite, reinforced plastic, thermoplastics, or other suitable material. With reference to FIG. 22, in some embodiments the crown insert 26 can be comprised entirely of injection molded material. In some embodiments, the insert 26 can be comprised of single or multi-density metallic or non-metallic material.

Figure 23:
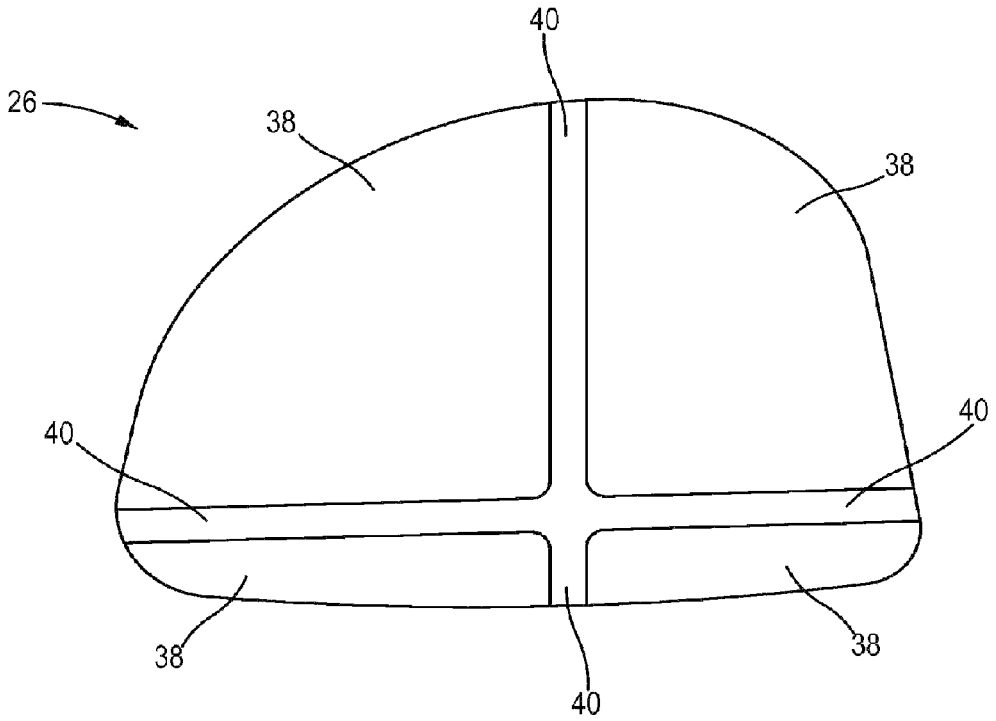
FIG. 23 is a top plan view of an alternative embodiment of the crown insert of FIG. 22.

FIG. 23 illustrates an embodiment in which the crown insert 26 can have one or more portions 38 that are comprised of plastic, along with one or more flexible divider elements 40 that connect the portions 38 together. In some embodiments, a majority of the crown insert 26 is a thermoset or thermoplastic material, which may optionally be reinforced with secondary fibers, such as carbon, glass, wood, plant or metal such as, for example, a plastic. In some embodiments, the portions 38 can be interchangeable. The divider elements 40 can be comprised, for example, of any metallic or non-metallic material desirably having a density less than that of the body member 20. In some embodiments, the divider elements 40 can be bonded with the remaining portions 38 of the crown insert 26. In some embodiments the divider elements 40 can be formed integrally with the remaining portions 38. In some embodiments, the divider elements 40 can divide the crown insert 26 into four portions 38, though other numbers of portions are also possible. The divider elements 40, along with the plastic portions 38, can give the crown insert 26 flexibility and reduced weight as compared with crown inserts made of metal or carbon fiber. The added flexibility can inhibit the plastic material of crown insert 26 from cracking or fracturing. In some embodiments, if the flexibility is too great, and negatively affects the sound/tuning of the club head 10, additional measures can be taken to reinforce the club head 10 and/or to create better sound qualities. For example, a gasket can be added between the crown insert 26 and the body member 20, or material such as latex can be added between the crown insert 26 and the body member 20, to act as a sound barrier. In some embodiments, a support member can extend generally from the sole 16 to the crown 14 can be added to the club head 10.

In some embodiments, the club head 10 can have a density ratio between the body member 20 and an insert. For example, in some embodiments the ratio of the density of the body member 20 to the crown insert 26 can be 1.5. In some embodiments, the density ratio between the body member 20 and one of the inserts can be approximately 2.0, 2.5, 3.0, 2. 5, 4.0, or higher than 4.0. Other density ratios are also possible.

Overall, the use of plastic (such as, for example, polyurethanes, polyesters, epoxy resins, phenolic resins, and carbon composites) in the crown insert 26 can, at least in some embodiments, not only reduce weight but also facilitate a generally transparent, or at least partially transparent, club head 10. Transparency can allow a user to view whether material has accumulated inside the club, and/or whether the club head 10 is damaged or showing signs of wear on the inside. In some embodiments, the crown insert 26 can be translucent. In some embodiments the crown insert 26 can be comprised of a photochromic material. The plastic can reduce weight in the crown 314, thus allowing the weight that otherwise would been located in the crown 314 to be optimally redistributed to other areas of the club head 310 to optimize a location of a center of gravity, for example, or optimize moments of inertia in the club head 310.

With continued reference to FIGS. 19-21, the crown insert 26 and/or body member 20 can comprise at least one mounting feature 42. The mounting features 42 can be used to attach the crown insert 26 to the body member 20 or other component of the club head 10. For example, with reference to FIG. 21, in some embodiments the mounting features 42 can comprise attachment flanges, permitting the crown insert 26 to be adhesively attached, for example, or welded, to the body member 20. In some embodiments, mounting features can comprise non-threaded attachments that clamp and unclamp with the push of a finger, hand, or tool. The mounting features can include one-touch fasteners and may have internal springs. A press-fit or snap-fit assembly can be used. In some embodiments, a tool can be used to release an insert, such as the crown insert, to replace it with a different crown insert.

Figure 24:
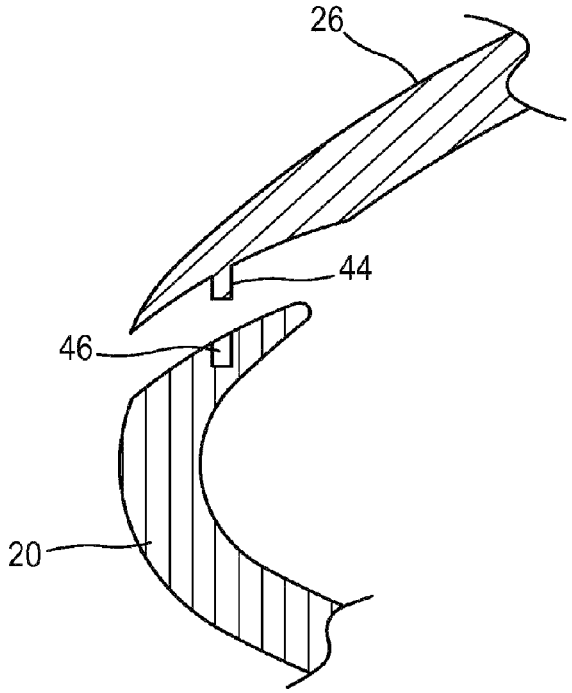
FIGS. 24 and 25 are embodiments of detail C, shown in FIG. 21.

FIG. 24 shows a detail view of section C from FIG. 21. As illustrated in FIG. 24, mounting features 42 on the crown insert 26 can comprise post-like structures 44 that are configured to be received within corresponding mounting features 42 on the body member 20. The corresponding mounting features 42 on the body member 20 can comprise, for example, openings 46 on a mounting surface 48 of the body member 20.

Figure 25:
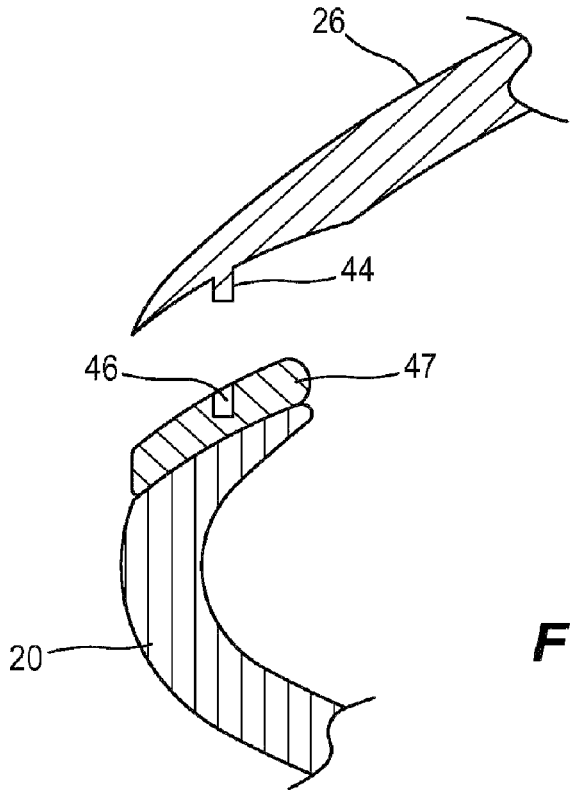

FIG. 25 illustrates a detail view of section C from FIG. 21 according to certain embodiments in which a gasket member 47 is placed between the body member 20 and crown insert 26. For example, the gasket member 47 can be adhesively attached to the body member 20. In some embodiments, instead of the body member 20 having openings 46, the gasket member 47 instead can include the openings 46. Alternatively, in other embodiments both the gasket member 47 and body member 20 can include openings, and the post-like structures 44 can be inserted through the gasket member 47 and into the body member 20.

With continued reference to FIGS. 20, 21, 24 and 25, the post-like structures 44 and openings 46 can be spaced around the club head 10, such that the crown insert 26 is secured firmly to the body member 20 in a plurality of locations. For example, the mounting surface 48 can include six openings 46 spaced generally equally around the club head 10, and the crown insert 26 can include six post-like structures 44 that are configured to be received within the six openings 46. In some embodiments, the post-like structures 44 can press or snap-fit into the openings 46, and the crown insert 26 can be held in place without the use of any additional adhesive, welding, etc. In some embodiments, additional adhesive can be used, for example between an outer edge of the crown insert 26 and the mounting surface 48. In some embodiments, the crown insert 26 can be mounted to the mounting surface 48 without the use of post-like structures 44 or openings 46. For example, in some embodiments the crown insert 26 can be attached purely by adhesives, welding, mechanical attachment, etc.

With reference to FIGS. 18, 19 and 21, in some embodiments the sole insert 24 can comprise at least a majority, for example by volume, of the sole 16. The sole insert 24 can include composite, plastic, or any other suitable material. In some embodiments, sole insert 24 is made of injection molded plastic. Further, sole insert 24 may have secondary coatings or be co-molded to other materials. Co-molded materials and secondary coatings can include ceramics, anodizing, or similar. In some embodiments, a secondary coating or co-molded material includes a low-friction polymer. For example, sole insert 24 may have a hard-anodized coating infused with a low-friction polymer such as a fluorinated polymer (e.g., poly-tetrafluoroethelyne (PTFE), sold under the trademark TEFLON by DuPont). Suitable coatings are discussed in U.S. Pub. 2011/0118057, the contents of which are hereby incorporated by reference in their entirety for all purposes.

Sole insert 24 can have a variety of shapes and sizes. For example, the sole insert 24 can have an oblong and/or generally hourglass-like shape, such as that shown in FIG. 18. Other shapes and sizes are also possible. As with the crown insert 26, the sole insert 24 can also be comprised of a material that is lightweight, and/or less dense, than that of the body member 20, so that weight can be redistributed as desired to other areas of the club head 10, and a center of gravity of the club head 10 can for example be pushed towards the back and heel side of the club head 10, and/or moments of inertia can be optimized. In some embodiments, a movement of weight can advantageously increase a moment of inertia of the club head 10, causing reduced unwanted twisting or movement of the club head 10 upon impact with a golf ball.

In some embodiments, there can be more than one sole insert 24. In some embodiments, a sole insert 24 can have a divider, similar to at least one of the embodiments of the crown insert described herein.

With continued reference to FIGS. 18, 19, and 21, the sole insert 24 can comprise at least one mounting feature 42. The mounting features 42 can be used to attach the sole insert 24 to the body member 20 or other component of the club head 10. With reference to FIG. 19, in some embodiments the mounting features 42 of the sole insert 24 and body member 20 can comprise one or more attachment flanges. For example, the sole insert 24 can include a first attachment flange 50 that extends inwardly from the sole insert 24. In some embodiments, the first attachment flange 50 can extend at a right angle relative to a surface of the sole insert 24. The attachment flange 50 can be configured to contact and/or mate with a corresponding attachment flange 52 on the body member 20. The attachment flange 52 can have a bent profile, for example, and extend inwardly from the body member 20 (e.g. towards an interior volume of the club head 10).

In some embodiments, the sole insert 24, and/or other inserts on the club head, can be configured to snap-fit into the body member 20. For example, in some embodiments, at least one surface of attachment flange 50 can contact and press against at least one surface of the attachment flange 52 of the body member 20, helping to hold the sole insert 24 in place relative to the body member 20. The insert 24 can be held in place by friction. In some embodiments the sole insert 24 can include an additional flange 54, which contacts a flange 56 on the body member 20. The flanges 54 and 56 can also be configured to contact one another, and/or snap-fit in place or be attached by adhesive, welding, etc. In some embodiments, the body member 20 can include a flange or flanges that are biased in a first direction, such that when an insert is positioned within the club head 10, the flanges are forced away from the first direction towards a second direction, the flanges pressing back against the insert towards the first direction to hold the insert in place again once the insert has been attached. For example, in some embodiments the flange 52 can be biased in a first direction towards the back end of the club head, and pushed towards a second direction towards the front of the club head when the sole insert 24 is attached. In some embodiments, the body member 20 can include flanges with ends that are initially biased towards one another, and when an insert is attached, the ends are pressed away from one another, the force of the ends of the flanges holding the insert in place. In some embodiments, adhesive, welding, and/or mechanical structures can be used to help hold one or more inserts (e.g. the sole insert 24) in place within the body member 20.

In certain embodiments, either crown insert, sole insert, any other insert such as a face insert or skirt insert (or combination thereof), or any other component is fastened to form a playable club by a mounting feature that uses a threaded mechanism. For example, a mounting feature may include a screw well such as, for example, those described in U.S. Pub. 2011/0111885, the contents of which are hereby incorporated by reference in their entirety for all purposes. Further, an insert may be fastened into place by a screw through another portion of a club head. Threaded elements are discussed in U.S. Pat. Nos. 8,033,930; 7,771,290; 5,776,011; and 5,429,365, the contents of which are hereby incorporated by reference in their entirety for all purposes.

In some embodiments, one or more inserts, such as sole insert and/or crown insert 24, 26 can be configured to have a size larger than that of a corresponding opening on the body member 20. When the sole insert and/or crown insert 24, 26 is inserted into the opening in the body member 20, the sole insert and/or crown insert 24, 26 can flex initially, and/or the body member 20 can flex initially, and the sole insert and/or crown insert 24, 26 can be held in place frictionally once positioned inside the opening. In some embodiments, the sole insert and/or crown insert 24, 26 can force one or more flanges 50 to act as a spring mechanism, applying a force on the sole insert and/or crown insert to hold the sole insert and/or crown insert 24, 26 in place within the body member 20.

Other snap-fit constructions can also be used.

Figure 26:
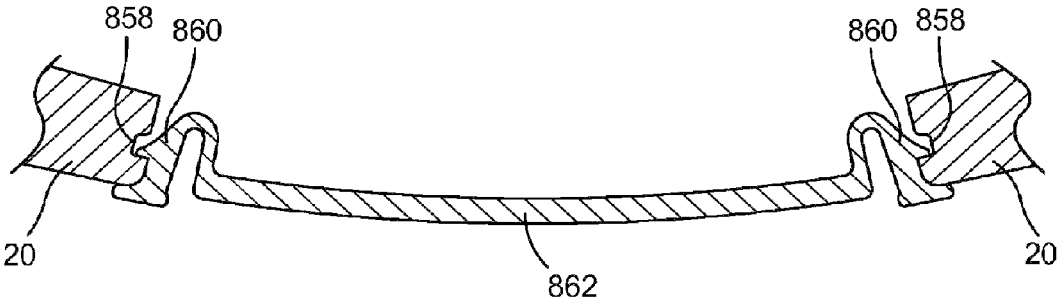
FIG. 26 is a partial view of a club head and insert according to an embodiment.

FIG. 26 shows a snap-fit construction according to certain embodiments. Body member 20 of a club head can include one or more recesses, channels, openings, or other structures 858 along the inside or outside of the club head configured to receive an attachment flange 860 on an insert 862, and to temporarily lock the attachment flanges 860 and the insert 862 into place within the club head. The insert 862 can be removed, for example, by pressing on one or more areas of the insert 862, such as the outside edges of the insert.

In some embodiments, screws, clamps, or other fasteners can be used to connect, remove, and/or replace the inserts. In some embodiments, adhesive can be used to help hold an insert or inserts in place that will not be replaced.

Figure 46:
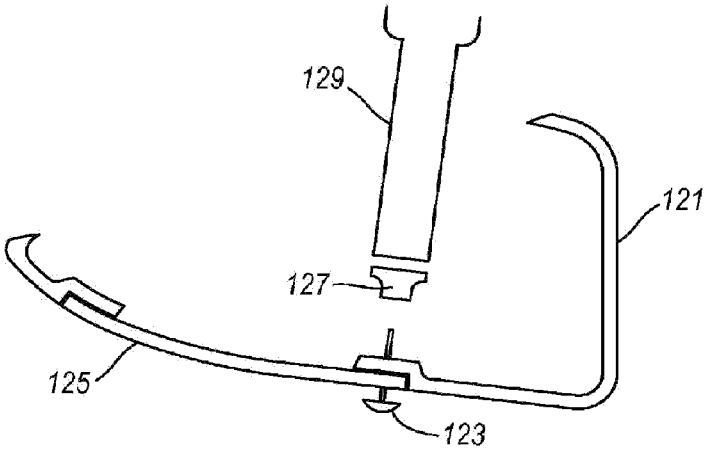
FIG. 46 illustrates a method of rapidly fastening a sole plate to a club head.

In certain embodiments, two club head components can be joined, or a component can be joined to a body part, by an assembly method such as staking, ultra-sonic welding, or heat staking. For example, The seams as shown in FIG. 21 provide surfaces that can be attached by these methods. In certain embodiments, components are assembled by heat staking. FIG. 46 illustrates one way in which an assembly tool can access seams for assembly by heat staking.

Heat staking is a means of locking club head components together. In general, one of the parts to be assembled is designed to include a plastic post or tab which can be inserted through a hole or aperture in another part and then permanently and inelastically deformed by the generation or application of heat by some tool surface which effects plastic deformation. The variables which can be tuned include the characteristics of the particular plastic material employed including its flow and melt temperatures, the nature and characteristics of the tooling employed and the geometries thereof, means by which the tooling may be brought to bear against the plastic elements to be deformed, the choice of method for effecting heating, and the parameters of pressure, time, and heat energy applied.

In one embodiment, a plurality of first thermoplastic components, or heat-stakes, may be located sporadically around the periphery of a component and a second component may comprise a plurality of second thermoplastic components, or encapsulates, comprising receiving holes located in corresponding locations to the heat-stakes of the first automotive component. The heat-stakes may be inserted into the receiving holes and a staking device may be used to heat-treat a leading end of each heat-stake. This use of the staking device results in the deformation of the heated leading end of the heat-stake such that a "mushroom cap" may be formed. The mushroom cap of each heat stake commonly covers the corresponding receiving hole of the encapsulate. This resulting overlap results in the mechanical coupling of the first and second components. The resulting retention force of a heat staking process may be tuned by varying the amount of surface area of the encapsulate contacted by the heat-stake's mushroom cap as well as the composition states of the encapsulate and heat-stake.

A particular advantage of heat stake in club head assembly is that such methods operate well with dissimilar materials. For example, a plastic component with stakes can be fastened to a metal component with receiving holes by heat staking. Heat staking is discussed in more detail in U.S. Pat. Nos. 6,840,755; 6,296,470; 5,871,784; 4,767,298; and U.S. Pub. 2008/0230948, the contents of each of which are hereby incorporated by reference in their entirety for all purposes.

In certain embodiments, two club head components can be joined, or a component can be joined to a body part, through the use of magnets, discussed in more detail below.

In some embodiments, the club head 10 can include an entire set of different inserts that can be easily removed and replaced. This can facilitate consumer customization of the club head 10. For example, a club head set could include a club head 10 with a body member 20, and a plurality of different thickness, density, weight, and/or transparency crown or sole inserts. A user can select a desired insert or inserts, and quickly and easily attach the desired inserts. Advantageously, in some embodiments the inserts can press-fit or snap-fit into place within the body member 20. The inserts can be interchangeable, and in some embodiments can comprise a kit, the parts of which can be tailored to specific golfer needs. In some embodiments, the customization could include choosing from a plurality of inserts with different indicia, designs, etc., including but not limited to country flags, favorite teams, etc.

With continued reference to FIG. 18, the club head 10 can further include at least one weight member 58. The weight member 58 can removable, and can be inserted into a portion of the body member 20. In some embodiments, addition of a weight member 58 can advantageously permit more weight to be moved towards the heel of the club head 10. In some embodiments, the weight member can have a head 60 that has an outer surface that is generally flush with an outer surface of the body member 20. The weight member 58 can comprise a weight screw, formed for example from tungsten, stainless steel, such as 17-4, aluminum, or other suitable materials. Other types and materials are also possible. In some embodiments, the weight screw head 60 can include one or more tool cavities 62. The tool cavities can be configured to receive a tool, such as a specialized tool, that is configured to remove the weight screw 58. In some embodiments the tool cavities 62 can comprise two separate openings. In some embodiments the tool cavity can comprise a generally star-shaped opening for receiving a correspondingly-shaped tool. Other shapes and types of tool cavities are also possible. In some embodiments the club head 10 can be configured to receive various weight screws 58 of different weight, so that the swing weight of the club head 10 can be altered. For example, in some embodiments the weight screw 58 can be comprised of tungsten, and weigh approximately 10 grams. In some embodiments the weight screw 58 can be comprised of stainless steel, and weight approximately 6 grams. In some embodiments the weight screw 58 can be comprised of aluminum and weight approximately 2 grams. Other materials and weights are also possible. The type and weight of weight screw 58 used in the club head 10 can depend on an overall club head weight, a desired swing weight, a desired location of a center of gravity of the club head 10, and/or a desired moment of inertia of the club head 310. For example, the club head 10 can be designed, and a weight screw 58 can be selected, such that a center of gravity of the club head 10 is located approximately 4 mm rearward from a geometric center point on the face insert 22, and approximately 4 mm above a lowest point on the sole 16 when the club head 10 is at address. Other locations for the center of gravity are also possible.

In some embodiments, the ratio of the weight screw material density to body material density (i.e. between weight screw 58 and body member 20) can be approximately 1.5. In some embodiments the density can be approximately 2.0, 2.5, 3.0, 3.5, 4.0, or higher than 4.0. Other density ratios are also possible.

In some aspects, the invention provides a club head with a removable or interchangeable component, such as a crown panel or sole plate, that is affixed to the a club head body through the use of a mechanism in a club head that also provides other functionality. Through the use of mechanisms that also provide other functionality, it is possible to provide a club head with one, two, three or more separable panels that further include no visible assembly mechanisms (e.g., protruding plastic tabs, recessed holes, etc.) other than the mechanism associated with the other functionality.

Figure 27:
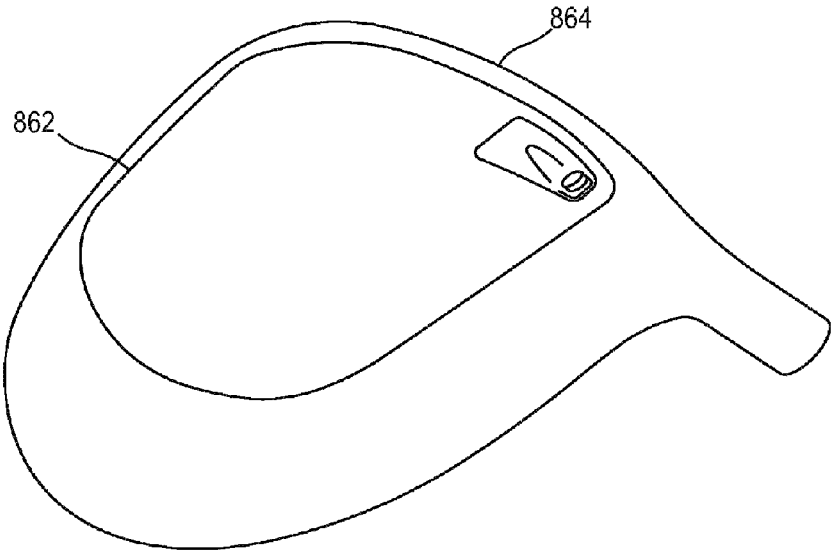
FIG. 27 shows a club with sole plate.

FIG. 27 shows club head 864 with insert 862. Insert 862 is shown here as a sole plate, and may be textured or contoured for turf interaction or to tune the stability of the club head when sitting on the ground in the address position. As shown in this embodiment, insert 862 is held in place, at least in part by hosel sleeve screw 30.

Figure 28:
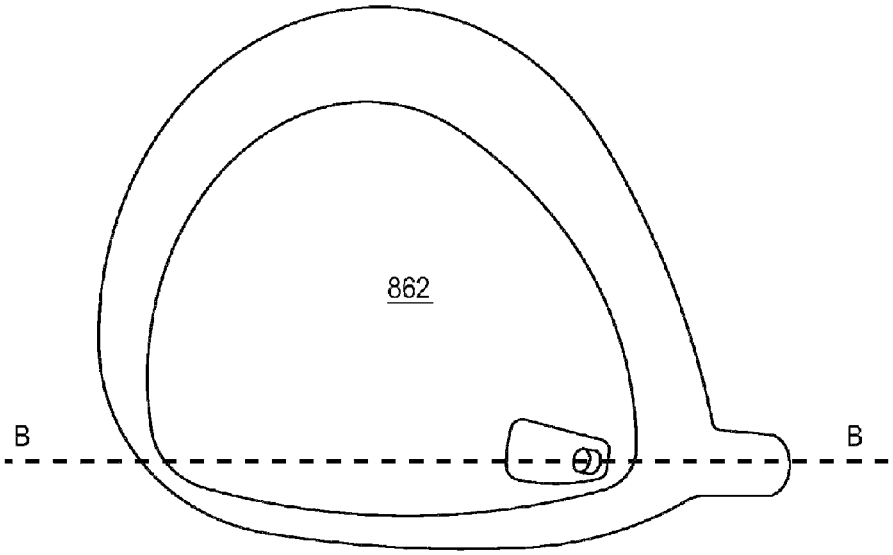
FIG. 28 is a bottom view of a club head with detachable sole plate.

FIG. 28 is a bottom view of club head 864. Sole insert 862 covers more than about 50% of the visible area of the club head sole when looked at from underneath (e.g., about 75% of the visible area). In certain embodiments, a sole insert 862 covers less than about 50% of the visible area of a sole when looked at from underneath (e.g., less than about 25%).

Figure 29:
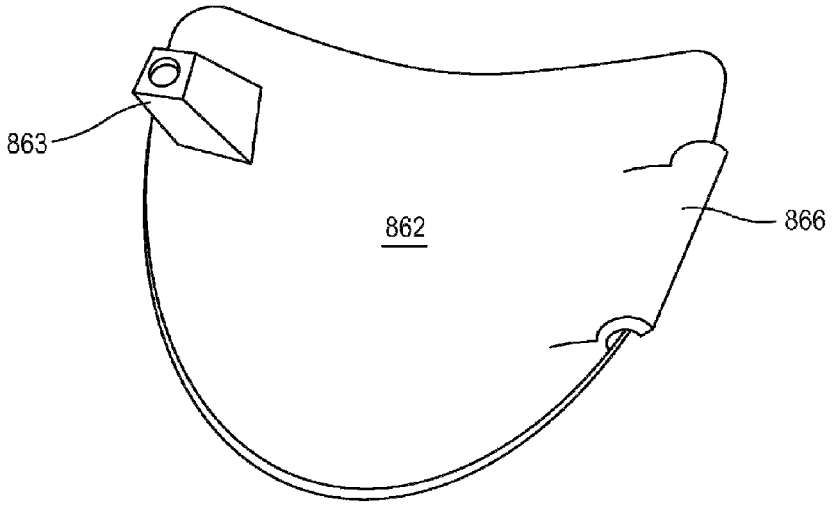
FIG. 29 shows a sole plate according to certain embodiments.

FIG. 29 shows insert 862 having boss 863 and clasp 866. Club head 864 is assembled by positioning clasp 866 on the inside edge of the insert hole in the bottom of the body of club head 864. Insert 862 is then closed, using clasp 866 as a hinge, so that boss 863 comes proximal to repositionable shaft housing 865.

Club head 864 includes housing 65 to receive and mount a repositionable shaft in various dispositions. When a shaft is mounted in a hosel of club head 64, hosel sleeve screw 30 fastens the shaft into place.

Figure 30:
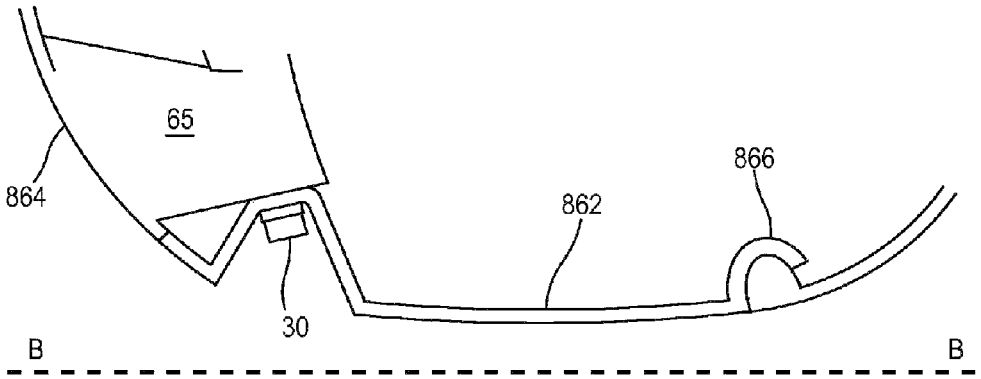
FIG. 30 is a cross section across the line in FIG. 28.

FIG. 30 shows hosel sleeve screw 30 fixing insert 862 into position. When insert 862 is installed in club head 864, clasp 866 is entirely within the club head. Insert 862 is held in place securely by hosel sleeve screw 30, which is associated with other functionality of the club head (e.g., an interchangeable/repositionable shaft). Golf clubs including adjustable mechanisms, or adjustable mechanisms for golf clubs, suitable for operation with the invention, are discussed in U.S. Pub. 2010/0041493; U.S. Pub. 2011/0098128; U.S. Pat. Nos. 8,057,323, 1,879,117 and 3,096,982, incorporated by reference herein in their entirety.

Figure 31:
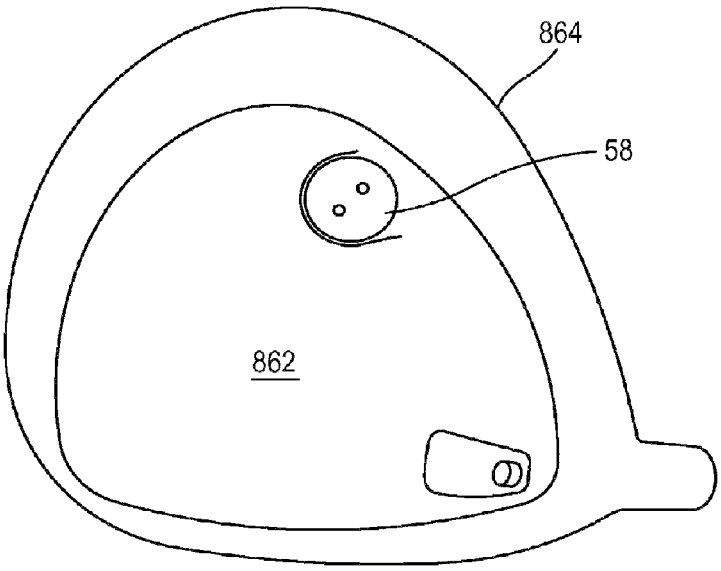
FIG. 31 illustrates a detachable sole plate fixed into a place with a weight member.

FIG. 31 shows an embodiment in which an insert 862 is held in place through the use of a releasable element 58. As discussed herein, releasable element 58 can be a weight member or another functional element. For example, in some embodiments, releasable element 58 is a disc-like structure (e.g., mounted on a post for insertion into a sole) with non-uniform thickness. By rotating element 58 into different positions, a sole can be given a different contour geometry so that an assembled golf club, when resting on a flat surface at an address position, interacts with the ground in different ways (i.e., rests in different positions). In such a fashion, release element 58 can be used to tune an effective parameter of a club, such as face angle.

Figure 32:
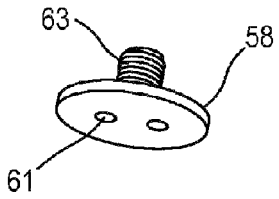
FIG. 32 shows a weight member for fixing a sole plate into place.

FIG. 32 shows a releasable component 58 having two tool cavities 61 and a threaded post 63. As shown in FIG. 32, releasable component 58 is a simple, monolithically formed weight.

Figure 33:
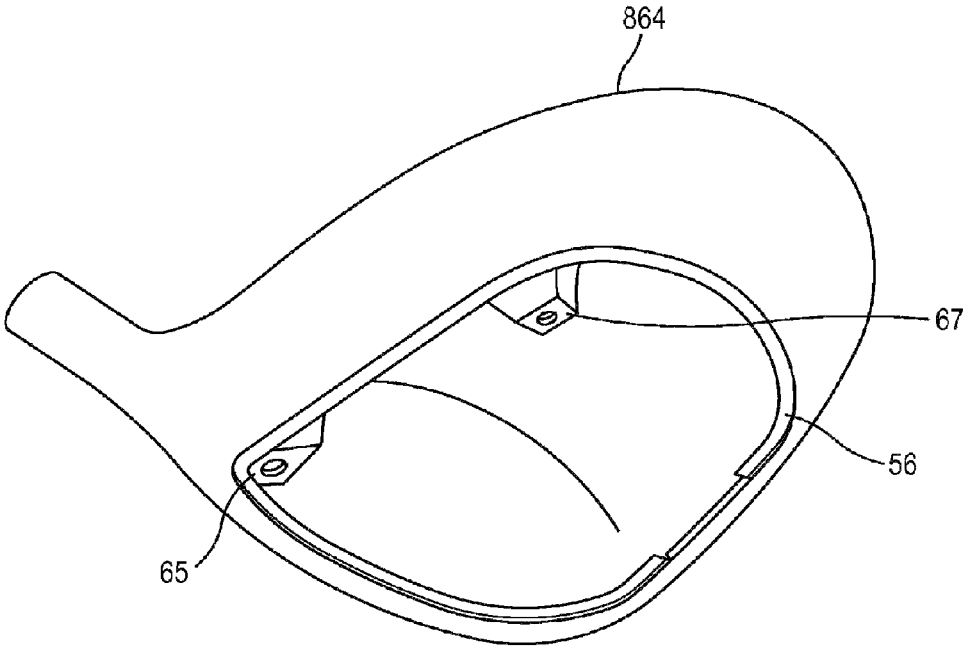
FIG. 33 shows a club head configured to receive a sole plate.

FIG. 33 shows club head 864 configured to receive insert 862 (here, a sole plate). Club head 864 includes boss 67 having a threaded hole to mate with threaded post 63. Club head 864 further includes attachment flange 56 and repositionable shaft housing 65. Insert 862 can be positioned on the base of club head 864 with 866 hooked therein. Releasable component 58 and shaft screw 30 can then be tightened (e.g., with a tool), fixing inset 862 there in place. One insight of the invention associated with clubs with most beneficial properties is the dual functionality of a releasable component to provide a customizable mass distribution while also providing a mechanism for fastening a separable component to a club head. Separable components are discussed in U.S. Pub. 2011/0294589, the contents of which are hereby incorporated by reference in their entirety for all purposes. Here, the invention provides the ability to finely-tune a club head to correct for a golfer's hook or slice by positioning the weight on a heel side, toe side, or both, through the use of a releasable weight component. Rather than simply adding a mass of weight, the fastening mechanism of the present invention derives most desirable additional utility in unexpected ways by harmonizing the placement of releasable weights used to aid in improving a golfer's shot with the fastening of releasable body components.

In some aspects, the invention provides club heads with separable components that can be attached or removed without the use of tools.

Figure 34:
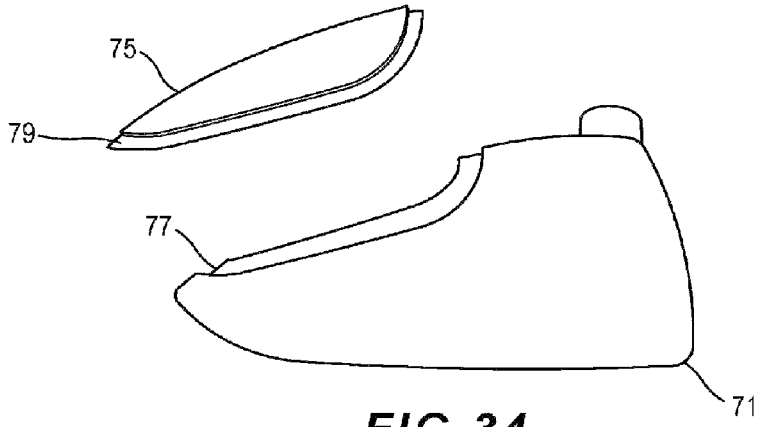
FIG. 34 shows a club head with slotted flange and deformable crown panel.
Figure 35:
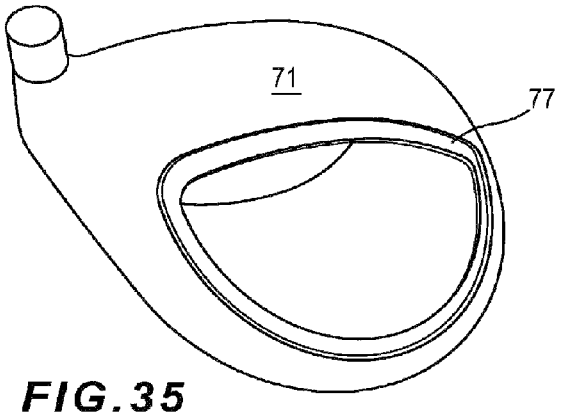
FIG. 35 shows a club head with slotted flange.
Figure 36:
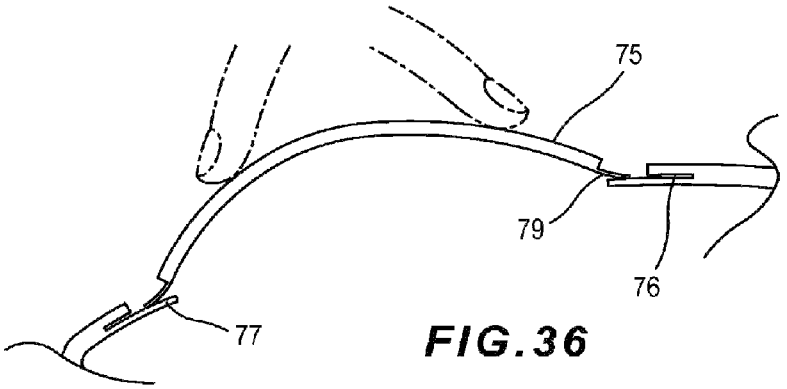
FIG. 36 shows insertion of a deformable crown panel into slotted flange.

FIG. 34 shows a club head 71 with slotted flange 77 and deformable crown panel 75. As shown in FIG. 35, slotted flange can extend around an aperture in a club head, completely or in part. Crown panel 75 is then positioned so that a thin edge 79 is pressed against slotted flange 77, as shown in FIG. 36. Crown panel 75 deforms plastically or elastically.

FIG. 36 shows panel 75 being bent so that it bows outwards, allowing thin edges 79 to be inserted into slot 76 in slotted flange 77. As panel 75 is released, it tends to return to its original shape such that thin edge 79 fully inserts into slot 76. In some embodiments, it is pushed entirely into place and adjusted by hand.

Figure 37:
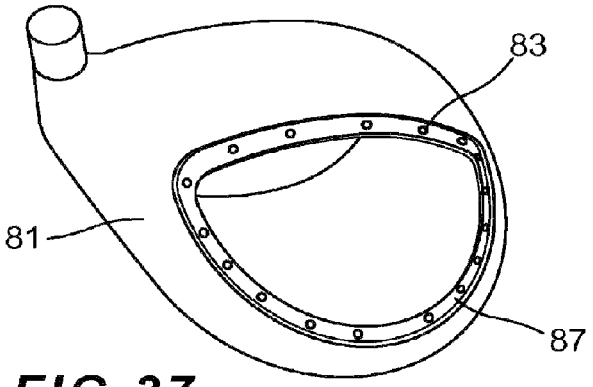
FIG. 37 shows a club head with flange with holes.

In some embodiments, a separable component is attached to a club head without tools through the use of one or more barbed posts. FIGS. 37-40 show a tool-less removable panel attachment system. As shown in FIG. 37, club head 81 includes a flange 87 having one or more of hole 83 therethrough.

Figure 38:
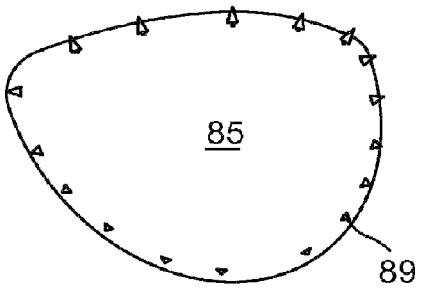
FIG. 38 shows a crown panel with barbed posts for insertion into holes in a flange.
Figure 39:
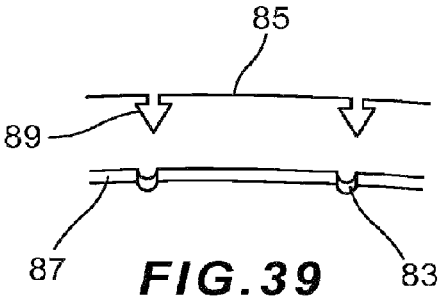
FIG. 39 shows a cross-sectional view of barbed posts and flange with holes.

FIG. 38 shows an insert having one or more barbed post 89 positioned and dimensioned to correspond to the holes 83. FIG. 39 shows a detailed cross-sectional view of barbed posts 89 and flange 87 with holes 83. When insert panel 85 is pushed into place, each barbed post 89 pushes through a hole 83. The barbs deform plastically/elastically and retain insert 85 mounted securely on club head 81.

Figure 40:
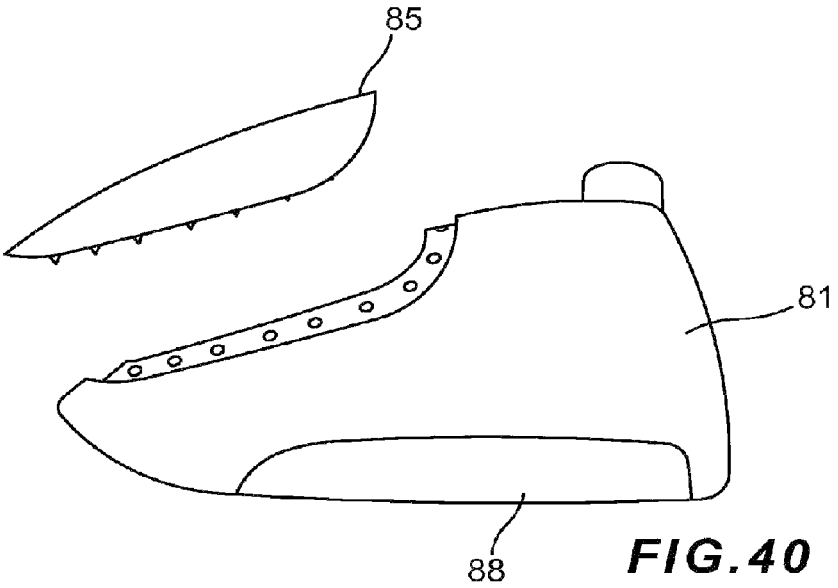
FIG. 40 is a side view of a club head and crown panel with barbed posts.

FIG. 40 is a side view of club head 81 and crown panel 85 with barbed posts 89 positioned to be attached together.

In certain embodiments, club head 81 is provided for use with one or more disposable inserts 85. Each insert 85 can have a novel or interesting color or pattern. A golfer chooses one that he or she finds pleasing and inserts it into club head 81 through the use of the barbed posts (or any of the other suitable mechanisms such as those described elsewhere herein). When the golfer wishes to remove insert 85, pulling it away from club head 81 snaps all of the barbed posts off, and the insert is set aside. A golfer may use a tool, such as a thin, flat screwdriver, to lift a first edge of insert 85 to aid in removing it.

In certain embodiments, the invention provides a club head with a removable and re-attachable panel through the use of depressable engagement tabs.

Figure 41:
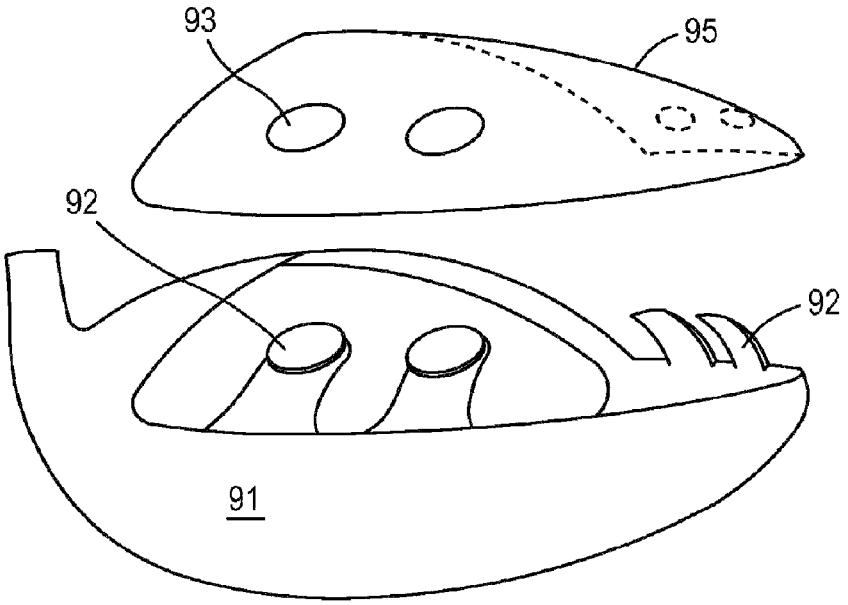
FIG. 41 shows a club head with button tabs and attachable crown panel.

FIG. 41 shows a club head 91 with four of depressable engagement pad 92 and attachable crown panel 95. Crown panel 95 has four receiving holes 93 dimensioned to correspond to a button portion of the depressable engagement pads 92. When crown panel 95 is pushed onto club head 91, pads 92 deform (e.g., bend inwards) and then snap into place.

Figure 42:
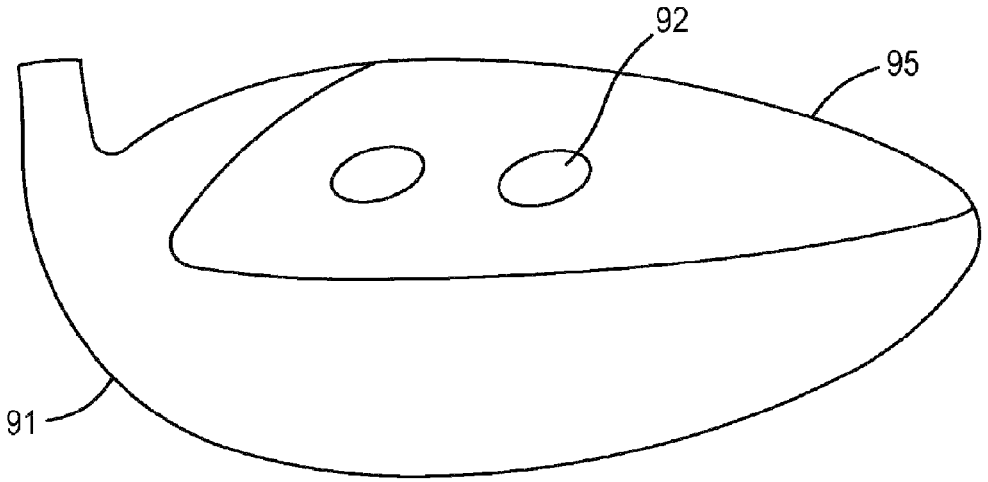
FIG. 42 shows the club head and panel in FIG. 41 assembled.

FIG. 42 shows an assembled club head 91. To remove panel 95, the button portion of pads 92 is depressed and panel 95 is lifted off. Any suitable number of pads 92 may be included, and in any suitable arrangement.

In some embodiments, a removable or disposable panel is provided to be attached via adhesive.

Figure 43:
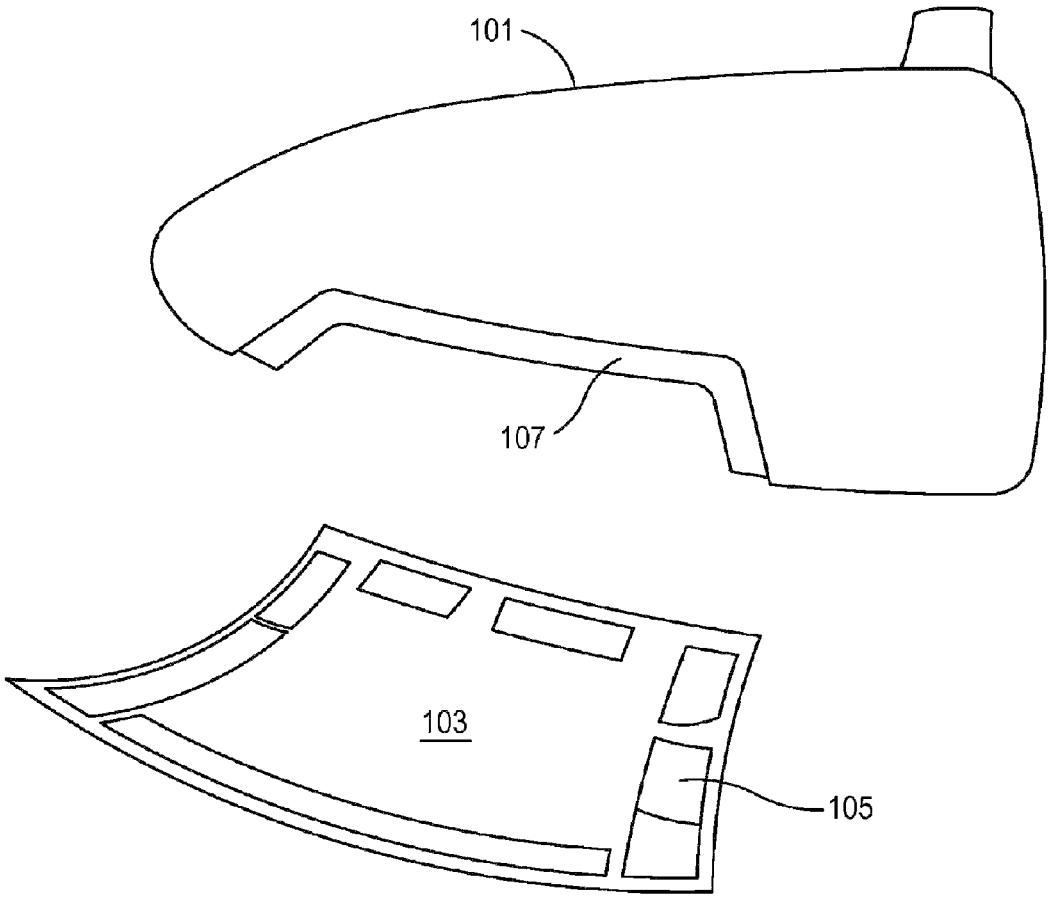
FIG. 43 shows a club head and sole plate with pre-attached adhesive strips.

FIG. 43 shows a club head 101 and sole plate 103 with pre-attached adhesive strips 105. Adhesive strips 105 can be located to correspond to flange 107. Alternatively, plate 103 may not include adhesive strips 105, and they can be provided separately (e.g., as double-stick tape). In some embodiments, plate 103 is fastened into place through the use of VHB adhesive tape, wet epoxy, or a combination thereof. Fastening is discussed in U.S. Pub. 2011/0045921, the contents of which are hereby incorporated by reference in their entirety for all purposes.

In various embodiments, providing a club head with a body member and one or more outer panels provides a club designer with opportunities for novel arrangements of material to tune a mass distribution, to enhance strength, to refine sound tuning, or modify coefficient of restitution of a club head. For example, certain embodiments, a panel will be used to cover what would otherwise be one or more holes in a club head body. Where the club head body includes a metal or other heavy material, and the panel includes a plastic, composite, or other lightweight material, this can provide significant weight savings.

Figure 44:
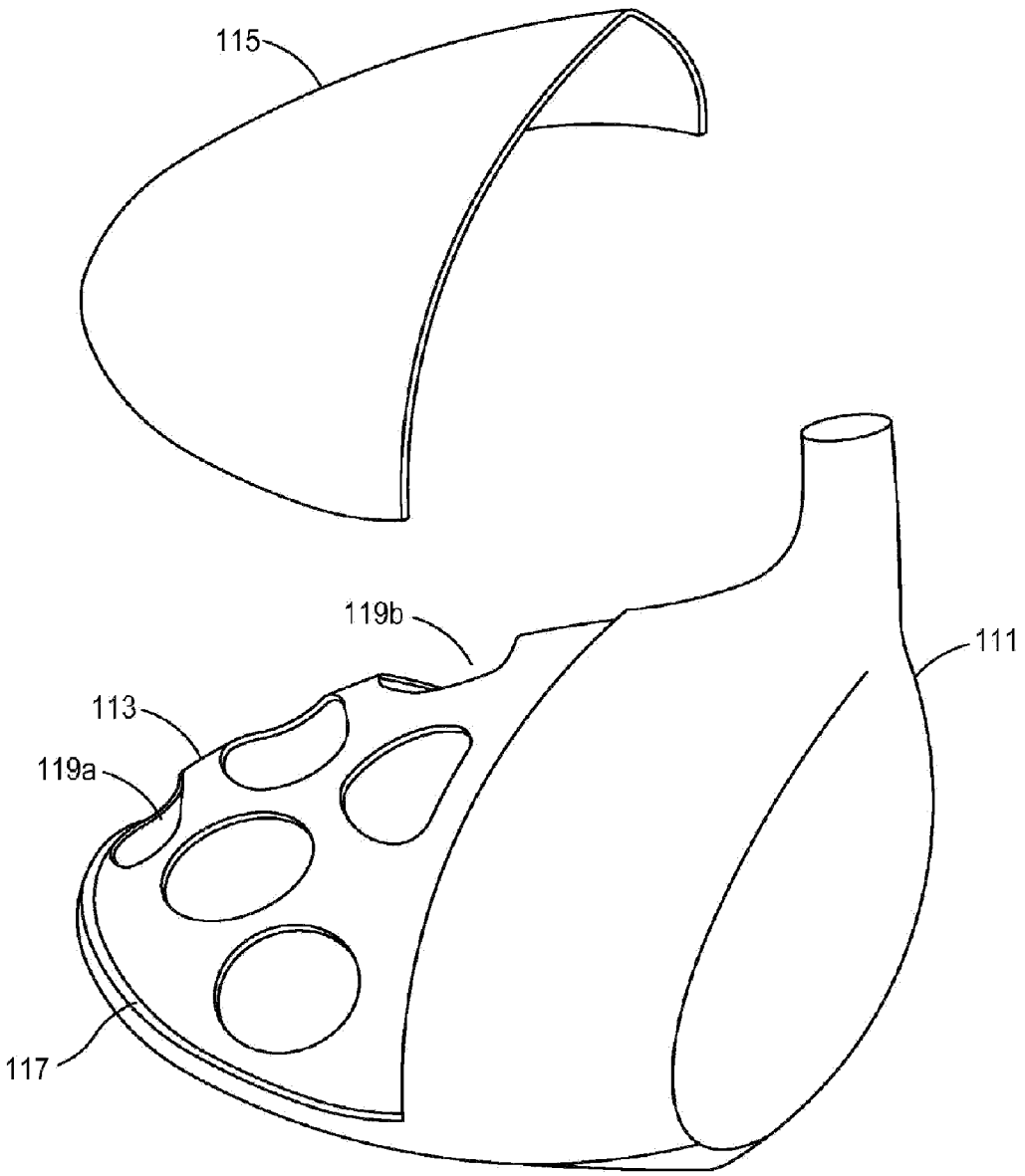
FIG. 44 shows a club head with cage structure and attachable crown panel.

FIG. 44 illustrates a club head 111 having a crown panel 115 to cover a cage portion 113 that includes one or more of hole 119*a*, 119*b*, . . . etc. Cage portion 113 can be surrounded by lip 117 dimensioned to correspond to an edge of panel 115. It may be found that this construction of a club head provides excellent durability and coefficient of restitution, while allowing for significant mass savings (relative to a club head without holes 119). Furthermore, panel 115 can be customizable or interchangeable. In certain embodiments, panel 115 has adhesive on an inner surface, barbed posts corresponding to holes in club head 111, a thin edge corresponding to a slotted flange on club head 111, or any other suitable attachment mechanism such as those described herein.

In certain embodiments, a club head with a multi component construction makes use of a rapid fastening system such as the bolt assembly sold under the trademark POPBOLT by Emhart Technologies (Shelton, Conn.).

Figure 45:
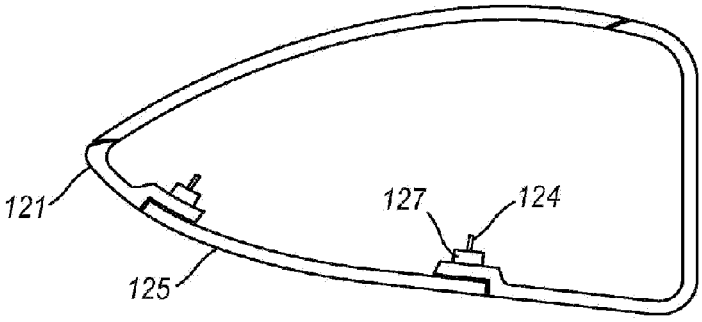
FIG. 45 is a cross-sectional view of a club head assembled with a rapid fastening system.

FIG. 45 is a cross-sectional view of a club head 121 assembled with a rapid fastening system. As shown in FIG. 45, a panel 125 is mounted to a flange in club head 121. A bolt post member 124 protrudes through a hole in the flange, and a collar 127 is affixed thereto. In certain embodiments, post member 124 is a threaded bolt and collar 127 is a threaded nut. In some embodiments, post member 124 and collar 127 are components of a rapid fastening system.

FIG. 46 illustrates a method of rapidly fastening a sole plate to club head 121. As shown in FIG. 46, post member 124 is provided by a separate bolt. Collar 127 is positioned thereon and tool 129 is used to fasten collar 127 to post member 124. When using a system such as the bolt assembly sold under the trademark POPBOLT, collar 127 is swaged to post member 124. Post member is threaded to begin with and swaging collar 127 to post member 124 causes collar 127 to become threaded. Collar 127 can then be removed through the use of a wrench. Swaging collar 127 to post member 124 is described in FIG. 49.

Figure 47:
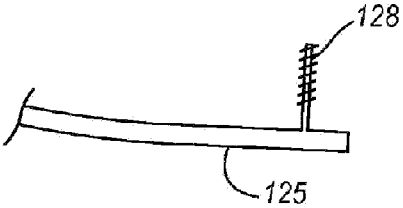
FIG. 47 shows a threaded post for use in a rapid fastening system.

FIG. 47 shows a post member 128 formed integrally with insert 125 and protruding from a surface of the insert.

Figure 48:
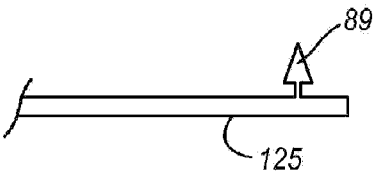
FIG. 48 shows a barbed post for attachment to a hole.

FIG. 48 illustrates an embodiment in which a protruding post is a barbed post 89. Insert 125 with barbed post 89 can be used in club head 121, even where club head 121 can also, separately, be used with a rapid fastening system. In some embodiments, club head 121 has a rapid fastening system used to fasten insert 125 in place (e.g., by swaging collar 127). Then, collar 127 is removed with a wrench and insert 125 is removed and set aside. Another insert 125 that includes barbed posts 89 is then fixed to club head 121 using the same holes. By these means, a club head can be customized with a tool (for example, in a pro shop) by one method, but then can be "field stripped" and re-customized out on the course without the benefit of the tool system.

Figure 49A:
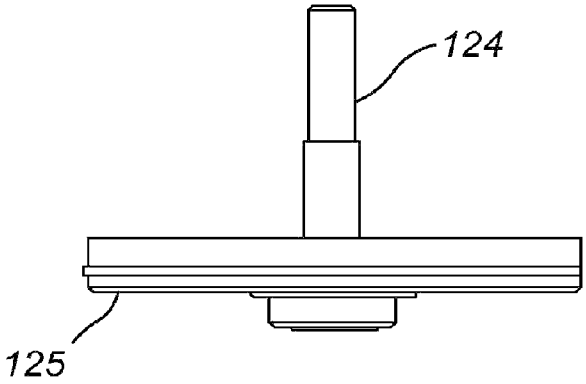
FIGS. 49A-49C illustrates a mechanism of a rapid fastening system.
Figure 49B:
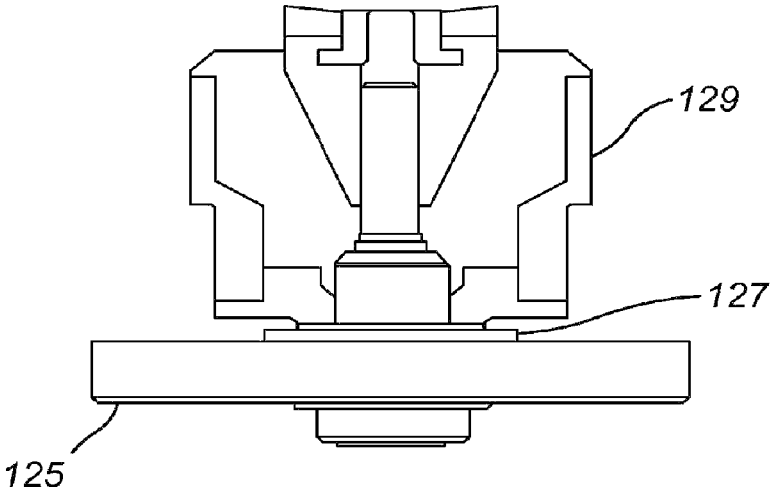
Figure 49C:
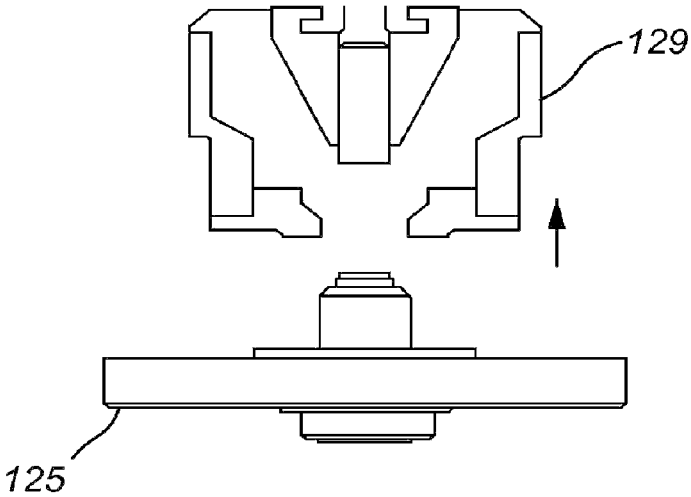

FIGS. 49A-49C illustrate the operation of a rapid fastening system such as the bolt assembly sold under the trademark POPBOLT by Emhart Technologies (Shelton, Conn.). As shown in FIG. 49A, a bolt or post is inserted through a hole (e.g., post 124 protruding from insert 125 is inserted through a hole in a corresponding flange on a club head body). FIG. 49B shows positioning collar 127 over post 124 through the use of tool 129. In certain embodiments, a tool 129 of a rapid fastening system carries collar 127 and positions it over post 124. As illustrated by FIG. 49C, operating a trigger on tool 129 swages collar 127 to post 124 (simultaneously forming a threaded connection). Operating tool 129 also breaks off an excess portion of post 124 and removes it. Tool 129 can then be taken away from the assembly site.

Figure 50:
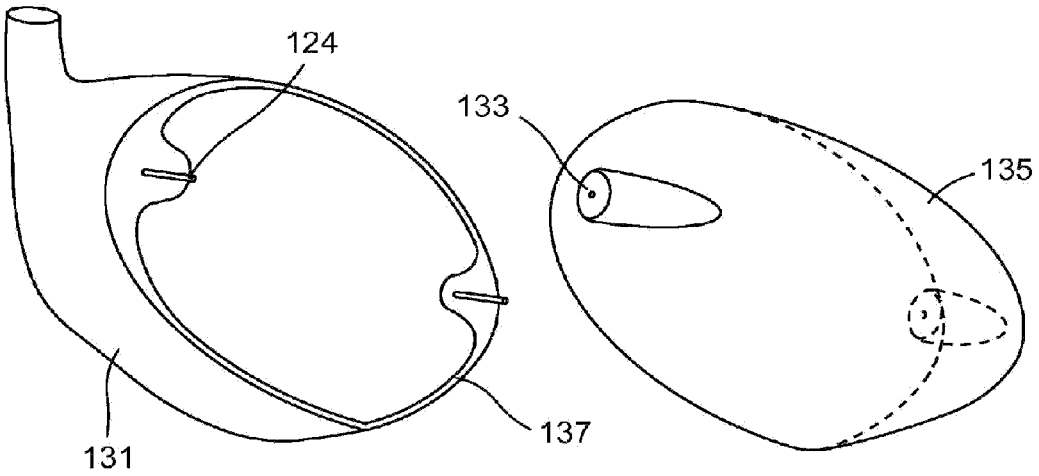
FIG. 50 shows a hosel/face member and a body member.
Figure 51:
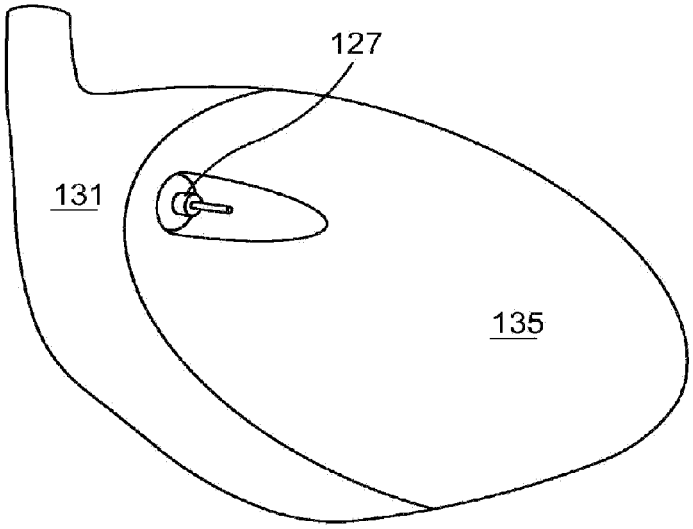
FIG. 51 shows the components of FIG. 50 assembled with a rapid fastening system.

FIG. 50 shows a hosel/face member 131 and an aft body member 135 adapted to be coupled together with a rapid fastening system. Face member 131 can include one or a number of post member 124, while body 135 has a corresponding number of inset boss 133 dimensioned so that post 124 slides through a hole therein. In certain embodiments, collar 127 is then positioned on post 124 and fastened into place as discussed above and as shown in FIG. 51. Suitable club heads for use with systems of the invention are discussed in U.S. Pat. No. 7,959,522, the contents of which are hereby incorporated by reference in their entirety for all purposes.

In some embodiments, the invention provides a club head with a sole or crown insert that press-fits or snap-fits into place from within the inside of the club head.

Figure 52:
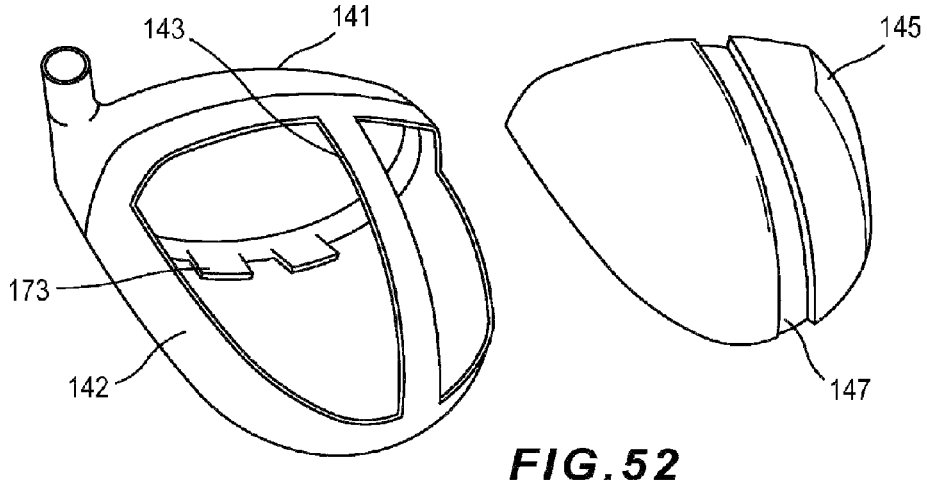
FIG. 52 shows a club head with voids and a translucent insert panel.
Figure 53:
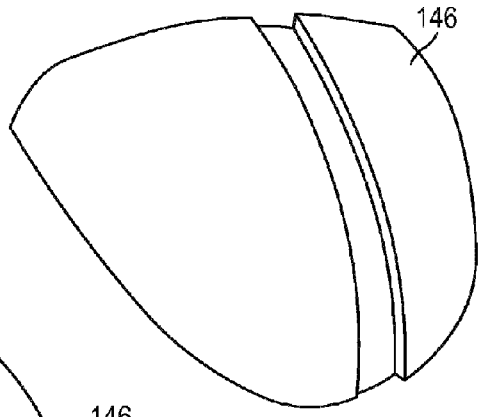
FIG. 53 shows an opaque insert panel for a club head with voids.
Figure 54:
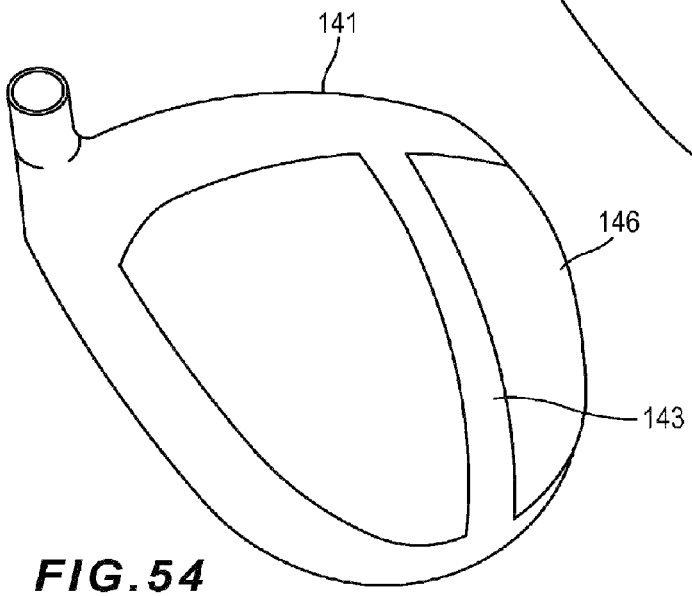
FIG. 54 shows a club head assembled with an insert panel.

FIGS. 52-54 show a club head body 142 configured to receive internal insert 145. As shown in FIG. 52, club head body 142 can be separated from face member 141. Face member 141 is mounted to club head body by one or more of cantilever 173 (discussed in more detail with respect of FIGS. 60-66, below).

To attach insert 145 to club head body 142, face member 141 is removed. Insert 145 is pushed into body 142 from the front aperture. Insert 154 deforms slightly (e.g., by plastic/elastic deformation) and then snaps into place within club body 142. As shown in FIG. 52, body 142 has band 143 dimensioned to correspond to groove 147 on insert 145. Once insert 145 is snapped into place, it can be held in place because an outer edge of insert 145 deforms (compresses) to be insert, and then returns to original shape such that the edge overlaps the edge of the corresponding void in body 142. Insert 145 can similarly be removed by squeezing it from a heel side and a toe side such that the outer edge compress, and then pushing it into the inner volume of body 142 and removing it from the aperture at the front of body 142. As shown in FIG. 52, insert 145 is translucent or transparent.

FIG. 53 illustrates an opaque insert 146 that functions in the same manner.

FIG. 54 shows an assembled club head including body 142 and insert 146 or insert 145.

In certain embodiments, the invention provides a club head in which a face component can be separated from a body component through the use of a threaded connection.

Figure 55:
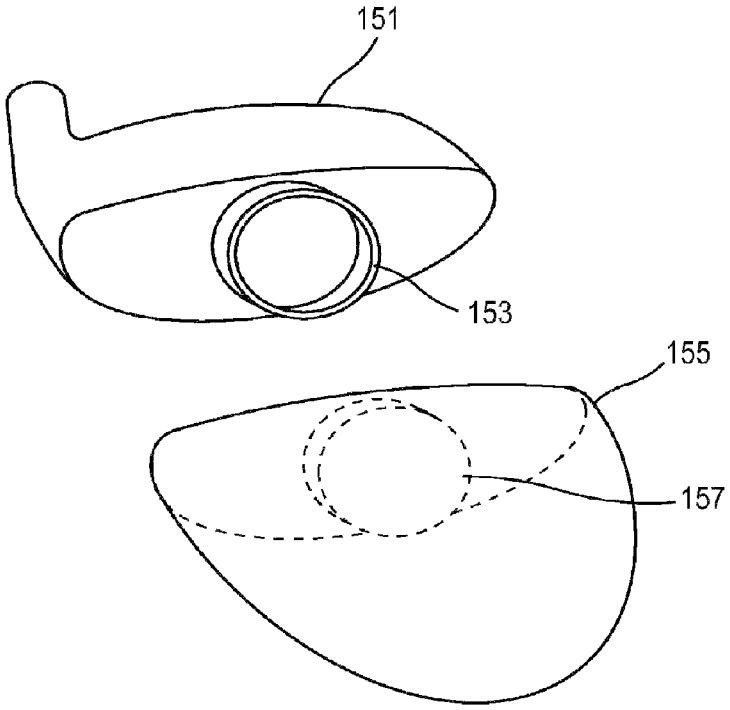
FIG. 55 shows a face member and body member with corresponding threaded portions.
Figure 56:
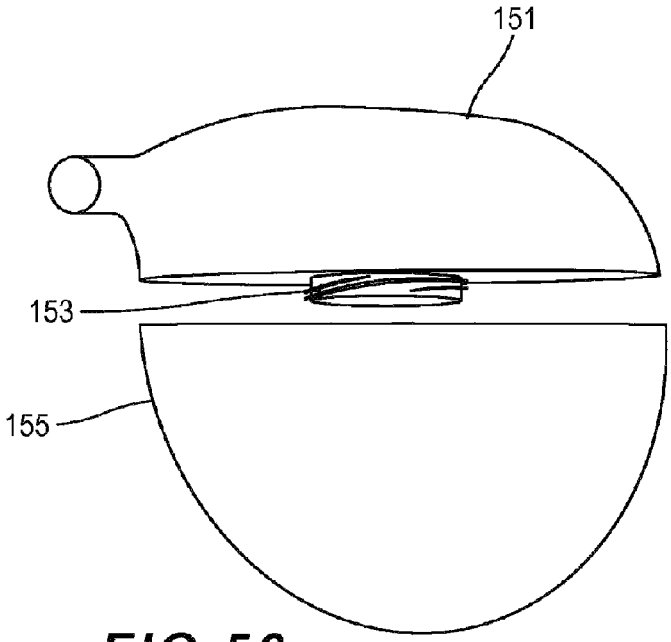
FIG. 56 is a top view of a face member and body member with threaded portions.

FIGS. 55 and 56 show face member 151 and body member 155 with corresponding threaded portions. As shown here, face member 151 bears male threaded member 153 and body member 155 bears female threaded recess 155. Body member can be threaded onto face member 153 and screwed tightly into place. In some embodiments, a club head as shown in FIGS. 55 and 56 is provided as a demonstration. For example, any part of the club head is transparent, and the threaded members allow the club head to be separated (e.g., by unscrewing) allowing a golfer to visually inspect an inside detail of the club head, such as layers of construction of a crown, skirt, or sole. In certain embodiments, such a club head is not meant for playing golf, but is provided primarily as a tool for displaying other features in a club head. In some embodiments, such a separable club head is provided as a novelty item, such as a toy for children, a canteen or flask, a tee case, or a gag gift or marketing prop. In certain embodiments, one of male threaded member 153 and female threaded recess 155 corresponds in dimensions to some commonly available threaded item (such as a mason jar or wide mouth drink bottle) allowing a golfer to make amusing assemblies.

In certain embodiments, the invention provides a strap-based assembly system that uses Velcro, snaps, clasps, or adhesives.

Figure 57:
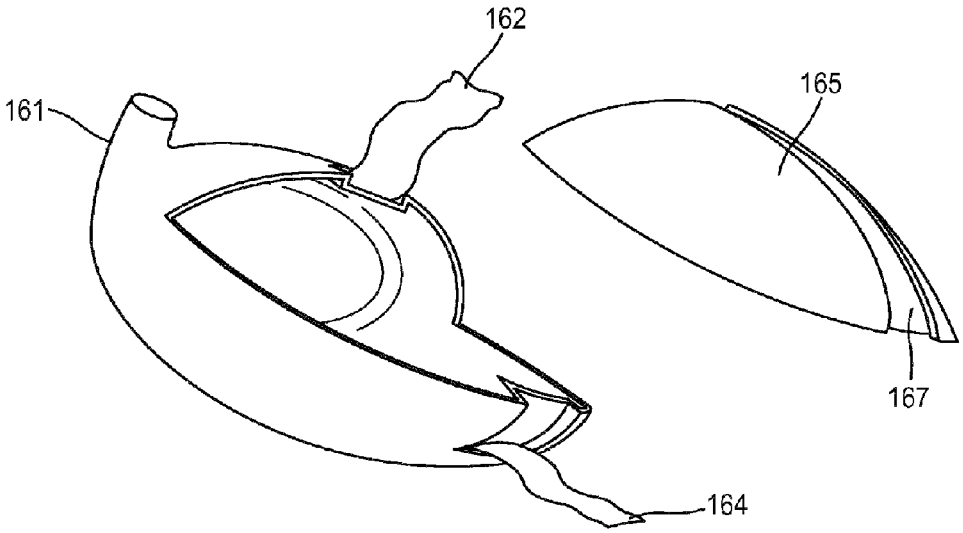
FIG. 57 shows a club head body with closeable strap and crown panel with groove.

FIG. 57 illustrates a club head 161 with a crown member 165 having a groove 167 therein. When the crown member 165 is positioned on club head 161, first strap 162 can be fastened to second strap 164, holding the crown member 165 in place.

Figure 58:
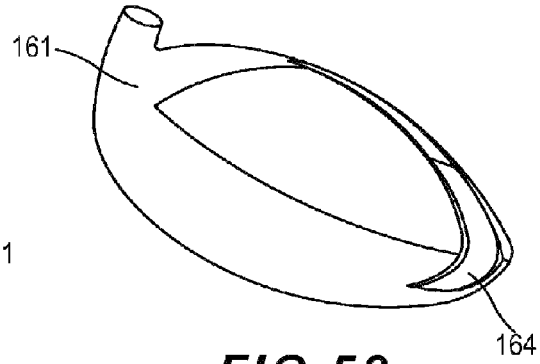
FIG. 58 shows an assembled club head with crown panel strapped to body.

FIG. 58 shows club head 161 with strap 164 holding crown member 165 in place. Crown member 165 can be translucent, transparent, or opaque. In certain embodiments, the straps fasten by Velcro. A club head of the invention can have one or more straps, individually or in combination, that bind to or surround a portion of a club head for functional or aesthetic purposes. For example, in some embodiments, a club head includes a strap (e.g., nylon, rubber, or leather) that extends in a face-aft direction, as shown in FIG. 57. In certain embodiments, a strap member extends around a club head, entirely or in part, in a heel-toe direction. Further, straps may extend in both directions or at angles relative to those directions.

Figure 59:
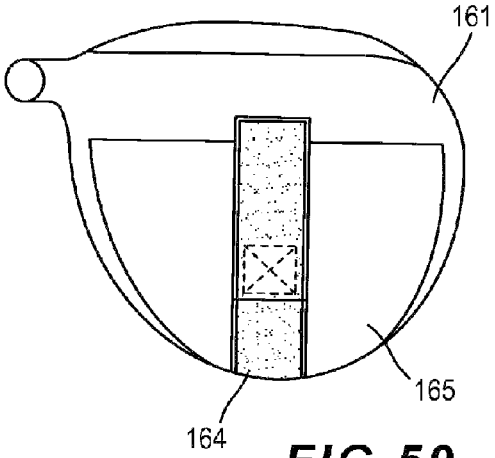
FIG. 59 is a top view of the club head shown in FIG. 58.

FIG. 59 is a top view of club head 161. Straps may be used to carry weight members or electronics-related items (e.g., devices such as shot-tracking devices with accelerometers or LCD screens). In embodiments in which crown member 165 is translucent or transparent, such an arrangement can provide a golfer a view of an element within the club head such as, for example, a digital screen or readout. Straps may be provided as described (e.g., as wrapping elements) in U.S. Pat. No. 7,896,753, the contents of which are hereby incorporated by reference in their entirety for all purposes.

In some aspects, the invention provides club heads that include cantilevered attachments. FIGS. 60-66 show cantilevers.

Figure 60:
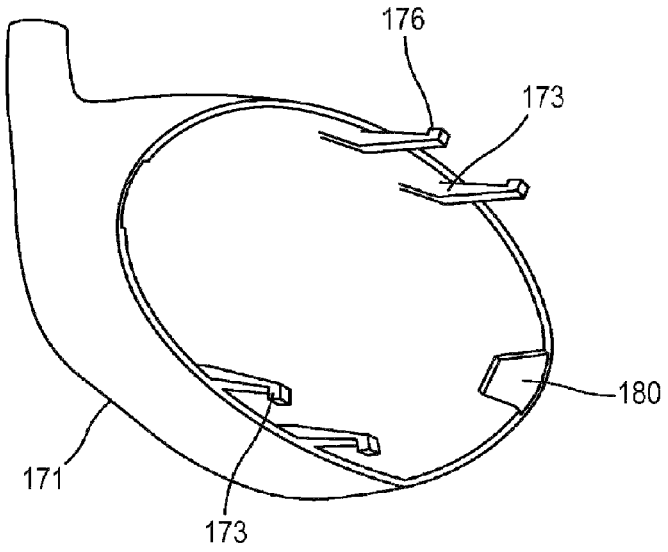
FIG. 60 shows a club head face member with cantilevered posts.

FIG. 60 shows a face member 171 having a number of cantilever 173 protruding therefrom. Body member 175, shown in FIG. 62, has a number of recess 177 located and dimensioned to correspond to tips 176 of cantilevers 173. When face member 171 is mated to body member 175, cantilever tips 176 snap into place in recesses 177, fastening the club together.

Either of the face member or body member may further include sets of corresponding tab 187 and slot 180 to aid in positioning the body members together.

In some embodiments (not pictured), recesses 177 are holes through a part of the club head, and the cantilevered component can be removed from the component with holes by pressing in on the tips 176. It will be appreciated that this describes a functionality that is related to that described with reference to FIGS. 41 and 42. Depressable engagement pad 92 and receiving hole 93 can be a related embodiment of cantilever 173 and recess 177, and vice versa.

Figure 61:
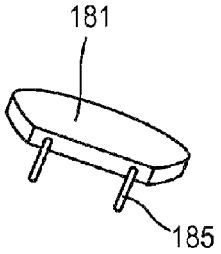
FIG. 61 shows a tool for separating a cantilevered attachment point.
Figure 62:
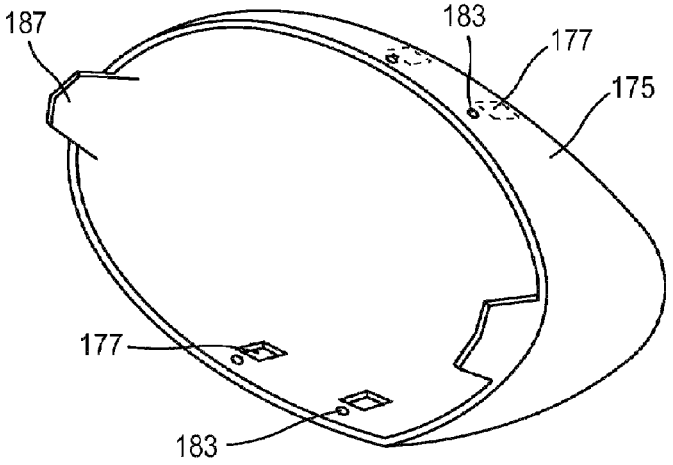
FIG. 62 shows a club head body member with recesses for receiving cantilever tips.

In some embodiments, a body member 175 includes decoupling holes 183. A tool 181 is provided, as shown in FIG. 61, having a prong set 185 dimensioned to be inserted into decoupling holes 183. Prong set 185 pushes cantilever tips 176 out of depressions 177, allowing club head components to be separated from one another.

Figure 63:
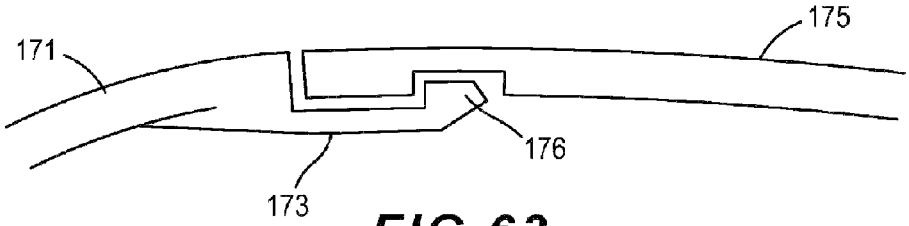
FIGS. 63-66 show configurations of cantilevered posts and recesses.

FIGS. 63-66 show configurations of cantilevered posts and recesses. FIG. 63 shows a cantilever 173 having a squared tip 176 designed to inseparably couple two components of a club head.

Figure 64:
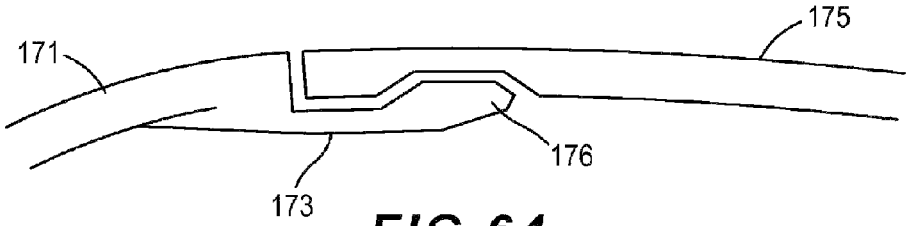

FIG. 64 shows an angled tip 176 designed to be slid out from recess 177 allowing components to be decoupled.

Figure 65:
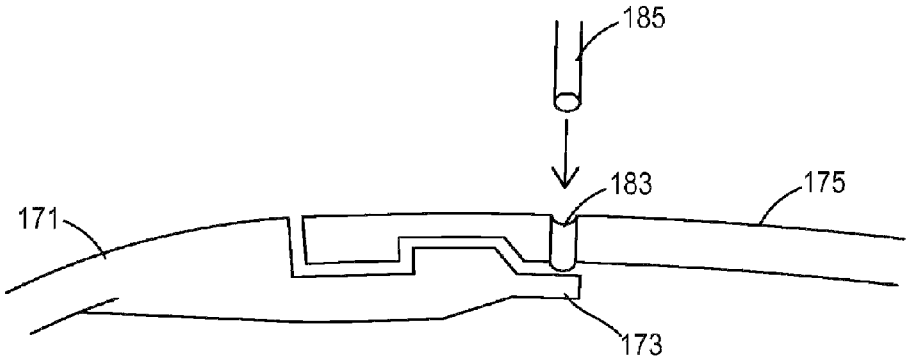

FIG. 65 shows another embodiment of decoupling holes 183 arranged so that prong set 185 pushes on a distal tip of cantilever 173.

Figure 66:
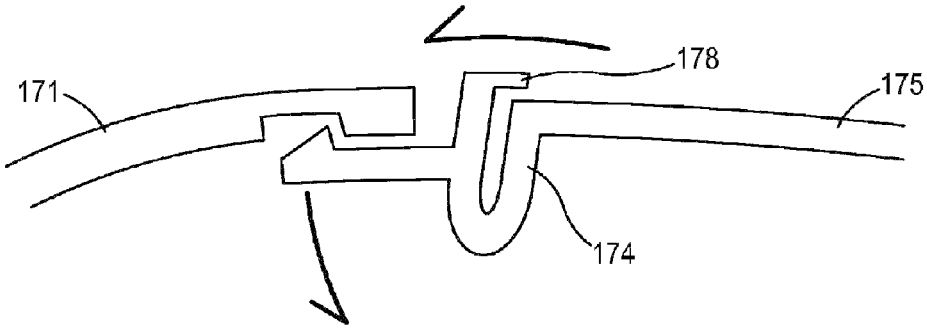

FIG. 66 shows a spring cantilever 174 having a protruding tab 178 available from an outside of a club head that can be manually squeezed to decouple components of a club head.

Figure 67A:
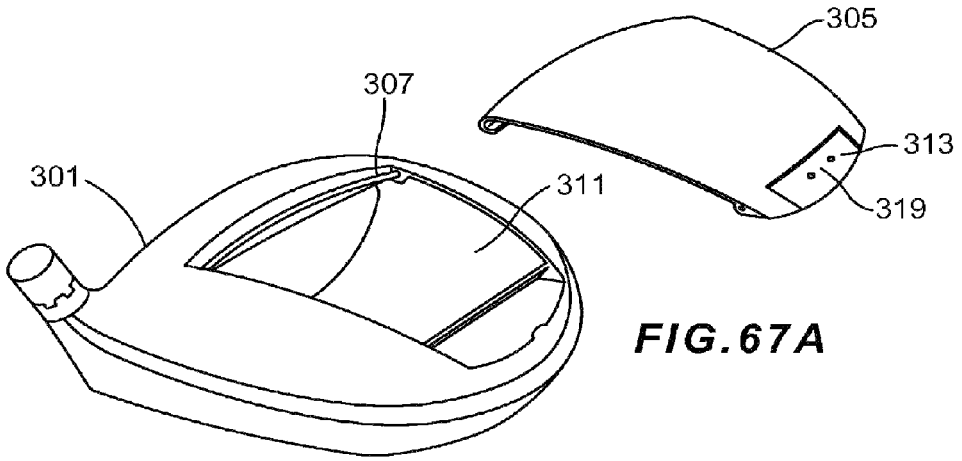
FIGS. 67A-67C show a club head with component with cam mechanism.
Figure 67B:
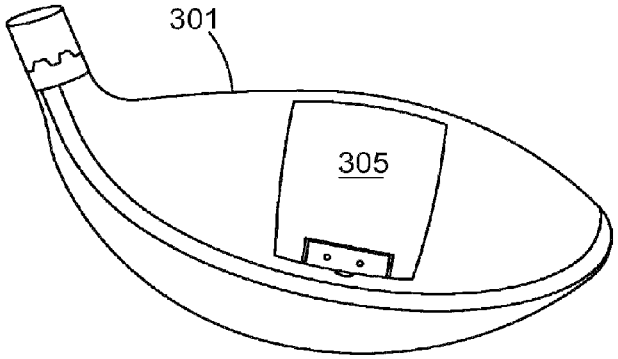
Figure 67C:
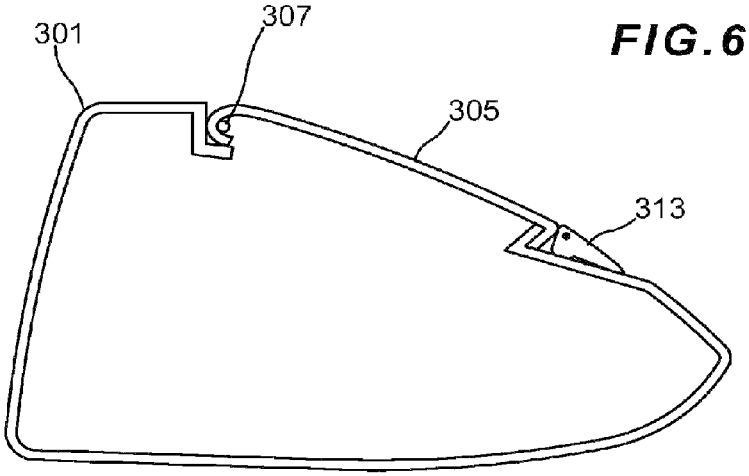

In certain aspects and embodiments, the invention provides separable components of multi-component club heads that employ a cam mechanism for releasably joining components. FIGS. 67A-67C show a club head 301 with component 305 having cam mechanism 313. As shown in FIG. 67A, club head 301 has a void opening 311 dimensioned to mate with component 305. One portion of component engages at a perimeter of void opening 311. Here, component 305 is shown having hooks to catch bar 307. Any suitable engagement mechanism can be used. With a portion of component 305 engaged at void opening 322, cam mechanism 313 can be rotated into place to produce a fastened-together club head as shown in FIG. 67B. FIG. 67C is a cross-section of club head 301 showing bar 307 receiving hooks of component 305, and cam mechanism 313 rotated into place.

Figure 68:
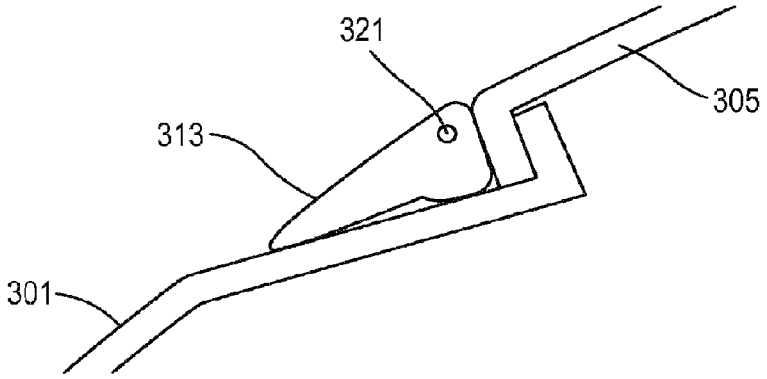
FIG. 68 is a detail view of the cam mechanism of FIGS. 50A-50C.
Figure 69:
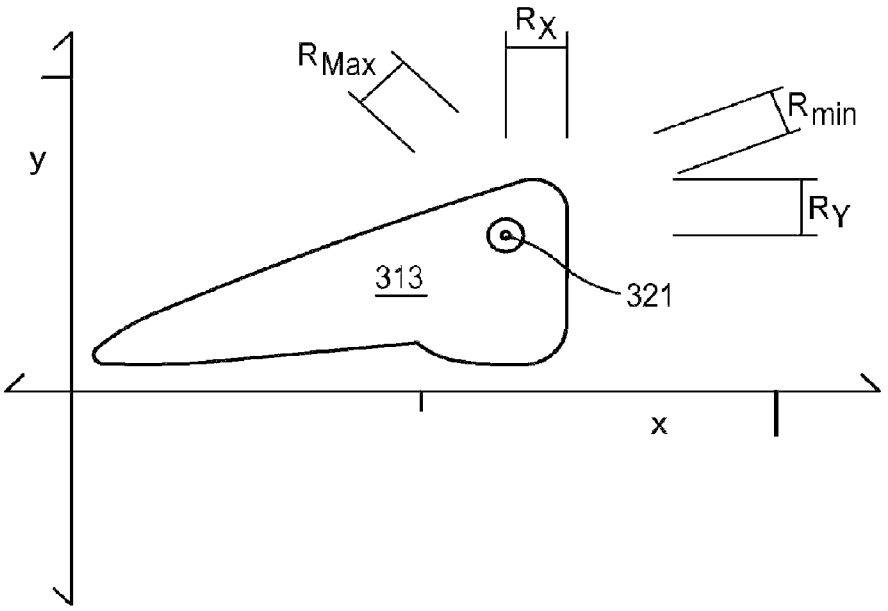
FIG. 69 illustrates radii around a cam axis.

FIG. 68 is a detail view of the cam mechanism of FIGS. 67A-67C illustrating cam axis 321 through cam mechanism 313. FIG. 69 illustrates radii around a cam axis. In certain embodiments, as shown in FIGS. 67-68, component 305 is dimensioned to engage with club head 301 such that some deformation of component 305 is required to remove it. As shown in FIGS. 67A and 67C, an aft portion of component 305 bends under and forward, while an aft portion of the perimeter of void opening 311 extends upwards and aftward. These two portions hook together (i.e., requiring some deformation of component 305 to put it into place on club head 301). When cam 313 is rotated into place, it abuts a surface of component 305 and prevents the deformation of component 305 that would be necessary to remove the component from the club.

As shown in FIG. 67A, cam mechanism 313 may have a tool engagement surface 319 capable of engaging with a tool. A golfer can engage the tool with tool engagement surface 319 to have leverage from the handle of the tool to release cam mechanism 313 from the fastened position.

FIG. 69 illustrates the operation of cam mechanism 313. As shown in FIG. 69, an outer surface of cam mechanism 313 defines a non-constant radius around cam axis 321. When cam mechanism 313 is fastened into place on an assembled golf club, cam axis 321 is spaced away from an adjacent portion of the club head by an engaged radius Rx. Cam mechanism 313 may further be dimensioned such that, when it is fully released (e.g., in the "up" position compared to FIG. 67A), cam axis 321 is spaced away from the adjacent portion of the club head by a minimum radius $R_{min}$. Releasing cam mechanism 313 requires pushing it through an orientation in which cam axis 321 is spaced away from the adjacent portion by a maximum radius $R_{Max}$. The relative dimensions of the radii (e.g., $R_{min}<R_X<R_{Max}$) prevents cam mechanism from releasing unexpectedly. Force must be applied (e.g., through the use of a tool) to deform component 305 enough to allow $R_{Max}$ to pass the adjacent portion of the club head. Because cam mechanism 313 presents the minimum radius $R_{min}$ to the adjacent portion when it is in the released position. component 305 has the most space to allow for easy removal from club head 301.

In certain embodiments, the amount of deformation required to remove component 305 from club 301 is close to the limit of perception for most people. A user may intuitively realize that they are deforming component 305 to attach it and remove it, but component 305 may not exhibit substantial deformation. In some embodiments, deformation of component 305 is elastic, plastic, or a combination thereof.

In some embodiments, a cam-based mechanism (e.g., as illustrated in FIG. 68) is used with another fastening mechanism. For example, a cam can be provided with a cantilever 173 (e.g., as illustrated in FIG. 60) such that, when the cam is engaged, cantilever 173 is prevented from exhibiting any deformation such that, for example, aft component 175 is fixed to face component 171 (making reference to FIGS. 60 and 62).

In certain embodiments, a cam is integrally formed with a fastening member. For example, FIGS. 70A-70D show a club head 331 with cam member 339 integrally formed with engagement hooks 338.

Figure 70A:
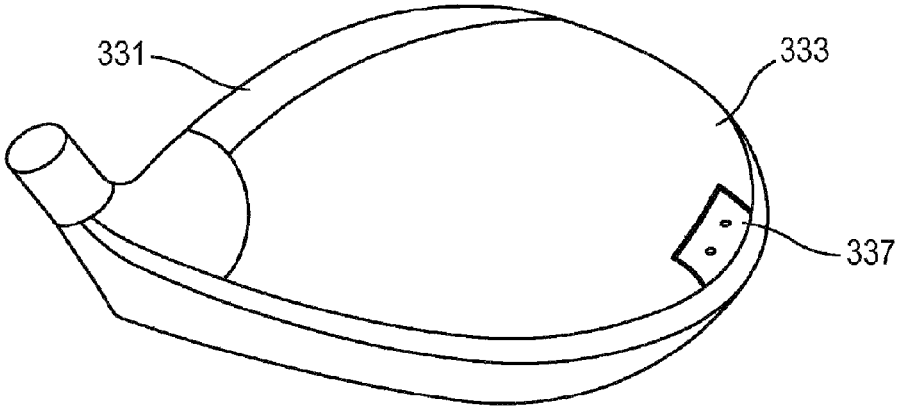
FIGS. 70A-70D show a club head with cam and engagement hooks.
Figure 70B:
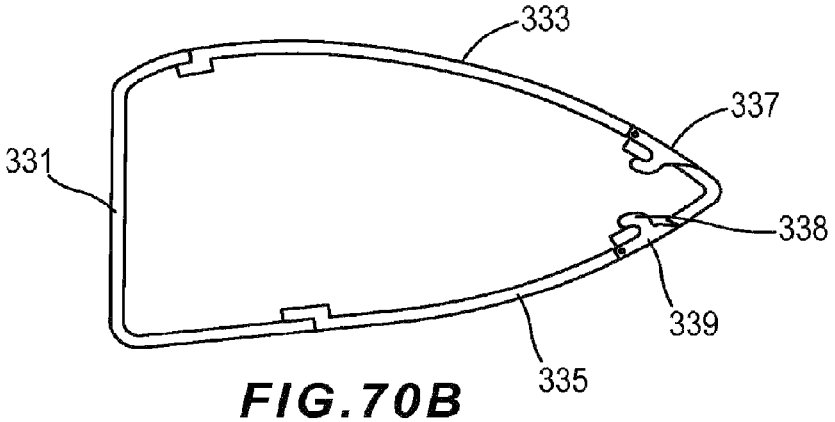

FIG. 70A shows club head 331 with removable crown 333 including cam member 337.

Figure 70C:
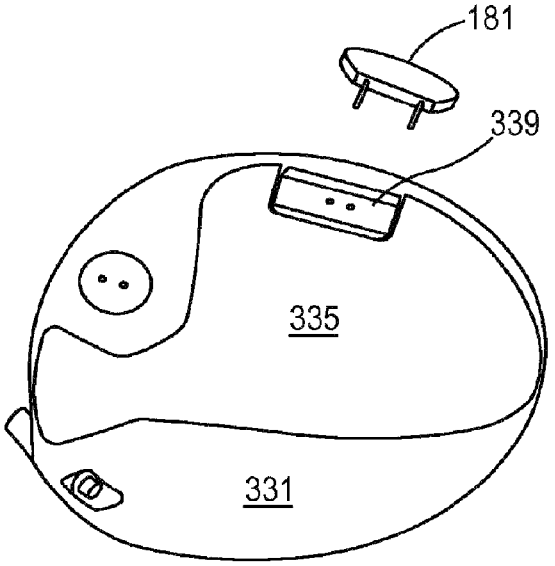
Figure 70D:
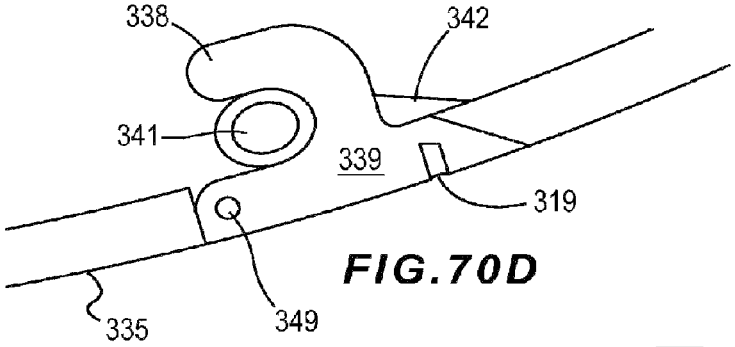

FIGS. 17B and 70C show removable sole 335 including cam member 339. Either or both cam member may have a tool engagement surface to be operated through the use of tool 181. FIG. 70D shows a detail view of cam member 337. Cam member 337 rotates about cam axis 349 bringing engagement hook around engagement member 341.

Figure 71A:
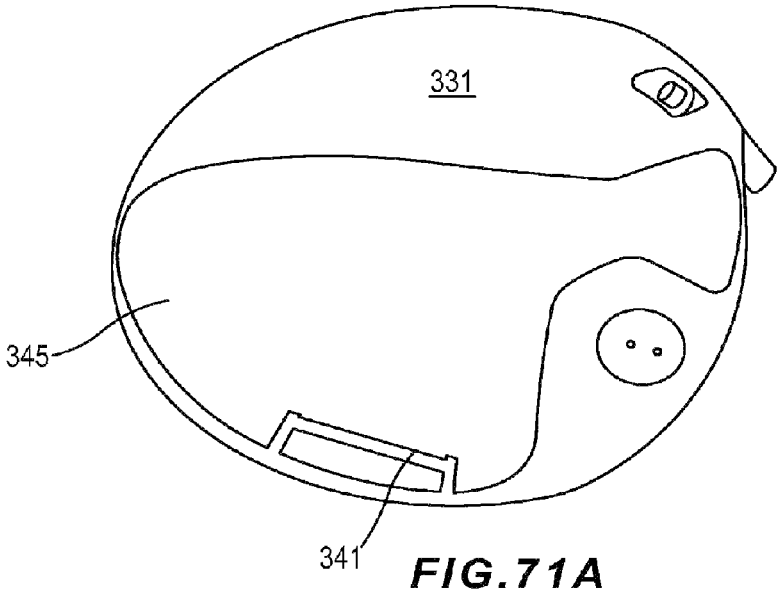
FIGS. 71A-71B show an engagement member for engagement hooks.
Figure 71B:
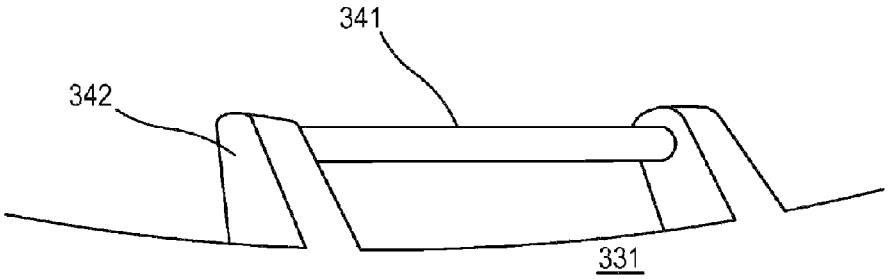

FIGS. 71A and 71B show engagement member 341 supported by one or more of arm 342 on club head 331. A surface of cam member 339 engages with a surface at a perimeter of removable sole 335 (the relevant portion of the perimeter of removable sole 335 may be thickened, folded inwards, or provided with an engagement block). When cam member 339 is engaged, it cannot freely release because force is required to push the portion of cam member 339 having RMax past the surface of the perimeter of removable sole 335. However, cam member 339 can be rotated by a golfer. In some embodiments, a golfer can manually rotate cam member 339, for example, because an elongated edge member provides a handle or lever. In certain embodiments, a golfer inserts a tool 181 into tool engagement surface 319 and uses the tool to release the component from the golf club.

In certain embodiments, the invention provides a golf club head with a removable component that fastens to a shaft of the golf club. Without being bound by theory, fastening a removable component to a shaft may provide for a very securely assembled club head due to the fact that the shaft provides a carriage function in that it carries the club head and it carries the energy of a golfer's swing. A component secured to the shaft can transmit any stress energy it is subject to through the shaft to the golfer—just as energy of impact is transmitted from a center of percussion at the club head to the golfer. Thus, when a golf ball is hit, the impact energy is transferred from the club head body through the shaft to the golfer and, simultaneously, from the separable component through the shaft and to the golfer. Accordingly, fastening the separable component to the shaft may tend to inhibit relative stresses between the component and the club head body.

Figure 72A:
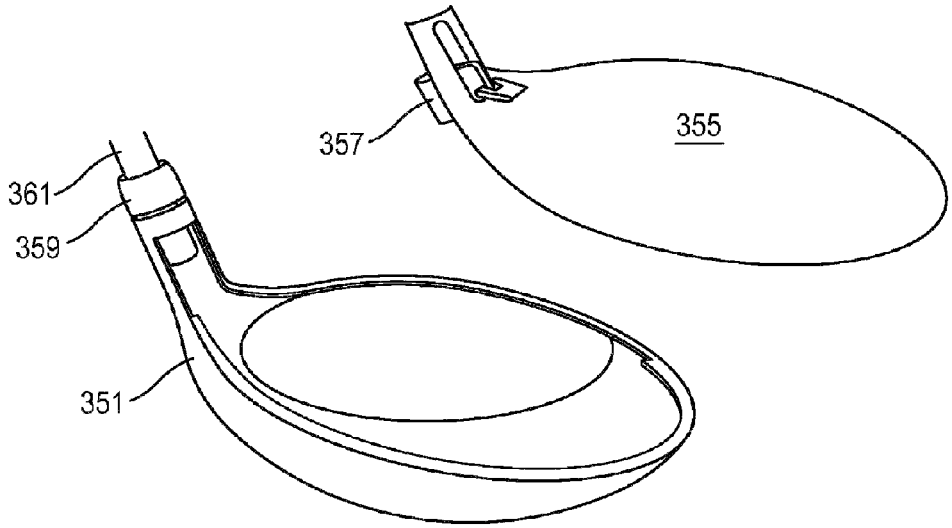
FIGS. 72A-72B show a component coupling system.
Figure 72B:
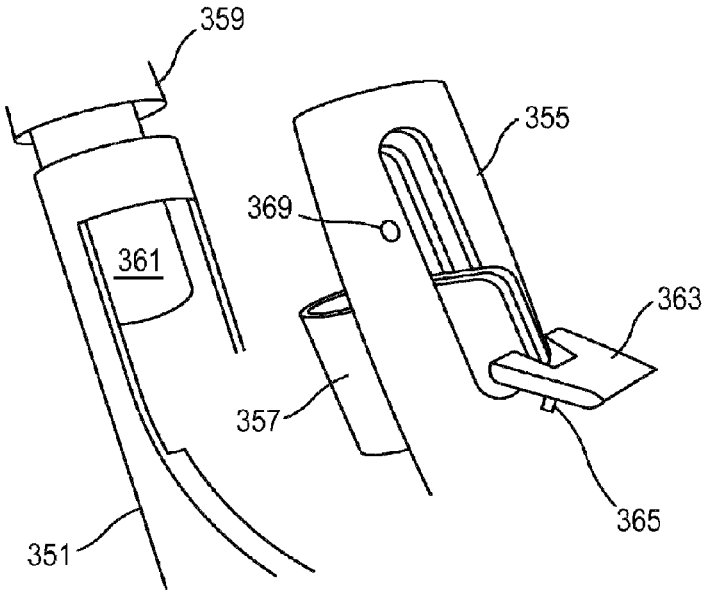

FIGS. 72A-72B show a separable component 355 for club head 351 including a mechanism for coupling to a shaft 361 of a golf club. Club head body 351 includes a cutaway, or void, dimensioned to correspond to component 355. Shaft 361 extends through a hosel of club head body 351, and may include a ferrule 359. Component 355 has a fastening mechanism that includes shaft collar 357 dimensioned to pass into club head body 351 and engage a portion of shaft 361.

Figure 73:
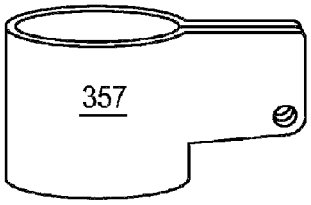
FIG. 73 shows a shaft collar for using a coupling system.

As shown in FIG. 72B, component 355 includes a slot that extends in a vertical direction when the club is at address. When component 355 is mounted to body 351, shaft collar 357 is disposed beneath an end of shaft 361. A golfer then lifts the mechanism, sliding shaft collar over the end of shaft 361. FIG. 73 shows shaft collar 357. In some embodiments, shaft collar 357 has a cylindrical portion and two tabs that extend from the cylindrical portion. In some embodiments, the two tabs are spaced apart from one another, at least proximal to the cylindrical portion, while shaft collar 357 is not subject to any stress. Sliding shaft collar 357 upwards through the slot in component 355 can push the tabs together if a portion of the slot has an inverted V shape. Thus, sliding collar 357 up over shaft 361 forms a press-fit between collar 357 and the shaft. Once positioned so, tab 363 can be swung into a closed position, pushing post 365 into hole 369 (which can be a press-fit or snap-fit engagement) so that collar 357 remains firmly mounted to shaft 361. In this way, component 355 is securely mounted to club body 351 to provide a playable club.

Figure 74:
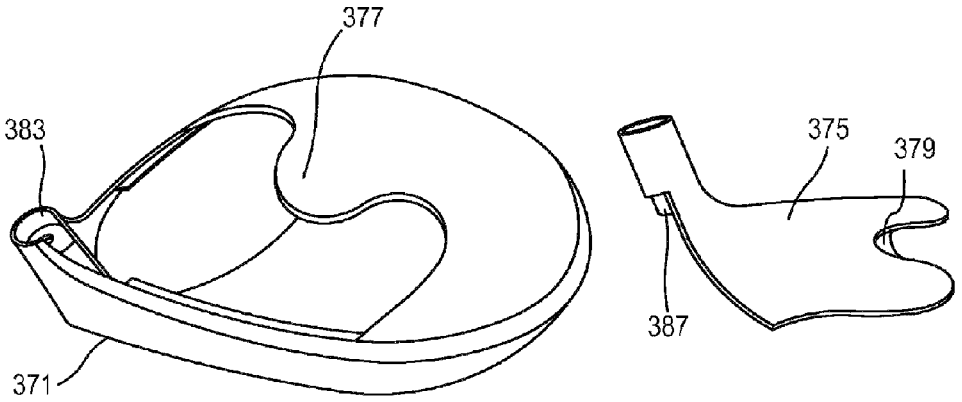
FIGS. 74 and 75A-75C show a club head with crown component.
Figure 75A:
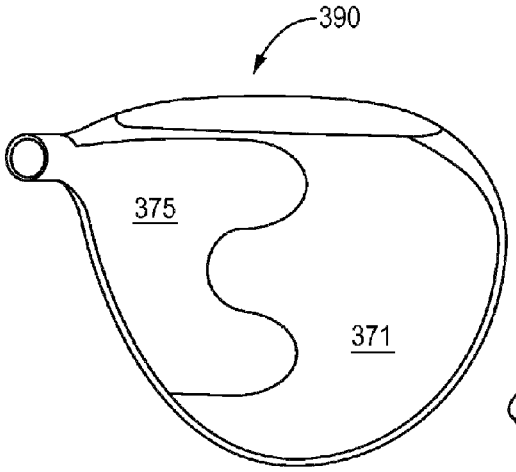

In some aspects, the invention includes the realization and development of the idea that a multi-component golf club head may be provided with optimized characteristics by coupling a component to a club head body or another component by fastening the component to the shaft or fastening the component into place through the use of a mechanism that also provides other functionality in the club head. A component may be securely fastened to a club head body through integration with the shaft by a variety of suitable mechanisms. FIGS. 74 and 75A-75C illustrate a mechanism for removably coupling a component to a club head body via the shaft. As seen in FIG. 75A, club head body 371 includes a cutaway void in the crown area dimensioned to receive an insert. While illustrated here as a portion of the crown, a cutaway void and a corresponding insert could define any suitable portion of the club head.

Figure 75B:
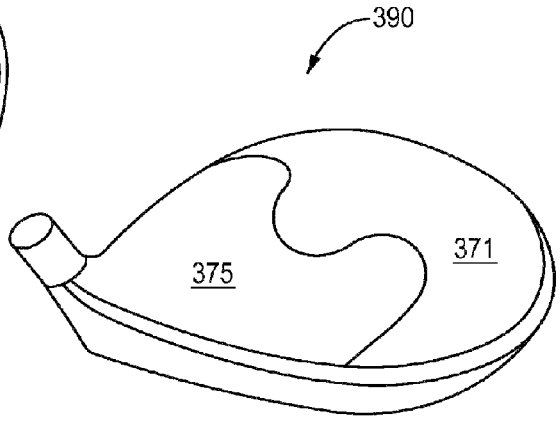
Figure 75C:
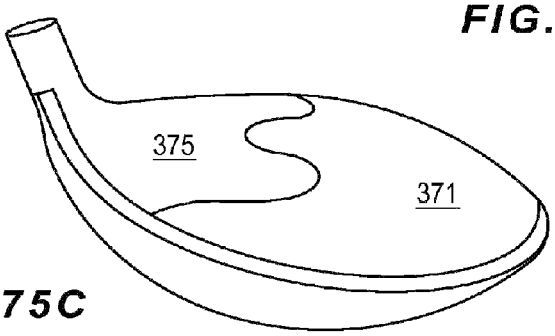

Club head 371 includes hosel recess 383 dimensioned to mate with hosel insert 387 on component 375. Component 375 is coupled to club head body 371 by inserting hosel insert 387 into hosel recess 383 to form an assembled club head 390 as shown in FIGS. 75A-75C. As can be seen in FIG. 74, the cutaway void in club head body 371 has a flange around at least a portion of the perimeter of the void.

Further, as illustrated in FIG. 75A, the cutaway void and the component 375 have corresponding wavy edges. The perimeter edge of the cutaway void is wavy in that it defines one or more lobe 377 corresponding to complementary wavy portion of component 375. The wavy portion of component 375 may further include a webbed portion 379 to slip under lobe 377 to help position component 375 correctly and hold it in place. One insight of the invention is that coupling lines in conformations other than straight may provide unexpected benefits in terms of durability, ease of assembly, sound tuning, among other things. More will be said about non-straight coupling seams below.

Assembled club head 390 may be fastened together for playing by any suitable mechanism. In certain embodiments, club head 390 takes advantage of an interchangeable or repositionable shaft that may, for example, also provide other functionality to a golf club (such as multiple loft angles or different shaft lengths). Interchangeable and repositionable shafts are discussed elsewhere herein. In certain embodiments, a shaft with a fixed ferrule is inserted into the hosel of component 375. Club head body 371 has a bore, or hole, for a shaft sleeve screw in the heel region of the sole. A shaft sleeve screw extends through the club head and threads into an end of the shaft. When the shaft sleeve screw is tightened, a compressive force is exerted between the fixed ferrule and the screw head/washer, thereby firmly gripping component 375 to club head body 371. Other mechanisms for coupling the shaft and ferrule to body 371, thereby holding component 375 in place, may include a bayonet mounting mechanism with J-shaped slots (see, e.g., U.S. Pub. 2010/0261543, the contents of which are hereby incorporated by reference in their entirety for all purposes), a threaded portion in hosel recess 383 corresponding to a threaded member on the shaft (see, e.g., U.S. Pat. No. 7,819,754, the contents of which are hereby incorporated by reference in their entirety for all purposes), or other methods known in the art. Mechanisms for golf clubs suitable for operation with the invention, are discussed in U.S. Pub. 2010/0041493; U.S. Pub. 2011/0098128; U.S. Pat. Nos. 8,057,323, 1,879,117 and 3,096,982, incorporated by reference herein in their entirety.

As discussed above, in certain embodiments, a component mates with a club head body or with another component via a non-straight seam line (e.g., not a straight line when viewed along a surface of an assembled club head). FIGS. 75A-75C and FIG. 76 show embodiments including non-straight seams. In some embodiments, coupling seams include wavy lines. Wavy can include, for example, lines that—when projected onto a surface—have at least three inflection points that can be connected by an arc. Wavy can include lines or edges that may generally be described as lobed, scalloped, or wavy.

One insight of the invention is that a golf company may desire to provide a family of similar, but not identical, club heads, each having a separable component. For example, a golf company may provide two drivers having the same model name, wherein one is a few cubic cm larger than the other (e.g., men's and women's models). Each club head can be provided with a separable component that has a functionally similar coupling mechanism and occupies a similar portion of an assembled club head. To avoid golfer confusion, different clubs can be provided with distinct wavy line patterns in the coupling seams. For example, the 455 cubic cm driver may have a wavy assembly seam line with three lobes on the club head body that interlock with two lobes on the separable component, whereas a 425 cubic cm driver may have a "tight wave" assembly seam line with seven lobes on the club head body that interlock with six lobes on the component. Through this mechanism, the separated components will each have a distinct appearance such that a golfer can easily reach for and pick up only the appropriate one when assembling a golf club.

For example, according to this example, a golfer who owns the 425 cubic cm model could enter a pro-shop seeking to purchase a newly-released component with some attractive feature (such as a translucent material in the component that reveals a digital LED screen of an electronic component within the club head). Knowing that their club head included the seven-lobed edge, the golfer—when looking at the components in the display case—can easily focus their attention on only those that fit with their club head.

Moreover, it is an insight of the invention that wavy lines may provide functional and structural advantages. For example, when coupling a component to a club head body (e.g., outdoors in the elements), it may be easier to achieve a proper fitting (i.e., easier to "seat" the part in place) if the wavy edges guide the component into the proper seating.

Further, the stability of the coupling of multi-components may be limited by degrees of freedom of relative motion between the two components. For example, when a cross sectional-profile of a component is curved (see, e.g., component 26 in FIG. 19), coupling the component to the club head body may leave open certain degrees of freedom (e.g., lateral translation in a front-back direction of the component relative to the club head). Providing a wavy coupling seam as shown in FIG. 75A can remove a degree of freedom of relative translation, thereby increasing the security of the coupling of the multiple club head components.

Beyond aiding a golfer in seating a component, and removing degrees of freedom to prevent uncoupling, a wavy seam may provide mating contact lines and surfaces that are oriented desirably relative to a direction of propagation of an impact-associated wave of compression energy. When a club head strikes a ball with force, energy may be transferred through the club head as compression waves that propagate through the materials. Where the waves encounter boundaries between separate components, they may reflect or refract in an undesired fashion if the wave-boundary intersection defines solely and only one certain angle (e.g., less than 45°). For example, given that driver heads may have shapes that have been optimized by generations of engineering design, placing a coupling seam between two components along a substantial portion of the driver head may interfere with impact wave propagation in ways that adversely affect the playability of a club, for example, diminishing its coefficient of restitution, contributing to rapid materials fatigue, or causing very uncomfortable transmissions of vibrations to a golfer's arms. Providing wavy boundaries may tend to preserve the existing, optimized energy propagation characteristics of a club head with multi-component construction.

Figure 76:
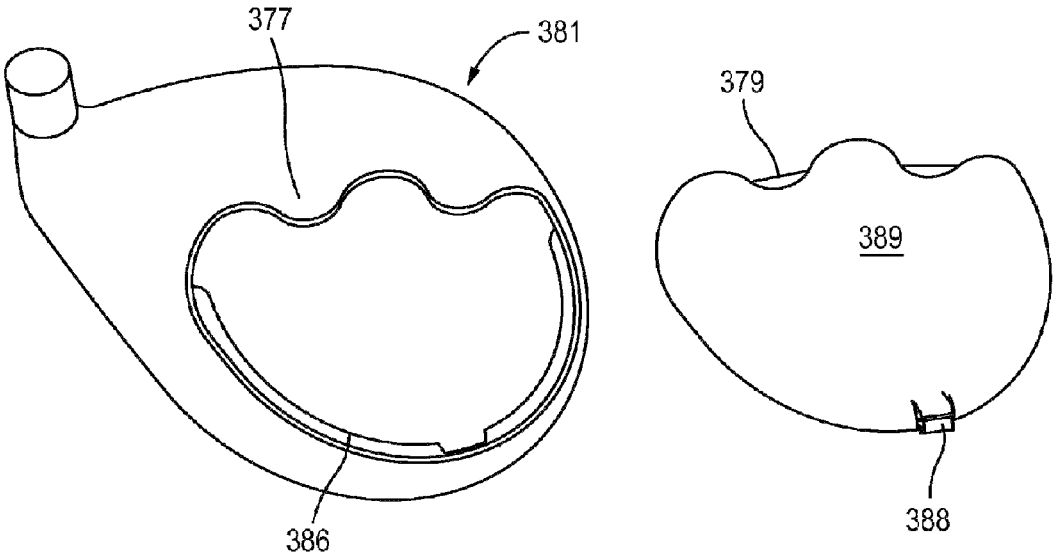
FIG. 76 shows a club head with crown component.

FIG. 76 shows a club head with multi-component construction in which a boundary seam between component 389 and club head body 381 is wavy. Club head body 381 includes a cutaway void space dimensioned to receive component 389. The void space may bear one or more of support flange 386 spaced around the perimeter. The wavy edge generally defines a series of lobe 377. Component 389 may be provided with webbed portion 379 corresponding to lobe 377 and fitted to extend under an edge of lobe 377, holding component 389 in its proper place in an assembled club head. As shown in FIG. 76, component 389 includes a snap-fit mechanism 388 for removably coupling the component to the club head.

Figure 77:
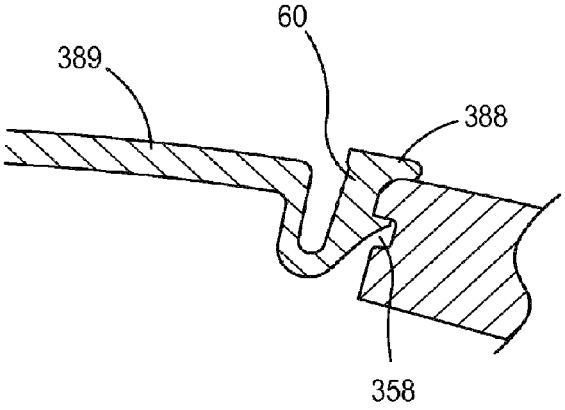
FIG. 77 shows a snap-fit catch for a component.

FIG. 77 shows a cross-sectional view of snap-fit mechanism 388. Cantilever 60 includes a protrusion that can mate with slot 358. In certain embodiments, a portion of cantilever 600 can be manually manipulated from the outside of an assembled club head to release component 389 from club head body 381.

In some aspects, the invention provides a club head with multi-component construction in which a component includes a malleable material such as rubber.

Figure 78:
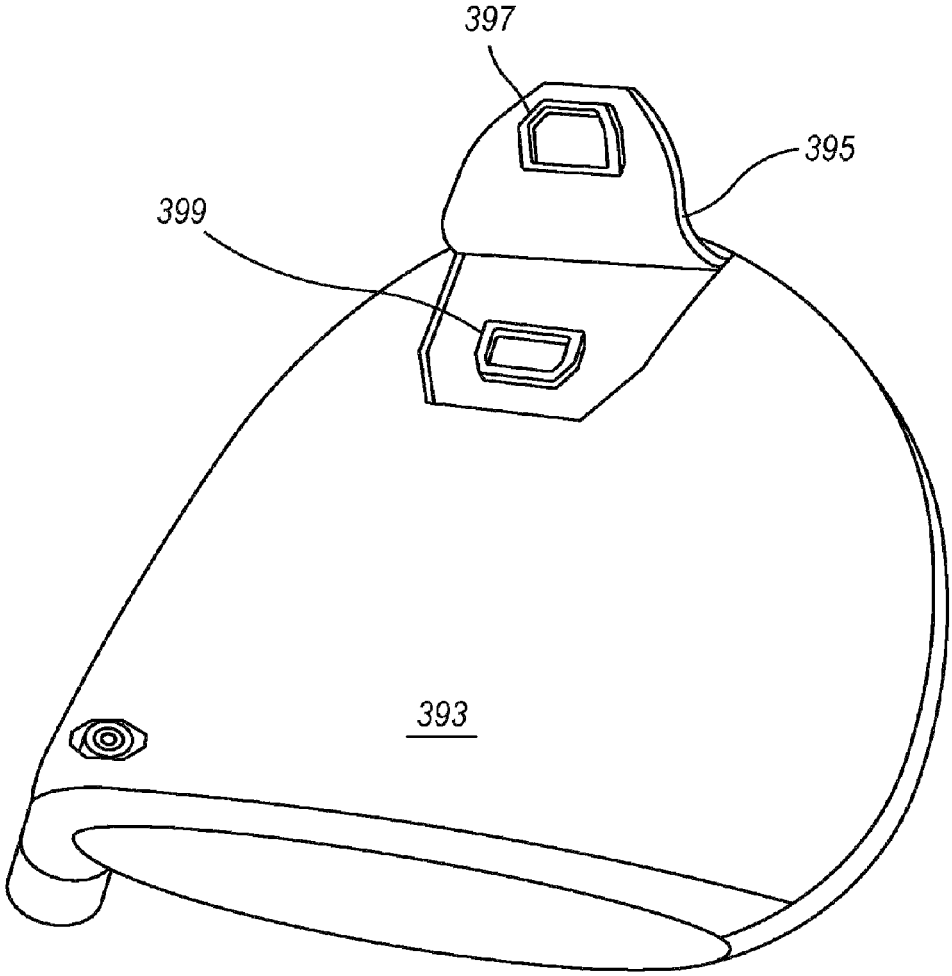
FIG. 78 shows a club head with a flap component.

FIG. 78 shows a club head 393 with a malleable component 395 capable of being pulled away from the club head by a peeling, or folding-back action. In some embodiments, as shown in FIG. 78, one edge of a malleable component is permanently fixed the club head (e.g., through cement, or rivets, or similar suitable attachment mechanism). In other embodiments, malleable component 395 is fully removable from club head 393 (e.g., for replacement/interchangeability with another component).

As shown in FIG. 78, malleable component 395 includes a gasket ring 397. Club head 399 bears a corresponding boss portion 399. In some embodiments as shown in FIG. 78, boss portion 399 is rigid (e.g., plastic, metal, or composite) and dimensioned to be pressed into an internal space of gasket ring 397. The pressure between gasket ring 397 and boss portion 399 creates a press-fit that holds component 395 to club head 393 during play. Boss portion 399 can provide functionality to the club head. For example, in certain embodiments, boss portion 399 surrounds a feature such as an opening into the club head, a weight-mounting port, or a mini-USB port. An opening can be provided that allows a golfer to insert a tool into the club head to interact with some other feature within the club head, such as, for example, a tunable mass-distribution mechanism or an assembly tool similar to the one depicted in FIG. 46.

Figure 79A:
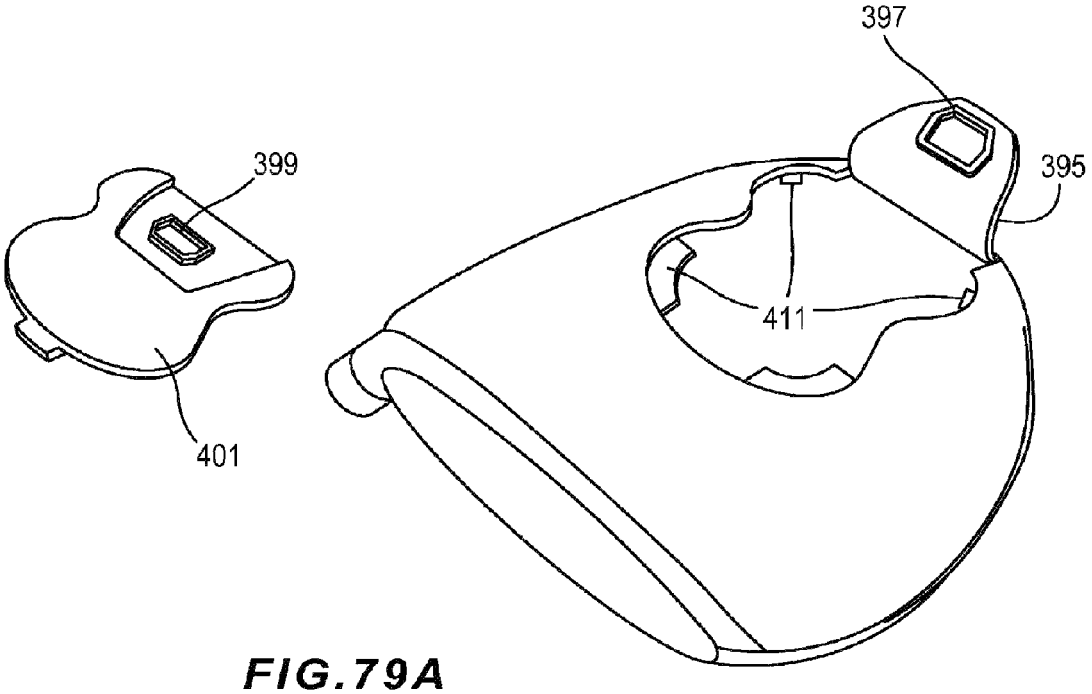
FIGS. 79A and 79B show use of a flap component to fasten a club head component.
Figure 79B:
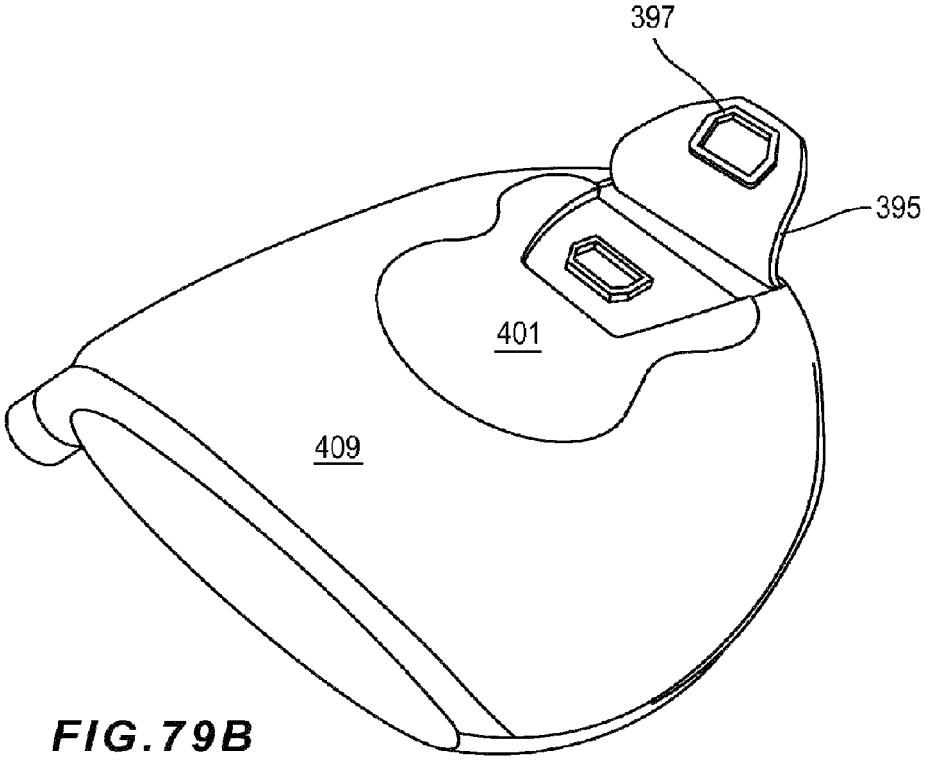

FIGS. 79A and 79B show use of a flap component to fasten a separable component to club head body. As shown in FIG. 79A, club head body 409 includes a cutaway void space dimensioned to receive insert 401. The perimeter of the void space includes one or a number of mounting flanges 411 that can hold insert 401 in place. Further, a portion of insert 401 may include one or number of mounting tabs dimensioned to slip under an edge of the perimeter of the void space. Insert 401 includes a boss portion 399 dimensioned to mate with gasket ring 397 on malleable component 395.

As shown in FIG. 78B, insert 401 can be positioned in the cutaway space of club head 409. Then, malleable component 395 can be used to fasten insert 401 in place, for example, through the use of a press fit between gasket ring 397 and boss portion 399. While insert 401 is here shown as having a wavy perimeter edge to mate with a corresponding wavy edge of the perimeter of the cutaway void in club head 409, this is just one illustrated embodiment. Insert 401 can have any suitable shape including, for example, a rectangle (e.g., to cover a compartment for two AA or AAA batteries), circular (e.g., to cover a screw or weight port), or irregular (e.g., to provide access to some interior mechanism or mass-distribution assembly).

Use of one component to aid in connecting another component allows for benefits in design and manufacturing that may not otherwise be available to club head designers. For example, when an assembled club head includes a separable component joined to the club head body (or another component) along an attachment perimeter, if a portion of the attachment perimeter is covered (for example, by a flexible flap 395), that portion may be manufactured to less precise manufacturing tolerances than if it were uncovered in an assembled, playable club head.

To illustrate, FIG. 78B shows insert component 401 assembled to club head body 409. An aft edge of insert 401, as shown, does not meet and mate with the perimeter of the cutaway void space in club head body 409. However, when flexible flap 395 is pushed into place, no gap between insert 401 and club head body 409 will appear under visual inspection. Accordingly, in certain embodiments, the invention provides a club head having a club head body and a separable insert in which an outer perimeter of the insert and an inner perimeter of a cutaway space in the body define an attachment perimeter. When the insert is coupled to the body, they make contact along a portion of the attachment perimeter and they are optionally spaced away from one another along a portion of the attachment perimeter. Another component of the club head is provided to cover the spaced away portion of the attachment perimeter such that, when the club head is fully assembled, no gaps are visible from the outside of the club head. This allows club head body 409 to be designed and manufactured with a cutaway provided to receive an insert. Then, insert 401 can be designed or manufactured with less stringent attention given to the fit along a portion of the insert, which may allow manufacturing to be faster or less expensive.

In some aspects, the invention provides a component for a club head that forms an assembled, playable club head through the use of magnets.

Figure 80:
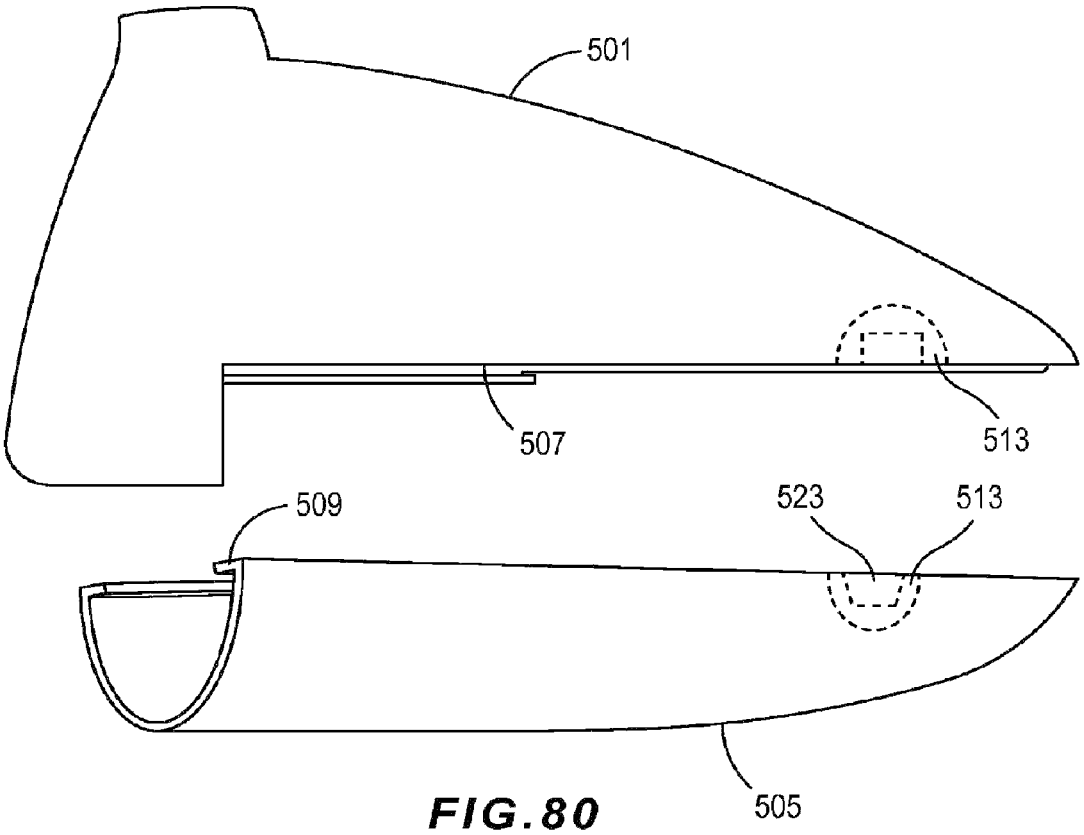
FIG. 80 shows a club head with removable sole component with magnets.

FIG. 80 shows a club head body 501 having a cutaway portion with a protruding flange defining slot 507. A separable sole member 505 has protruding tabs 509 dimensioned to slide into slot 507 to form an assembled club head. Each of club head body 501 and sole member 505 have one or more of boss 513, shown here on an inside surface, holding at least one magnet 523. Any magnet may be used in the invention. In some embodiments, a high-strength magnet such as a rare earth magnet is used (e.g., magnets including neodymium or samarium-cobalt). Magnet 523 can be press-fit into boss 519, held in place by adhesives, threaded in, or held in place by any other suitable method (including, for example, being embedded in plies of pre-peg using, for example, manufacturing methods as discussed in U.S. Pat. No. 6,695,608 the contents of which are hereby incorporated by reference in their entirety for all purposes). Further, magnets may be employed to fix a mass element in place, such as a mass ring as disclosed in U.S. Pub. 2011/0081986, the contents of which are incorporated by reference herein in their entirety for all purposes.

Figure 81:
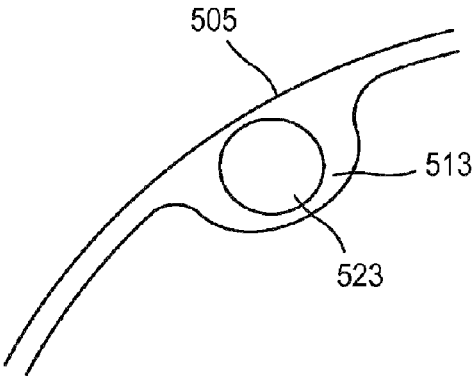
FIG. 81 is a top view of a boss member with magnet therein.

FIG. 81 is a top-down view of boss member 513 with magnet 523 therein. As can be seen from FIG. 81, boss 513 can be positioned to expose a surface of a magnet for interaction with another magnetic material.

Figure 82:
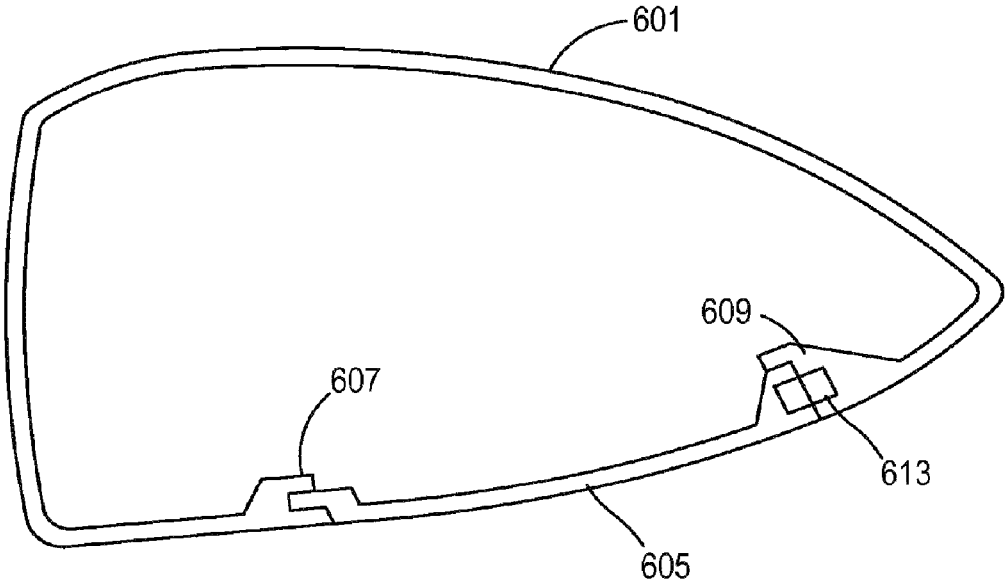
FIG. 82 is a cross-sectional view of a set of magnet bosses.

FIG. 82 shows another embodiment of the invention using magnets to fasten a component to a club head. Here, insert panel 605 is hooked into club head body 601 via a flange on insert panel 605 received by slot 607. Distal to the flange is a mating surface presented by magnet-including bosses on insert 605 and club head body 601. Looking, for example, at club head body 601, a boss portion 609 extends upwards and includes magnet 613 mounted therein (for example, by one of the methods mentioned above).

Magnetized coupling points can be positioned at any suitable location on a club head. In certain embodiments, separable components are designed to be held in place through the use of magnets that, when on an assembled club head, are located so as to optimize mass distribution (e.g., to increase MOI around a center of percussion on a strike face or to lower a center of gravity).

Figure 83:
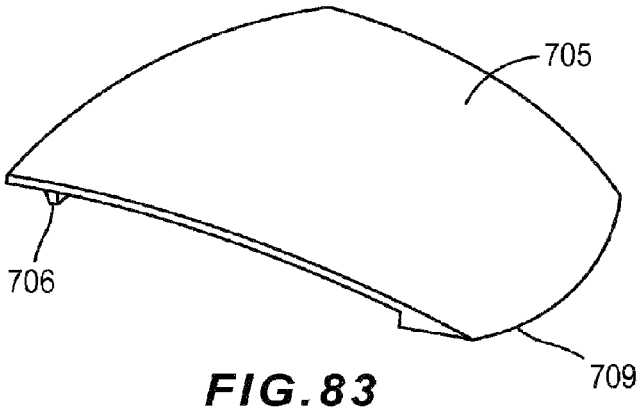
FIG. 83 shows an insert panel.
Figure 84:
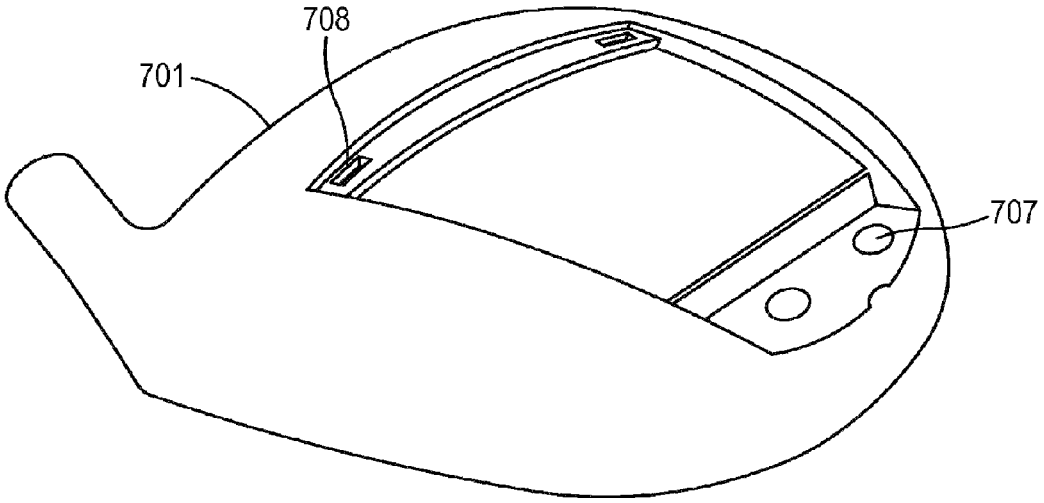
FIG. 84 shows a club head body.
Figure 85:
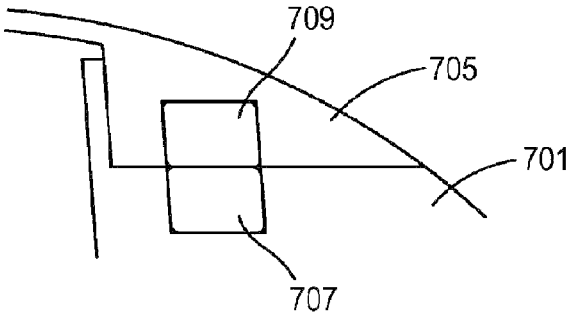
FIG. 85 shows magnets coupling an insert to a club head body.

FIGS. 83-85 illustrate another embodiment using magnets to couple an insert to a club head body. Here, insert 705 is coupled to club head body 701 through one or more of protruding post 706 dimensioned to be received by corresponding slot 708. An aft end of inert 705 includes one or more of magnet 709 (not visible in FIG. 83) exposed on an underside thereof. Club head body 701 further includes one or more of magnet 707.

FIG. 85 is a face-aft cross sectional view through magnetic coupling mechanism of insert 705 and club head body 701. Magnet 709 in insert 705 matches up to magnet 707 in club head body 701, thereby fastening the club together for playing golf.

In certain aspects and embodiments, the invention provides club with inserts and components that connect via one or more flanges or seams.

Figure 86:
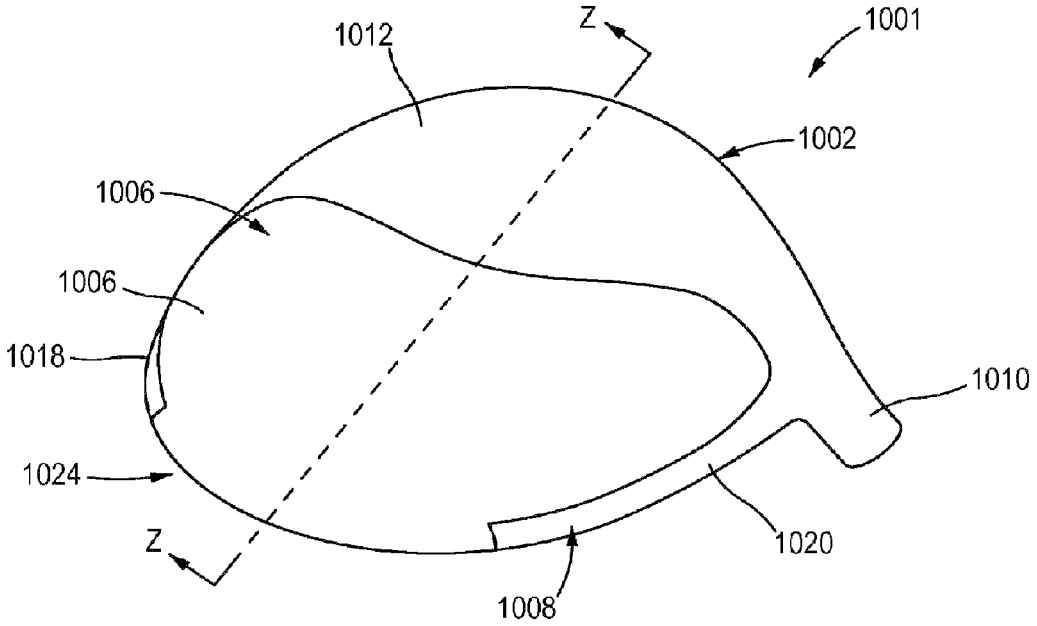
FIG. 86 is a perspective view of a golf club head of the present invention.

FIG. 86 shows a club head 1001 that includes a ball-striking face 1002, a crown 1004, a sole 1006, a skirt 1008 that extends between crown 1004 and sole 1006, and a hosel 1010. Golf club head 1001 is generally constructed from a body member 1012, a crown member 1014, and a sole member 1016. In the present embodiment, crown 1004, sole 1006 and skirt 1008 each include a multi-material construction.

Figure 87:
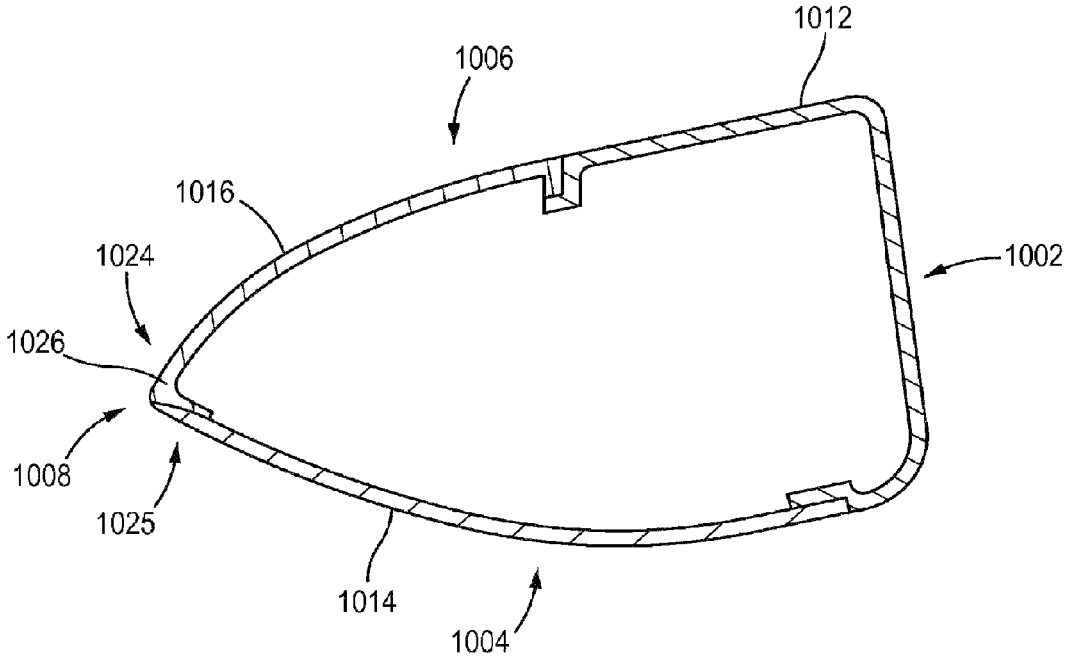
FIG. 87 is a cross-sectional view, taken along line 2-2, of the golf club head of FIG. 86.

FIG. 87 illustrates certain embodiments in which a portion of crown 1004 is constructed from body member 1012 and another portion is constructed from crown member 1014. A portion of sole 1006 is constructed from body member 1012 and another portion is constructed from sole member 1016. Furthermore, a portion of skirt 1008 is constructed from body member 1012 and another portion of skirt 1008 is constructed from sole member.

Body member 1012 includes a crown portion 1023 that forms a forward portion of crown 1004, a sole portion 1022 that forms a forward portion of sole 1006, a skirt portion that forms either a discontinuous, or continuous, portion of skirt 1008, and at least a peripheral portion of face 1002 of golf club head 1001. The crown portion is adjacent face 1002 and extends aft-ward from face 1002 and generally extends laterally from a toe side of the golf club head to a heel side of the golf club head and adjacent hosel 1010. The fore-aft length of each of the crown portion and the sole portion of body member 1012 may be any selected length, but is preferably in a range of about 0.100 inch to about 3.00 inches. The length of sole portion extending from face 1002 may be selected so that a desired ground contact location, when the club is in an address position, is located on the sole portion. The length may also be selected so that the center of gravity of golf club head 1001 is located vertically above the sole portion when the club is in an address position.

Sole portion 1022 and skirt portion 1018, 1020 of body member 1012 provide mounting features for attaching sole member 1016 to body member 1012. The mounting features may be any feature that provides structure for attaching a portion of sole member 1016 to body member 1012 such as an attachment flange or cavity. In the illustrated embodiment, body member 1012 includes an attachment flange having portions with different configurations for attaching sole member. In particular, the attachment flange is configured so that sole member 1016 is coupled to body member 1012 with both a lap joint and a butt joint over portions of the attachment.

Crown portion 1023 and skirt portion 1018, 1020 of body member 1012 provide mounting features for attaching crown member 1014 to body member 1012. The mounting features may be any feature that provides structure for attaching a portion of crown member 1014 to body member 1012. As shown, a peripheral portion of crown member 1014 overlaps and is coupled to body member 1012 with a lap joint. Body member 1012 and crown member 1014 may be coupled using any attachment method suitable for the selected materials, such as adhesive bonding, ultrasonic welding, welding, brazing, soldering, etc.

FIG. 86 illustrates certain embodiment in which body member 1012 includes a discontinuous skirt portion that includes a toe portion 1018 and a heel portion 20 that do not meet at an aft portion of the golf club head. As a result, body member 1012 includes a gap in the skirt portion that is located at an aft portion of body member 1012. Skirt 1008 in the completed golf club head 1001, however, is continuous because a portion of sole member 1016 is inserted into the gap and forms a portion of skirt 1008. It should be appreciated that the skirt portions may be configured so that gap is located at any portion of skirt 1008. For example, the gap may be located heel-ward, toe-ward or at-ward on skirt 1008.

FIG. 87 is a cross-sectional view of club head 1001, showing that sole member 1016 is coupled to sole portion 1022 and the heel and toe skirt portions 1018, 1020 of body 1012. An aft portion 1024 of sole member 1016 includes a flange 1026 that provides an attachment feature for an aft portion of crown member 1014 and additional reinforcement to that portion of the skit. In the present embodiment, flange 1026 extends between toe skirt portion 1018 and heel skirt portion 1020 of body member 1012 to form a continuous skirt 1008. It should be appreciated that an insert may be co-molded, bonded or inserted into flange 1026 to provide additional strength and/or stiffness.

The structure of golf club head 1001 provides manufacturing advantages over many previous multi-material constructions. Because only a portion of skirt 1008 is formed from body member 1012, the manufacturing method of golf club head 1001 creates less waste.

Figure 88:
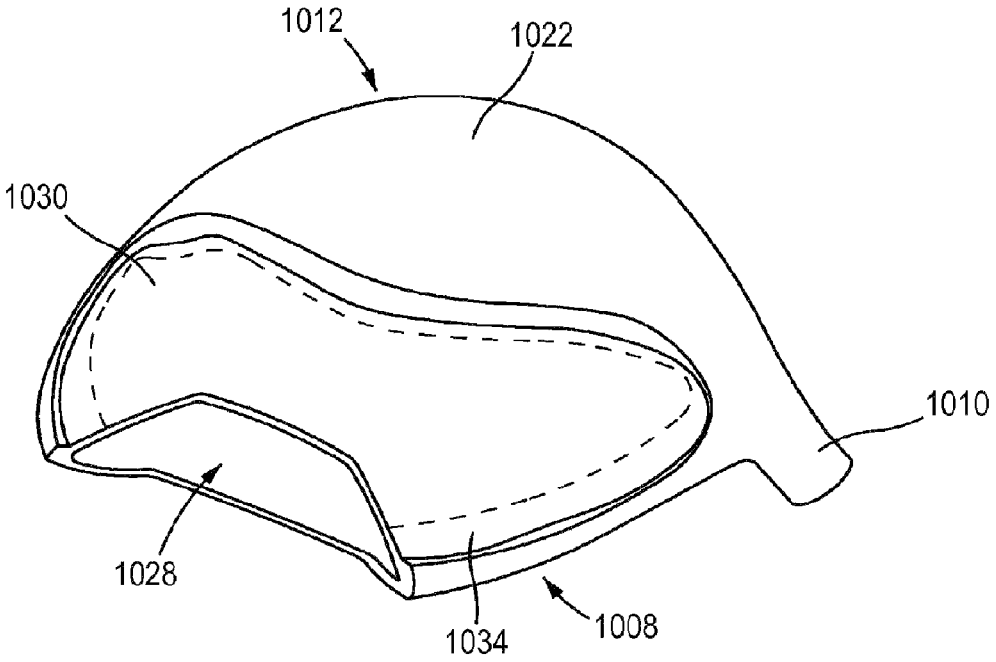
FIG. 88 is a perspective view of an embodiment of a body member of the golf club head of FIG. 86.

FIG. 88 illustrates a step in a method of constructing body member 1012 and golf club head 1001. Body member 1012 is constructed as a monolithic structure. Preferably, body member 1012 is constructed from a metallic material such as titanium, magnesium, steel, etc. such as by casting. Body member 1012 may alternatively be constructed from a non-metallic material, such as a fiber reinforced plastic or a thermoset plastic by molding. Additionally, the construction allows the mass to be distributed more easily to manipulate the center of gravity and the moment of inertia of golf club head 1001.

Body member 1012 is initially constructed with a discontinuous skirt 1008 and crown and sole portions with greater surface area than the final configuration. The crown and sole portions include a sole support 1030 and a crown support 1032, as shown by dotted line in FIGS. 88 and 89, which are recessed at the at end of the body member to create a gap in the skirt such that the body member includes an opening 1028. Sole support 1030 and crown support 1032 are formed during the initial formation of body member 1012 and extend across body member 1012 so that toe skirt portion 1018 and heel skirt portion 20 are supported during the formation of body member 1012. The support portions provide structural support to the skirt portions rather than forming them as cantilevered members relative to the remainder of body member 1012. As a result, the support portions prevent dimensional changes of the body member and improve the flow of material during the forming process.

A portion of each of the sole support 1030 and the crown support 1032 extend to the extremities of toe skirt portions 1018 and heel skirt portion 1020. The angle of intersection of a respective extremity and support portion is predetermined to provide sufficient support to the skirt portion during manufacturing.

Figure 89:
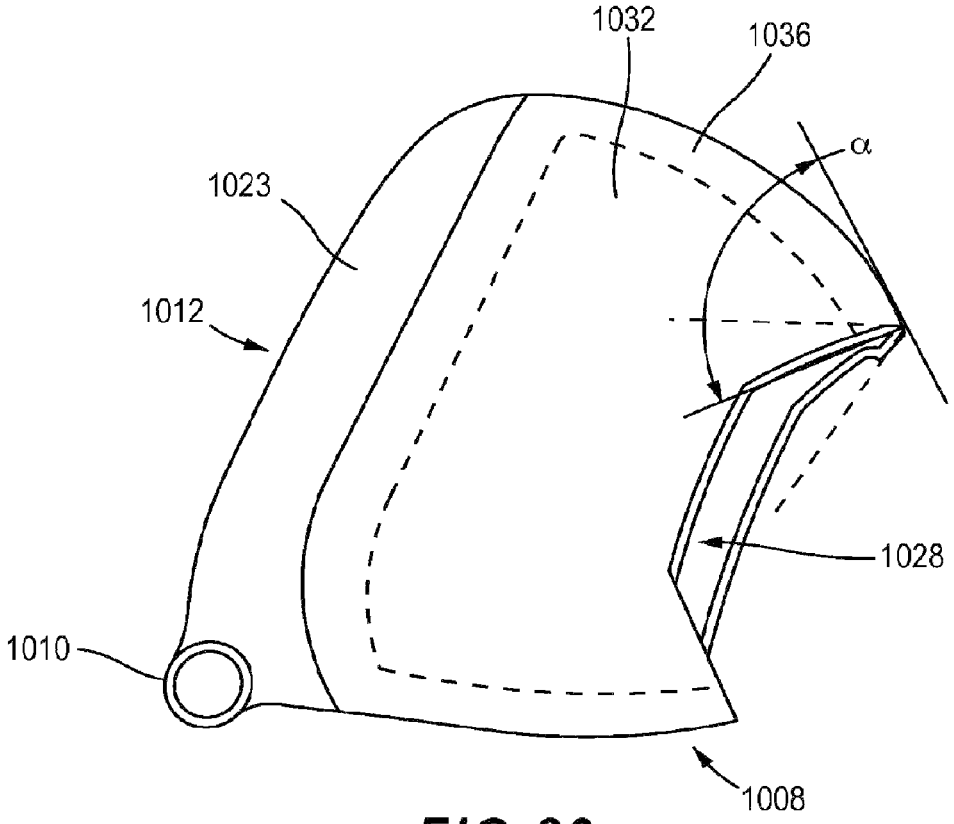
FIG. 89 is a top view of the body member of FIG. 88.

FIG. 89 illustrates an angle $\alpha$ at which crown/sole supports intersect a tangent to the skirt. After body member 1012 is formed sole support 1030 and crown support 1032 are removed and discarded. Sole support 1030 and crown support 1032 may be removed by any known method, such as milling, laser or plasma cutting, water jetting, etc. Sole support 1030 and crown support 1032 are cut so that a sole flange 1034 and a crown flange 1036 remain part of body member 1012. The sizes of sole support 1030 and crown support 1032 are preferably minimized to reduce the amount of material that is discarded while providing adequate support to the heel and toe skirt portions to resist bending and twisting during manufacture. Preferably, each of the sole support 1030 and the crown support 1032 and a tangent to the skirt 1008 intersect at an angle $\alpha$ of about 30° to about 120°, and more preferably the support and the skirt intersect at an angle of about 50° to about 100°, more preferably at an angle of about 70° to about 90°.

The remaining portion of skirt 1008 has an outer surface having a generally parabolic shape in cross-section having an apex that lies on an outer most edge of the club head. Preferably, the crown and sole flanges extend for a distance of between about 0.10 inch to about 0.5 inch inward from the outer most edge of the club head. The crown and sole portions may also include a step, or shoulder at an intermediate location.

After sole support 1030 and crown support 1032 are removed, sole member 1016 is coupled to sole flange 1034 of body member 1012 to form a complete sole. Furthermore, the at portion 1024 of sole member 1016 provides a structure for attachment of an aft portion 1025 of crown member 1014. In the present embodiment, aft portion 1024 of sole member 1016 includes a skirt structure and a flange 1038 that completes the discontinuity in crown flange 1036 and skirt 1008. Crown member 1014 is coupled to crown flange 1036 and aft portion 1024 of sole member 1016 to complete crown 1004 of golf club head 1001.

Figure 90:
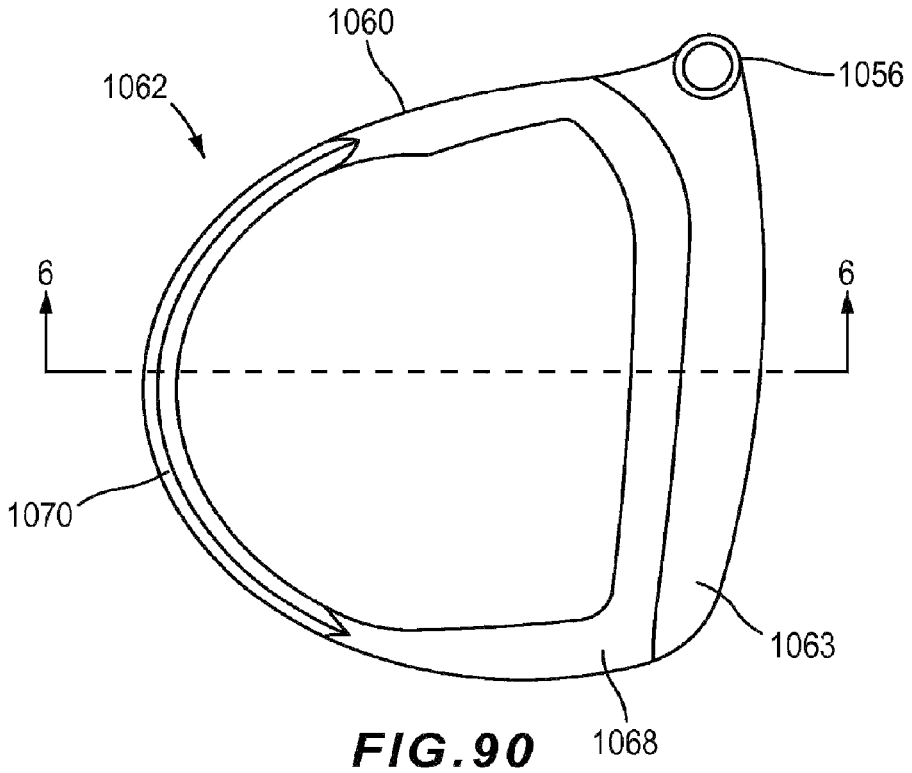
FIG. 90 is a top view of a body member included in another embodiment of a golf club head of the present invention.
Figure 91:
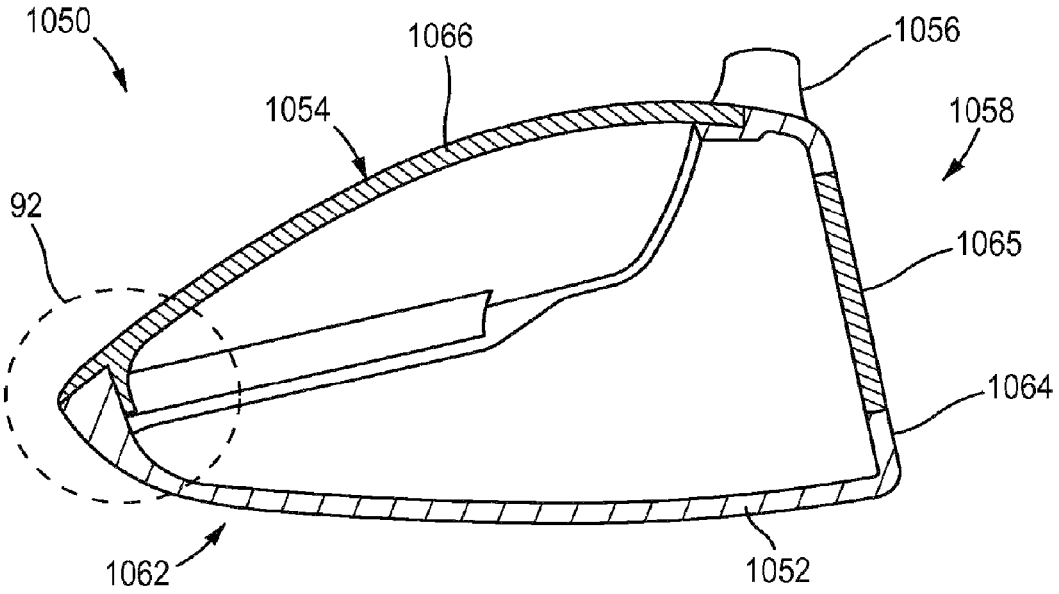
FIG. 91 is a cross-sectional view of a golf club head, taken along a plane generally corresponding to line 6-6 of FIG. 90.
Figure 92:
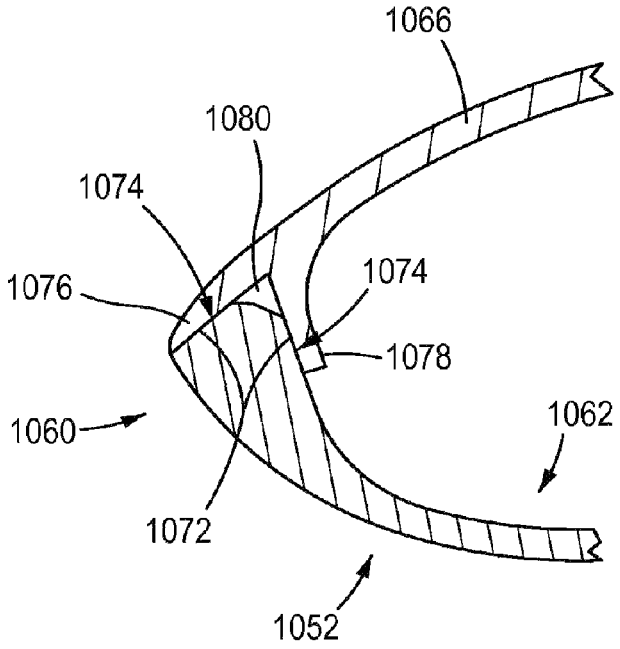
FIG. 92 is a partial cross-sectional view of detail A, shown in FIG. 90.

Referring to FIGS. 90-92, another embodiment including an alternative attachment structure for a sole and/or crown member will be described. Golf club head 1050 generally includes a sole 1052, a crown 1054, a hosel 1056, a ball-striking face 1058 and a skirt 1060. A body member 1062 is constructed to include sole 1052, a crown portion 1063, hosel 1056, a face portion 1064 and skirt 1060 as integral parts thereof. In particular, body member 1062 is generally formed as a monolithic body, such as by casting a metallic material, and includes a crown opening that extends over a portion of crown 1054 and a face opening that extends through ball-striking face 1058. A face insert 1065 is inserted into the face opening and is preferably suspended across the opening. Face insert 1065 may provide any portion of ball-striking face 58 and may be constructed with a constant thickness or with portions having different thicknesses.

The crown opening is covered by a crown member 1066 which is attached to body member 1062. Preferably, crown member 1066 is suspended across the crown opening and the perimeter of crown member 1066 is attached to body member 1062. Where components are attached at or around a perimeter, the attachment need not be continuous and multiple attachment geometries or mechanisms may be employed along a perimeter.

FIG. 90 illustrates an attachment flanges with multiple portions. Crown member 1066 is attached to attachment features that are formed on crown portion 1063 and skirt 1060 of body member 1062. The attachment feature includes a first flange portion 1068 and a second flange portion 1070. First flange portion 1068 includes a single faceted portion that provides a bonding surface for crown member 1066 to crown portion 1063 and a portion of skirt 1060. Second flange portion 1070 includes a multi-faceted portion that provides multiple bonding surfaces for crown member 1066 on a portion of skirt 1060. In the present embodiment, first flange portion 1068 extends around a forward portion of the perimeter of the crown opening and second flange portion 1070 extends around an aft portion of the perimeter of the crown opening.

First flange portion 1068 provides a single faceted attachment feature that extends along a forward edge of the crown opening and along forward portions of skirt 1060 on both the heel side and toe side of the golf club head. The first flange portion 1068 is joined with crown member 1066 by a single lap joint configuration. In particular, the corresponding portion of crown member 1066 includes a single wall that overlaps and is coupled to first flange portion 1068.

Second flange portion 1070 provides a multi-faceted attachment feature that extends along an aft portion of skirt 1060. By constructing a portion of skirt with a multi-faceted attachment feature, the mass of skirt 1060 may be more efficiently located by creating a compact mass in the skirt while providing sufficient bonding surface area for the crown member. Additionally, the attachment feature allows more precise location of crown member 1066 during manufacture because the interaction between the multi-faceted feature of skirt 1060 and crown member 1066 are self-locating.

FIG. 91 shows a cross-sectional view of club head 1050 along line 6-6 in FIG. 90. As shown in area "A", an aft portion of crown member 1066 includes a multi-faceted, or non-planar, attachment feature that complements the attachment feature of body member 1062.

FIG. 92 is a detail view of area "A" from FIG. 91, showing an aft portion of crown member 1066 including a pair of attachment surfaces 1072 that are angled relative to each other and that complement a pair of attachment surfaces 1074 included on the skirt. In the present embodiment, attachment surfaces 1072 of crown member 1066 are formed on a pair of at flanges 1076, 1078. A first at flange 1076 forms a portion of the outer surface of crown member 1066 which has a continuous curved outer contour. A second flange 1078 branches away from first at flange 1076 toward the internal cavity of the golf club head so that the two flanges are angled relative to each other and are configured for attachment to the multi-faceted skirt 1060. It should also be appreciated that the flanges may create a continuous curved mounting surface that interfaces a curved mounting surface of the skirt.

The angle between flanges 1076, 1078 is selected to match the particular configuration of the skirt and the desired method of attachment. For example, the draft angle of the attachment surfaces of the skirt and the manufacturing tolerances of the crown member are considered. Additionally, the method of attaching the crown member is considered such as if, during attachment of the crown member, the entire periphery of the crown member contacts the body member at the same time or if a portion of the crown member is contacted and the remainder is rotated into position. In one method, the portion of the crown member closest to the face of the golf club is installed and the crown member is rotated so that the aft portion comes in contact with the body member However, the angle is generally between about 40° and about 140°, more preferably between about 60° and about 120°, and even more preferably between about 80° and about 100°.

Second flange 1070 of skirt 1060 and aft flanges 1076, 1078 are dimensioned so that a cavity 1080 is formed between crown member 1066 and skirt 1060 after assembly of the golf club head. Cavity 1080 is provided so that in embodiments utilizing adhesive to couple crown member 1066 to body member 1062, the adhesive may flow away from the contact surfaces of the flanges and the skirt and toward the intersection of at flanges 1076, 1078. In other embodiments, a compressible gasket may be inserted into cavity 1080 to provide a more forgiving it during construction. In still further embodiments, the cavity may be omitted.

Figure 93:
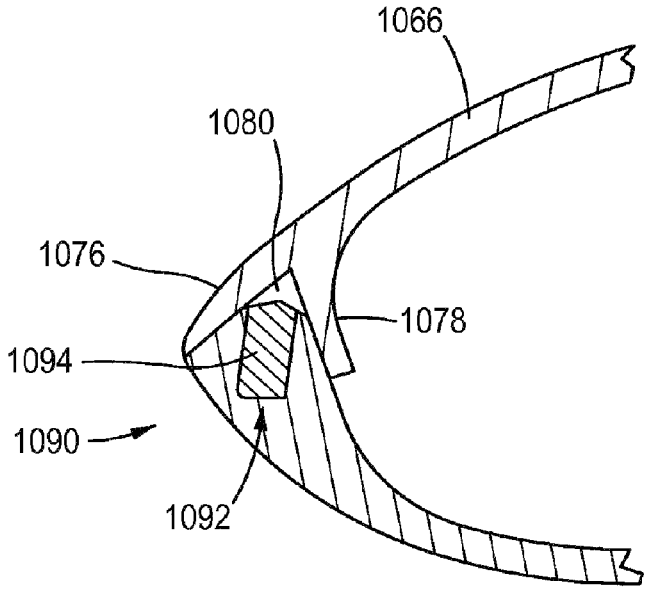
FIG. 93 is another partial cross-sectional view of detail A, shown in FIG. 90.

FIG. 93 gives a detailed view of an alternative embodiment of skirt 1060. In the embodiment, the construction of the crown member is identical to that described above and the skirt has been modified. In particular, skirt 1090 includes a cavity 1092. Cavity 1092 is configured to receive one or more inserts 1094, but may be left empty if desired. In embodiments utilizing a plurality of inserts 1094, the inserts may be provided with different masses to alter the weight distribution, such as by adding more weight heel-ward or toe-ward. Insert 94 may be constructed to do one or all of the following: to alter the mass of skirt 1090, to provide damping or sound-tuning and/or to provide strength or stiffness to skirt 1090. For example, insert 94 may be constructed from a material that has a density, stiffness, and/or strength that is different than the material of skirt 1090 or insert 1094 may be constructed from a material that has desired dampening properties. Insert 1094 may be constructed from metallic materials such as aluminum, magnesium, titanium, tungsten, and alloys thereof, or it may be constructed from non-metallic materials, such as polyurethane, tungsten loaded urethanes.

Figure 94:
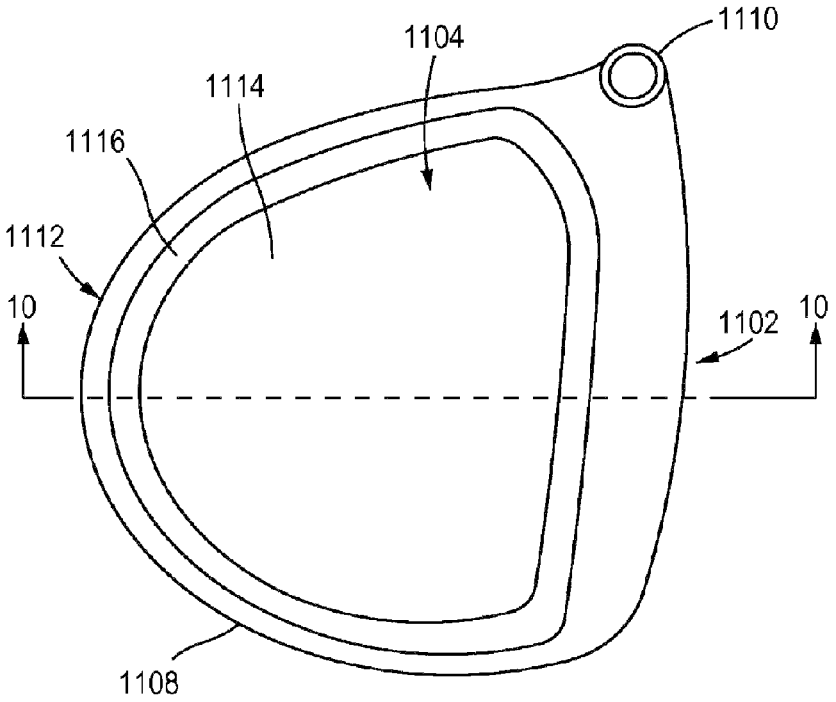
FIG. 94 is a top view of another embodiment of a golf club head of the present invention.
Figure 95:
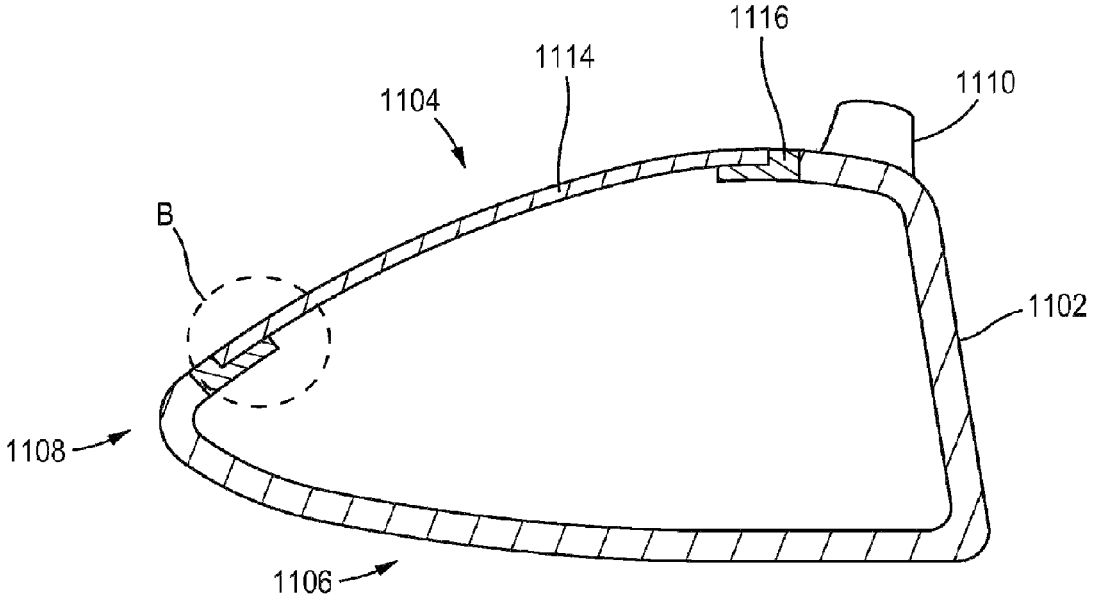
FIG. 95 is a cross-sectional view, taken along line 10-10, of the golf club head of FIG. 94.
Figure 96:
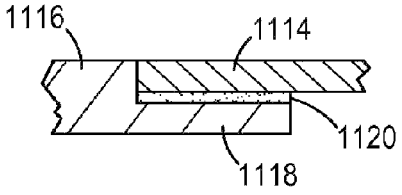
FIGS. 96-102 are partial cross-sectional views of alternative embodiments of detail B, shown in FIG. 95.

Referring now to FIGS. 94-96, another embodiment of a golf club head having an improved structure will be described.

FIG. 94 shows a golf club head with a ball-striking face 1102, a crown 1104, a sole 1106, a skirt 1108 that extends between crown 1104 and sole 1106, and a hosel 1110. In the present embodiment, crown 1104 includes a multi-material construction and includes a body member 1112, a coupling member 1116, and a crown member 1114. Body member 1112 includes an opening in the crown that receives crown member 114.

FIG. 95 is a cross-sectional view of the club head in FIG. 94, showing assembly and construction details. Crown member 1114 is coupled to body member 1112 through coupling member 1116. Coupling member 1116 is included and constructed to simplify the manufacturing process required to couple crown member 1114 to body member 1112, especially when a non-metallic crown member 1114 is coupled to a metallic body member 1112. For example, a composite crown member 1114 may be coupled to coupling member 1116, such as by adhesive bonding, and excess adhesive may be removed before the combined crown member 1114 and coupling member 1116 is secured to body member 1112. As a result, excess adhesive that would otherwise add additional weight to the assembled golf club may be removed. Additionally, a more difficult coupling process and/or configuration may be utilized to couple crown member 1114 and coupling member 1116 when the two are separate from body member 1112, where they may be worked on and manipulated more easily. Alternatively, coupling member 1116 and crown member may be co-molded.

Preferably, the material of coupling member 1116 is selected to provide improved bonding strength between it and the material of body member 1112 so that the overlapping bonding surfaces can be minimized to avoid adding unnecessary mass and to improve the integrity of the joint. For example, when a metallic body member 1112 and a generally non-metallic crown member 1114 are coupled, the crown member preferably includes a multi-material construction so at least the bonding portion provides a material high surface free energy because non-metal materials generally do not have very high surface free energy. For example, material having high surface energy, such as a metallic material like metallic mesh, may be added to the crown member to improve the efficiency of the bond. For example, including titanium mesh in a portion of the crown member may be used to increase efficiency during bonding of that component to a titanium body member. Ideally, the surface free energy of the members being bonded is greater than the surface tension of the bonding material so that the bonding material wets the bonding surfaces to provide a strong bond.

Additionally, forming the bond between the components separate from the club head body member may also be used to improve efficiency of the bonding because preparation of the bonding surfaces, post bonding processes and control over the fit of the components may be improved. For example, properly cleaning the bonding surfaces is important to maintain the surface energy of the material as high as possible. Methods of raising, and maintaining, the surface free energy of thermoset composites include abrasion using an abrasive material, such as an abrasive pad (e.g., Scotch-Brite pads, a registered trademark of 3M Company, St. Paul, Minn.) or sand paper, and grit blasting, then removing dust and debris using solvent wipes or dry wipes. Methods for maintaining high free surface energy for metal materials include vapor or solvent degreasing, increasing the effective bonding surface area by chemical or acid etching, use of a chemical coupler surface treatment such as a sol-gel process, and use of a corrosion inhibiting primer to preserve the freshly treated surface. By improving the efficiency of the bonding the overall bond width may be reduced, especially in the side joints. The coupling member is preferably constructed from a material that is the same as the body member or weldable to the body member.

FIG. 96 shows crown member 1114 coupled to coupling member 1116 with a lap joint. The lap joint is created by a flange 1118 included on coupling member 1116 and an overlapping portion of crown member 1114 that is coupled thereto. For example, the two members may be coupled using a bonding material 1120, such as by adhesive bonding, brazing, or soldering the two components together. Where the materials of crown member 1114 and coupling member 1116 permit welding, the bonding material 1120 may be weld material.

Referring to FIGS. 97-102, alternative coupling configurations between a crown member, a coupling member and a body member will be described.

Figure 97:
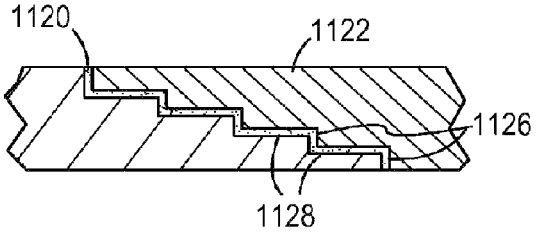
Figure 98:
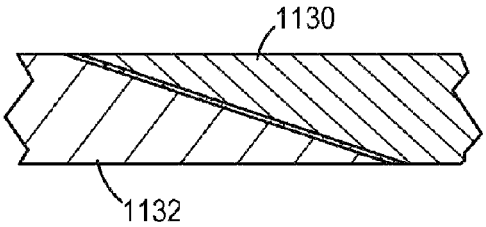

FIG. 97 illustrates a lap joint and FIG. 98 illustrates a tapered scarf joint that may be employed. For example, in FIG. 97, a crown member 1122 and a coupling member 1124 have complementary stepped flanges that are coupled with bonding material 1120. The stepped flanges are formed by a plurality of shoulders 1126 and landings 1128 and although shoulders 1126 and landings 1128 are shown perpendicular to each other, it should be appreciated that they may have any angle relative to each other. For example, shoulders 1126 and landings 1128 may be oriented to generally form a saw tooth pattern.

FIG. 98 illustrates another lap joint that includes an angled interface between a crown member 1130 and a coupling member 1132. The angle of the interface between the components may be selected so that a desired distribution of shear and normal forced may be placed on bonding material 1120 for a predetermined force on the components.

In other embodiments of coupling configurations, the components are configured so that a portion of one component is received in a portion of the other component. As a result, the components are coupled by bonding material 1120 and a mechanical connection.

Figure 99:
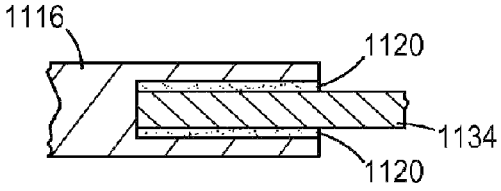

FIG. 99 shows a coupling in which a portion of a crown member 1134 is inserted into a recess of a coupling member 1136 and a pair of parallel interfaces are coupled by bonding material 1120.

Figure 100:
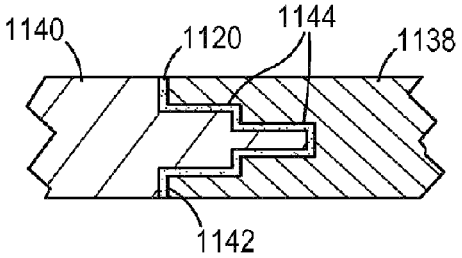

FIG. 100 shows another embodiment in which a crown member 1138 includes a recess that receives a portion of a coupling member 1140. Crown member 1138 and coupling member also engage at a stepped interface that includes a plurality of shoulders 1142 and landings 1144. Bonding material 1120 is disposed at the stepped interface to securely couple the components.

Figure 101:
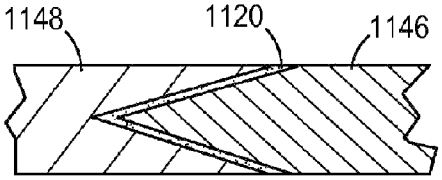

FIG. 101 shows another embodiment, in which a portion of a crown member 1146 is received in a recess of a coupling member 1148 and the two components engage at a pair of angled interfaces that are also held together with bonding material 1120. In such embodiments, the components may be coupled using thermal fitting techniques. For example, the coupling member may be heated and/or the crown member may be cooled so that clearance is provided between the components when the temperatures are different, then the components may be held in place until their temperatures are equalized. The materials may be selected, at least in part, by considering the required expansion based on the coefficient of thermal expansion of the material.

Figure 102:
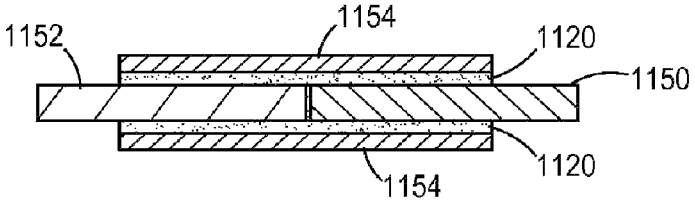

FIG. 102 illustrates a strap lap joint that includes a crown member 1150 that is attached to a coupling member 1152 by a pair of support members 1154. In particular, end surfaces of crown member 1150 and coupling member 1152 abut and support members 1154 are coupled across the abutment to the side surfaces of crown member 1150 and coupling member 1152.

It should further be appreciated that the club head construction including a coupling member to couple the body member and another component may be applied in other portions of the golf club head. For example, a coupling member may be used to couple a crown member (as shown), a sole member, a face member, and/or a hosel member to a body member of the golf club head.

The invention provides strong and lightweight coupling between members, components, or inserts in a golf club head. Using attachments at seams preferably with flanges (e.g., for sole member 1016 in FIG. 87, crown member 1066 in FIG. 91, or crown member 1114 in FIG. 96), the invention provides a mode of coupling that is extensible to body members generally, including face members or inserts as well as any other insert to optimize the utility or function of a club head.

For example, attachment methods described above are provided for attaching panels, inserts, or components, for example, light weight inserts (e.g., optionally similar to sole member 1016, above, or having any configuration).

Figure 103:
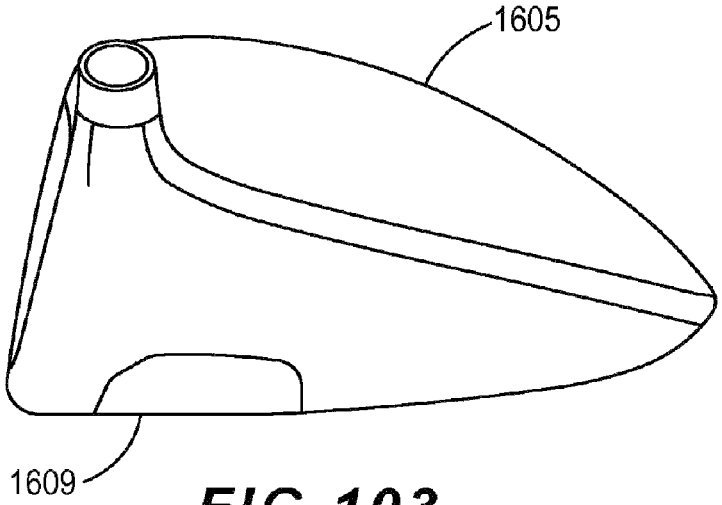
FIG. 103 is a side view of a club head according to certain embodiments of the invention.

FIG. 103 shows club head 1605 having insert 1609. Other exemplary inserts including, for example, light-weight inserts (for example, in the crown region) are discussed in Golf Club Head, U.S. Pat. No. 7,938,740; Golf Club Head with Concave Insert, U.S. Pat. No. 7,524,249; and Golf Club Head, U.S. Pub. 2011/0272846, the contents of each of which are incorporated by reference herein in their entirety. FIG. 103 shows insert 1609 in a sole region. Insert 1609 can be anywhere on a club head (e.g., face, skirt, crown, heel, or toe) as shown, for example, in the above-cited patents and publications.

Figure 104:
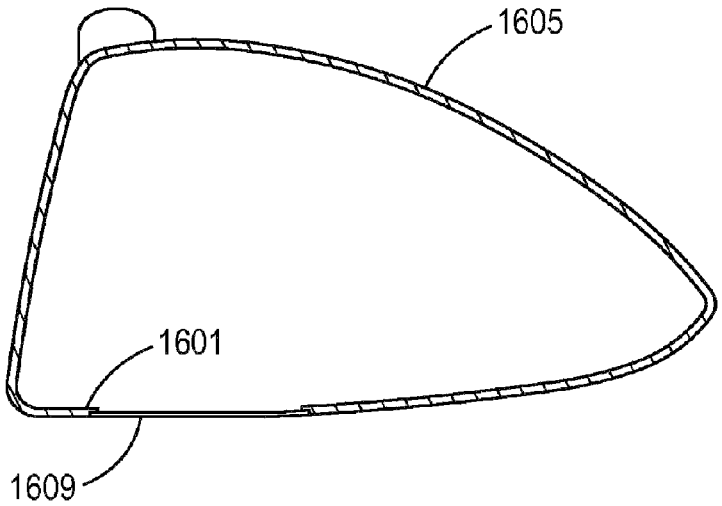
FIG. 104 is a cross-sectional view of the club head shown in FIG. 103.

FIG. 104 is a cross-sectional view of the club head shown in FIG. 103. As shown in FIG. 104, insert 1609 may optionally be of a different thickness than surrounding material of club head 1605. Insert 1609 is joined to head 1605 at a seam, which may have any construction discussed herein (see, e.g., FIGS. 96-102). A construction seam will generally include at least one flange 1601. As described here, flange 1601 is generally a protruding tab of material monolithically formed with surrounding material of club head 1605 and optionally recessed somewhat into the head so that if insert 1609 is in place, flange 1601 is not directly visible from the outside of the club head. However, flange 1601 may also refer to the corresponding portion of insert 1609. Further, the recessed side can be on the club head, on the insert, or on a mixture of both.

Figure 105:
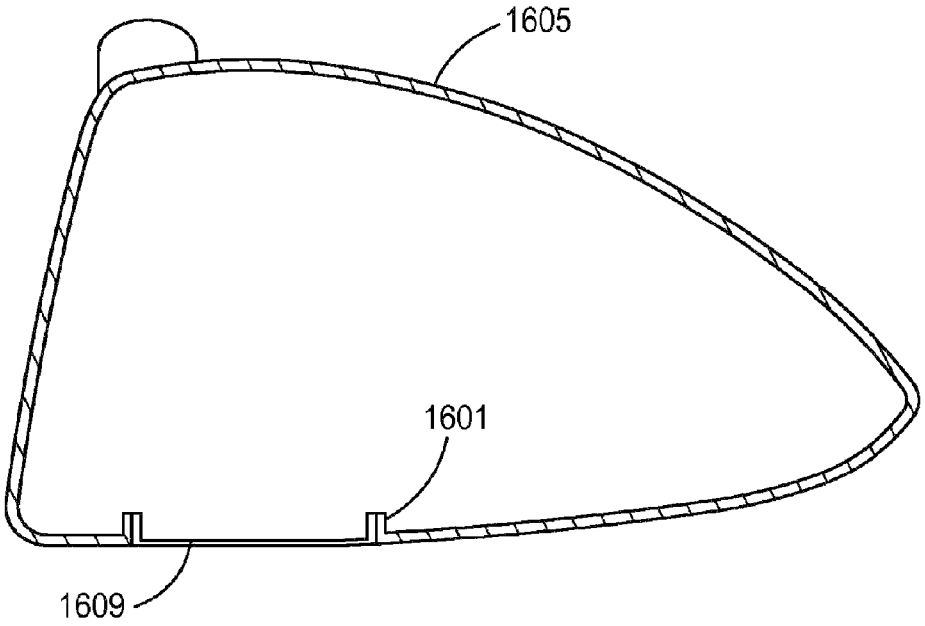
FIG. 105 is a cross-sectional view of a club head according to certain embodiments of the invention.

FIG. 105 shows an embodiment in which both of insert 1609 and head 1605 include an L-shaped flange (e.g., pointing into the club head) to present a mating surface for coupling the insert into the club head. In certain embodiments (not shown), only club head 1605 includes an L-shaped flange, and insert 1609 includes material that is as thick as the flange, thus not needing to be L-shaped, for example, to provide more weight or due to a light weight choice of material. In certain embodiments, insert 1609 includes an L-shaped flange and club head 1605 does not.

A flange or coupling seam according to the invention may be used to couple two components (e.g., substantially similar in size, i.e., neither one an "insert" in the other).

Figure 106:
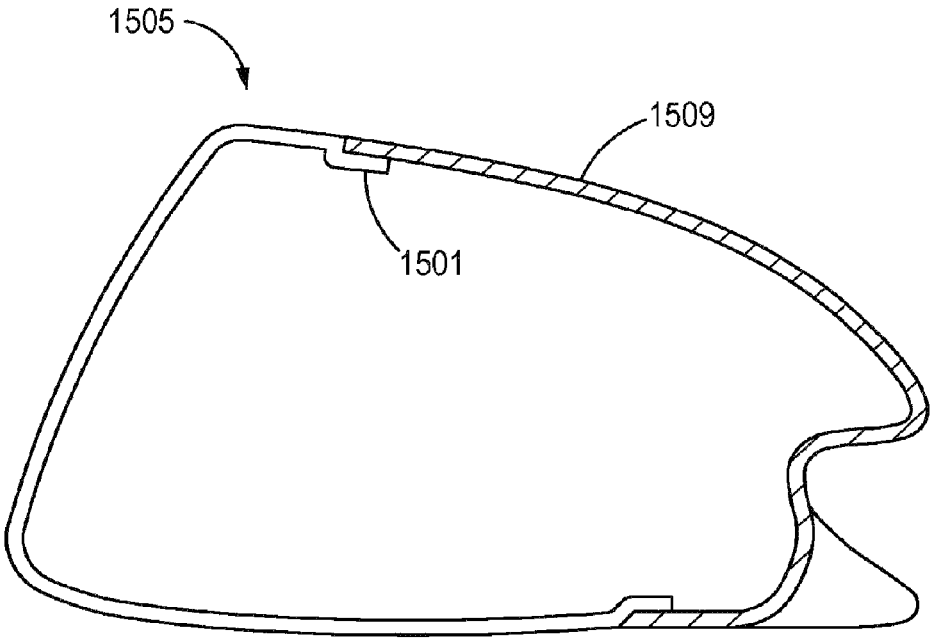
FIG. 106 is a cross-sectional view of a club head according to certain embodiments of the invention.

FIG. 106 shows a club head 1505 having a body member 1509 coupled to the club head at an attachment perimeter that includes a flange 1501. Attachment of a body member via an attachment perimeter is discussed in Golf Club Head with Concave Insert, U.S. Pat. Nos. 7,658,686 and 7,980,964; Golf club Head with Concave Insert, U.S. Pub. 2011/0275455; Golf Club Head, U.S. Pub. 2011/0053706; and Golf Club Head U.S. Pub. 2007/0054751, the contents of each of which are hereby incorporated by reference in their entirety. Flange 1501 can be disposed as shown in FIG. 106 or it can have any form (see, e.g., FIGS. 96-102, 105) in which at least one area of material is bound to another material.

Figure 107:
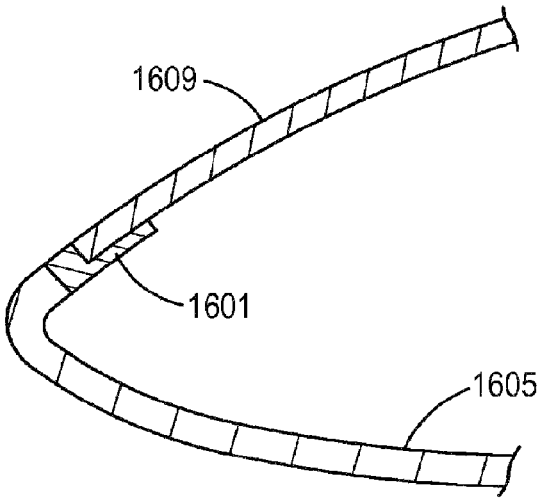
FIG. 107 is a detail view of a club head shown in FIG. 95.

FIG. 107 shows a detail view of a club head 1605, similar to one shown in FIG. 95, including a coupling member to present flange 1601 to crown member 1609. In various embodiments (e.g., including a coupling member or not and in which the flange is on an insert, a body, or both, and in which a flange has any disposition or morphology) the invention provides optimization to a flange for better weight and construction strength. Flanges according to the invention allow a greater variety of types (e.g., bonding ledges, lap joints, butt joints, tongue-and-groove types, saw tooth conformations) to be used in more places in a club head, for example, by minimizing weight of flange material and increasing bonding surface area, as well as allowing for removal of excess adhesive.

The invention generally provides a flange 1601 for binding a component 1609 to a club head 1605. Flange 1601 may optionally include one or more void 1613 in, through, on, or near a mating surface.

Figure 108:
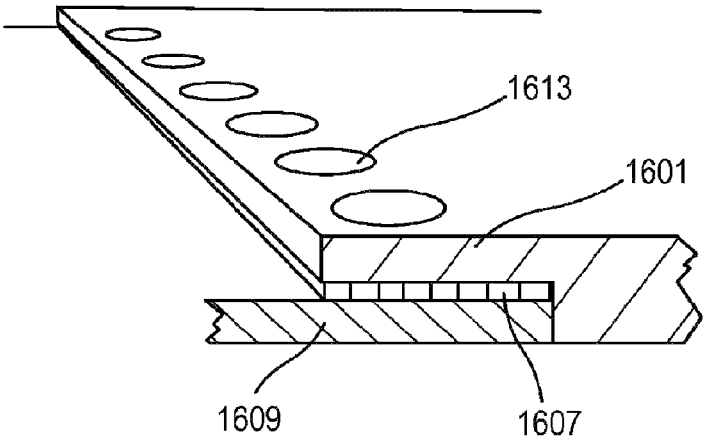
FIG. 108 illustrates a seam according to certain embodiments of the invention.

FIG. 108 shows a series of substantially circular voids 1613 arrayed along flange 1601 participating in a seam binding component 1609. A void 1613 may optionally pass all the way through flange 1601.

In some embodiments, adhesive 1607 binds component 1609 to club head 1605. Where void 1613 presents a recess into flange 1601, void 1613 may function as a cavity (see, e.g., cavity 1080 in FIG. 92) allowing adhesive 1607 to flow away from the contact surfaces.

Where void 1613 presents a hole through flange 1601, void 1613 further allows an adhesive 1607 to pass through flange 1601. This allows a greater surface area of flange 1601 to contact adhesive 1607, providing a strong bond. This further allows excess adhesive 1607 to be easily removed, creating a clean finish line and a club head 1605 with a minimum of unnecessary excess weight. Excess adhesive can be removed from within club head 1605 in any manner. For example, it can be allowed to dry and globules of adhesive not substantially participating in bonding will be as pellets, capable of being shaken out through a construction hole or hosel. Excess adhesive can be sanded away. Ridges, protrusions, or flashings of excess adhesive can be broken off by sonication, a tool, chemical treatment, or other means known in the art. In certain embodiments, a solvent such as turpentine or acetone is introduced into club head 1605 and swirled around to remove excess adhesive and then washed out of club head 1605.

Flange 1601 can include a single void 1613 into the surface or through it. In a preferred embodiment, a plurality of voids 1613 are provided through flange 1601 arrayed in a perforation-like pattern. A pattern of voids 1613 can be described with reference to a number of features. A plurality of voids can be described with reference to an average aperture area A of opening (e.g., where voids 1613 are round with a radius r, an individual aperture area Ai can be given by $\pi r2$). An area including a pattern of voids 1613 can be described with reference to a ratio S of void space to total area. A void 1613 can be described with reference to a geometric shape of a perimeter of void 1613. An aperture area of voids 1613 can be described with reference to a pattern describing the arrangement of voids 1613. A flange 1601 with voids can be described in terms of a number N of voids per cm in a linear direction along an attachment perimeter of component 1609 (e.g., N can be between about 10 and about 5000 or between about 0.1 and about 9).

FIGS. 108-113 each show a flange 1601 including an area of voids 1613 according to certain embodiments of the invention. As shown in FIG. 108, voids 1613 may be generally substantially circular and arrayed in a linear repeating pattern. An average aperture area A of voids 1613 may generally be between about 0.5 $mm^2$ and about 5 $cm^2$. A ratio S of void space to total area of flange 1601 may generally be between about 0.001 and 0.9, preferably between about 0.01 and about 0.9, preferably between about 0.1 and about 0.75 (e.g., between about 0.2 and about 0.5). Voids 1613 may be divots in a surface of flange 1601 or holes through flange 1601.

Figure 109:
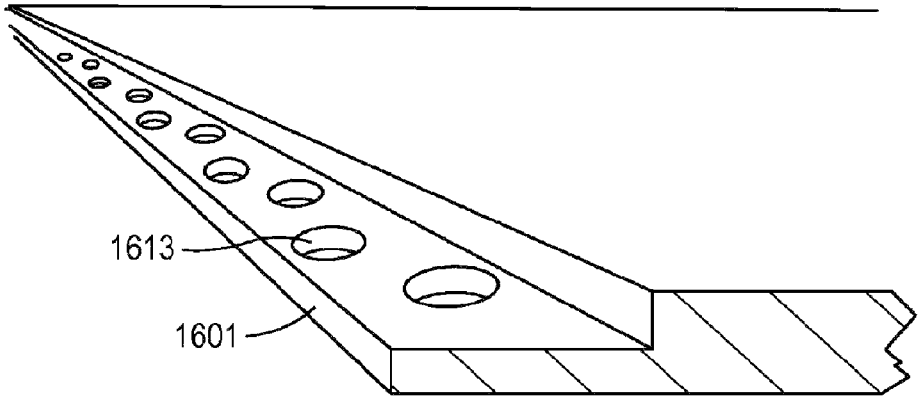
FIGS. 109-113 each show a flange according to certain embodiments of the invention.

FIG. 109 shows a pattern of voids 1613 presenting holes through flange 1601. As shown in FIG. 109, voids 1613 can be arrayed in an offset, or zigzag, pattern. Voids 1613 may be arrayed in a precise geometrical pattern, or with an irregular spacing or irregular offset. As shown in FIG. 109, a ratio S of void space to total area of flange 1601 may generally between about 0.1 and about 0.5, e.g., between about 0.3 and about 0.4. A perimeter of a void 1613 may be circular or substantially circular, as well as optionally oval, elliptical, ovoid, or oblong. A perimeter may be hexagonal, triangular, star shaped (e.g., if punched out by a punch tool) and need not be flush or planar with a surrounding area of flange 1601. For example, if a void 1613 is made by punching with a punch tool, a perimeter may be a rough edge including a series of points furled back in a direction of a punch.

Figure 110:
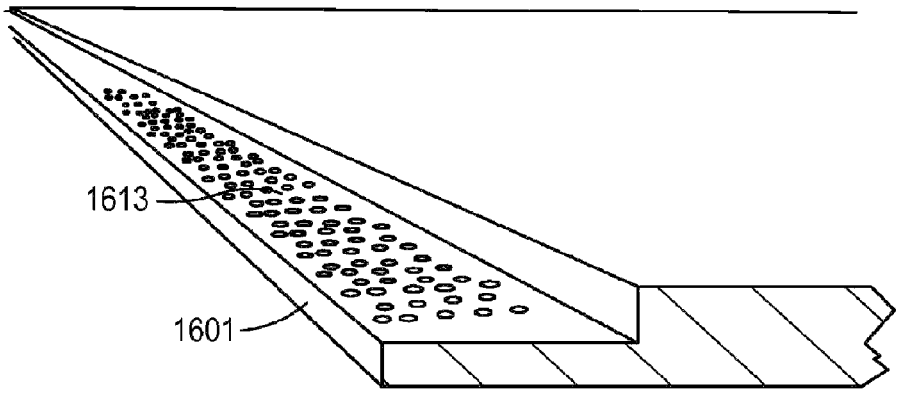

FIG. 110 shows a pin-hole pattern of voids 1613. Pin-hole voids may be arrayed in any density (e.g., tight cluster making a screen-like flange, or spaced apart). For example, a ratio S may be above about 0.5 (tight cluster or mesh) or lower (substantially solid flange). For pin-hole voids, an average aperture area A of voids 613 may generally be less than about 0.5 $mm^2$ (e.g., between about 0.001 $mm^2$ and about 0.1 $mm^2$). A pattern of pinhole voids 1613 may be square grid, rectangular grid, diamond grid, triangular grid, hexagonal grid, or irregular. In certain embodiments, pin-hole voids 1613 are arrayed in a pattern to represent an image or text (i.e., a brand or logo is "written" on the flange in pinhole voids).

Figure 111:
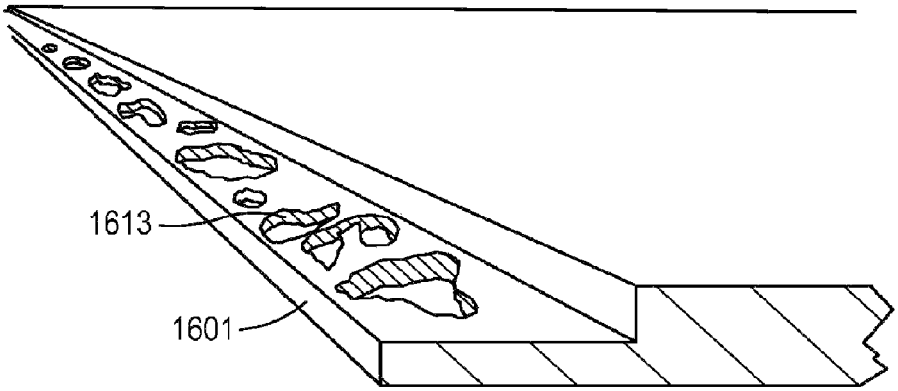

FIG. 111 illustrates a flange 1601 have an irregular array of irregular shaped voids 1613. With irregular voids 1613, any average aperture area A or ratio S is possible. For example, an average aperture area A can be between about 0.1 $mm^2$ and about 5 $mm^2$ or between about 5 $mm^2$. and about 3 $cm^2$. Irregular voids provide a ratio S that can be anything, for example, between about 0.001 and about 0.95.

Figure 112:
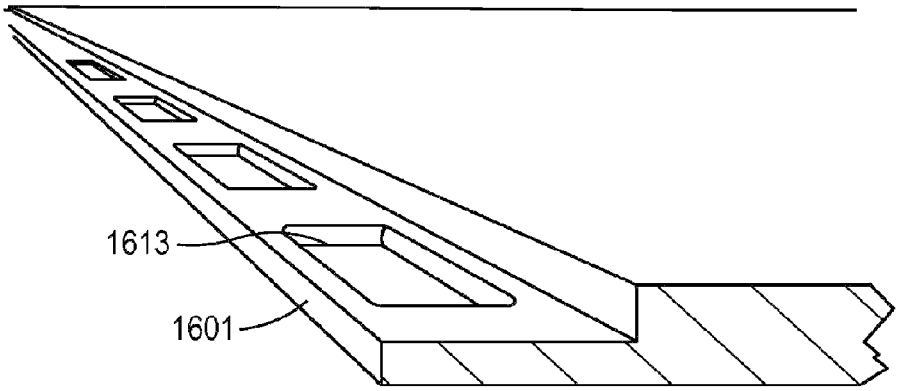

FIG. 112 shows a flange 1601 having voids 1613 generally having a substantially rectangular perimeter and arrayed in a regular, repeating pattern.

Figure 113:
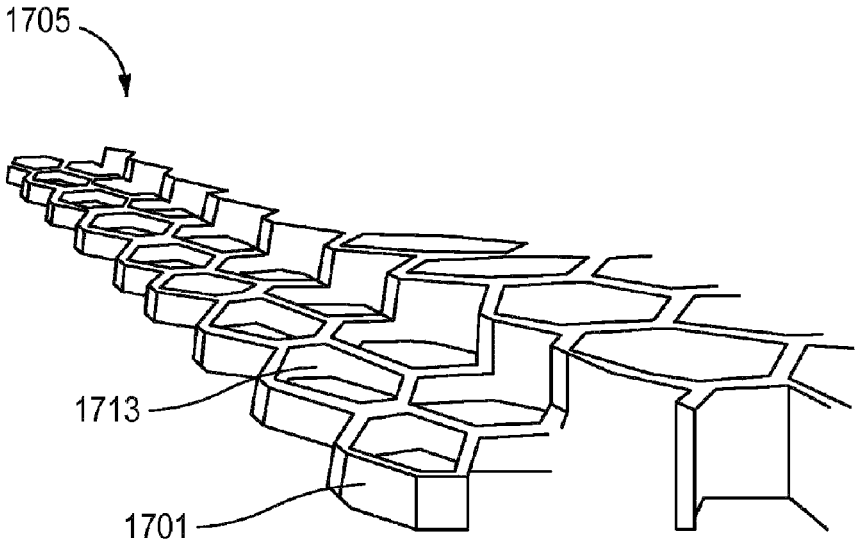

FIG. 113 shows a flange 1701 according to certain embodiments of the invention. As shown in FIG. 113, flange 1701 may be part of an area of material 1705 in a club head. Flange 1701 may generally have a honeycomb structure with substantially hexagonal voids 1713.

Figure 114:
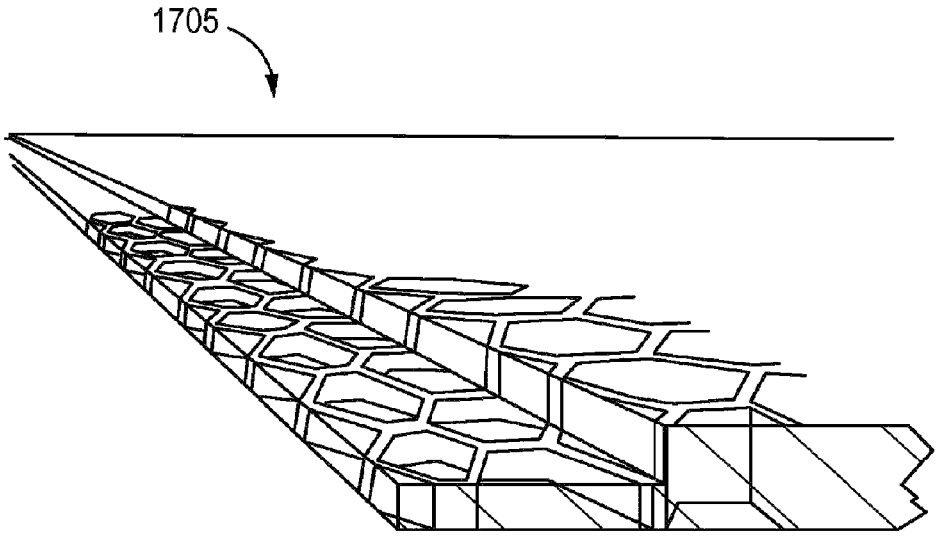
FIG. 114 shows the flange of FIG. 113 with idealized bounding lines.

FIG. 114 is a reproduction of the drawing in FIG. 113 with idealized bounding lines extending around the honeycomb structure to help visualize a three-dimensional shape of flange 1701. The honeycomb structure is not drawn or shown extending for the entire length of material 1705. The honeycomb structure may optionally extend for a portion of, or an entirety of, flange 1701 and may also extend any amount into surrounding material 1705.

A honeycomb structure or any of the embodiments described herein including one or more void in a flange can be made by any method known in the art. For example, material can be etched away from metal by laser etching. Material can be formed by laser metal sintering. Making components via laser metal sintering is discussed in Method of Making Golf Clubs, U.S. Pat. No. 8,007,373 and Method of Making Golf Clubs, U.S. Pub. 2011/0277313, both herein incorporated by reference in their entirety. Methods of making components are discussed in Golf Club Head, U.S. Pat. No. 7,803,065; Method of Making Golf clubs, U.S. Pub. 2011/0277313; Golf Club Head with Multi-Component Construction, U.S. Pub. 2011/0152003; Method of Making Golf clubs, U.S. Pub. 2010/0298065; Golf Club Heads, U.S. Pub. 2011/0151989; Club head with Improved Inertia, U.S. Pub. 2010/0056297; and Metal Wood Golf Club Head, U.S. Pub. 2008/0227564, the contents of each of which are incorporated by reference in their entirety.

An advantage of the invention includes the improvement to surface area, weight, joint strength, and appearance of coupled components when one or more void is provided on a mating surface or flange. For example, where a coupling seam is required in an area of a club head where weight is desired to be minimized (e.g., in a crown, above a center of gravity), voids can be provided. Voids do not need to be spaced evenly along a flange. For example, where a coupling seam extends across a crown and into a heel area and a toe area, a flange of the coupling seam may include more voids, or voids having a higher average aperture area A, or a higher ratio S near the crown, and a gradual or abrupt transition to minimum or no voids near a heel toe region.

Voids in a flange may be provided in a variety of sizes or shapes (e.g., intermingled). For example, large voids can be provided side-by-side with pinhole voids or any intermediate sized void. Where a flange comprises a curved surface (e.g., a portion of a spheroid surface), voids can be arrayed, for example, as a combination of hexagons and pentagons (i.e., soccer-ball structure or geodesic dome structure) to give a substantially regular geometry over a flange surface. Such a combination of voids may be employed when honeycomb structure (as shown in FIG. 113) is included on a flange having a substantially curved surface area.

Figure 115A:
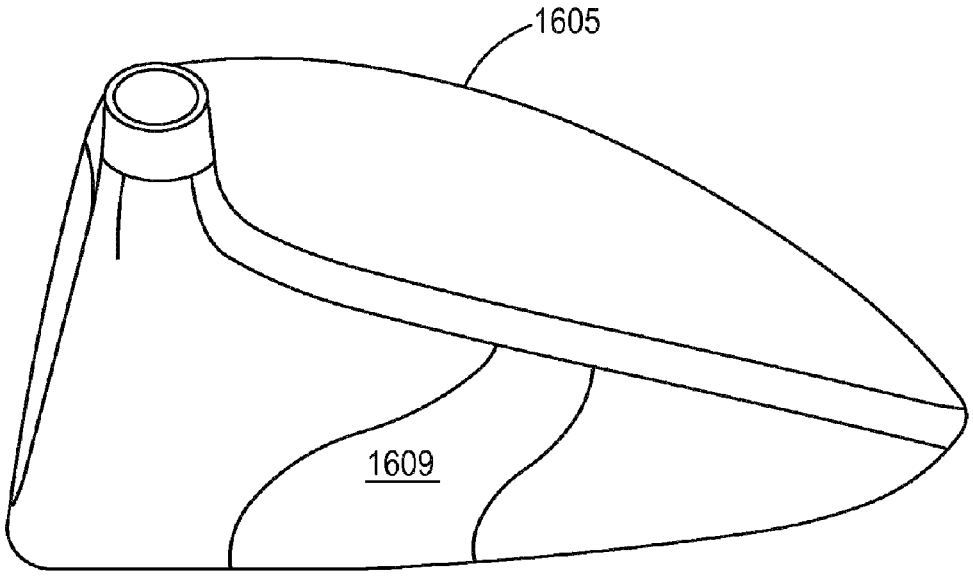
FIG. 115A is a side view of a club head according to certain embodiments of the invention.
Figure 115B:
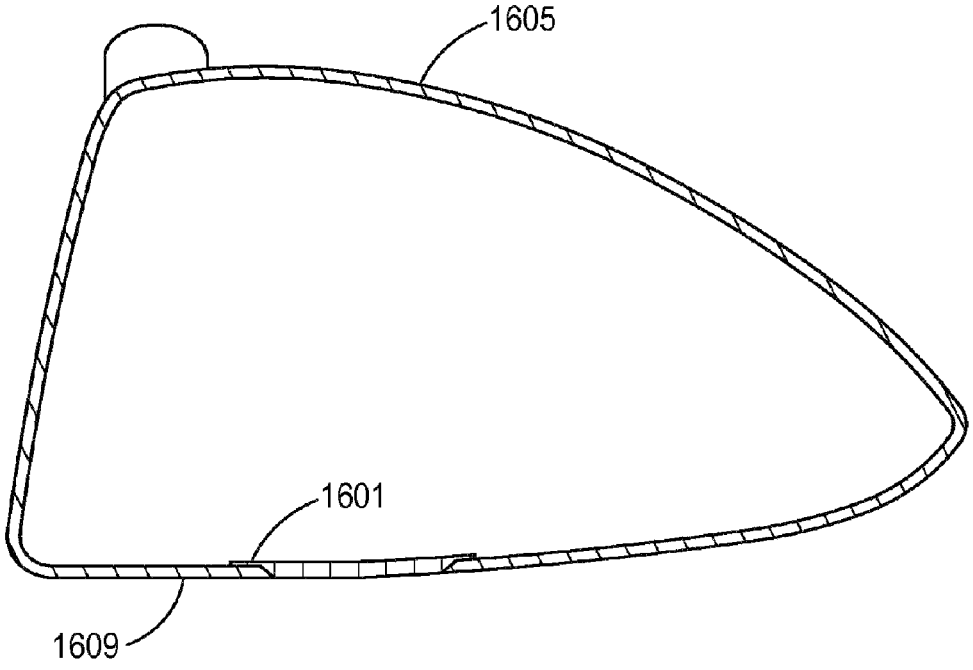
FIG. 115B is a cross-sectional view of the club head shown in FIG. 115A.

FIG. 115A is a side view of a club head according to certain embodiments of the invention. FIG. 115B is a cross-sectional view of the club head shown in FIG. 115A. As shown in FIG. 115B, flange 1601 may be included on component 1609. As shown in FIG. 115A, component 1609 extends from a sole of club head 1605 to a skirt of club head 1605. Flange 1601 may include voids in the form of perforations (e.g., array of substantially circular voids), pinhole perforations, honeycomb structure, or regular or irregular divots or holes according to any description herein. Voids may be: on flange 1601 on component 1609 as shown in FIG. 115B; on flange 1601 on club head 1605 as shown in FIG. 104; on both; on either or both of L-shaped flanges as shown in FIG. 105; or on any other mating surface morphology of the present invention, for example, as shown herein throughout. Any coupling member, flange, attachment perimeter, joint, or other mating morphology, for example, as shown at least in FIGS. 96-102, may include one or more voids 1613 according to descriptions herein or natural equivalents thereof.

For example, in certain aspects, the invention provides golf club head that includes a crown, a sole, and a face defining a body, in which the body includes at least one insert component 1609 connected to the body at an attachment perimeter. The attachment perimeter includes a flange 1601, and the flange includes one or a plurality of a void 1613, each forming a hole in a surface of the flange. The hole can go through the surface of the flange. Flange 1601 may be on the body and configured to be concealed from the outside of an assembled club head by the insert component, or it may be on the component. The insert component 1609 may be anywhere on the club head. Typically, lightweight inserts may be favored for the crown. Sole inserts may include any distribution of weight or topologies according to a club designer. The flange can be L-shaped. In some embodiments, the holes are pinpoint holes with average aperture area between about 0.01 $mm^2$ and about 1 $mm^2$, or they may have a ratio of aperture space to total surface area between about 0.1 and about 0.75. In some embodiments, the plurality of holes are disposed to be visible from the exterior of an assembled club head.

In certain aspects, the invention provides a component 1609 for a golf club head including material shaped to matingly couple to another component to form a body of a club head and comprising a flange 1601, wherein the flange comprises at least one hole through it.

Voids according to the invention offer particular benefits for optimizing the performance of adhesives (such as epoxy, resins, products such as Scotch-Weld brand adhesive DP807 from 3M Company (St. Paul, Minn.)) and other bonding substances. For example, voids present a greater surface area for adhesives to contact and, more particularly, can be configured to offer a greater surface area with a lower total volume of material than other assembly mechanisms. By increasing surface area while minimizing volume, bonding strength can be increased while a mass of a bond can be minimized, thereby giving a club head designer more discretionary mass to place elsewhere.

Voids 1613 allow excess adhesive to flow away from mating surfaces, thereby giving assembled golf clubs stronger bonds as well as a more precise it among parts, creating a more attractive appearance and aerodynamic outside surface. A better fit among parts creates club heads with more consistent playing characteristics and makes club head subassemblies during manufacturing more consistently compatible with downstream equipment (e.g., finishing stations for adding more components or laser etchings) in assembly work flows.

Voids 1613 further allow novel visual features that aid a golfer in recognizing a particular model of club or understanding a physical aspect of a club. For example, in some embodiments, a flange 1601 on an outside surface of a club includes one or more void 1613. Void 1613 may be partially or entirely filled adhesive. A part of void 1613 may optionally be filled with another material (e.g., urethane, water clear polyethylene or opaque materials, polycarbonate, acrylic, poly(methyl methacrylate), polystyrene, or polydimethylsiloxane). Any such material may be included in its default color, may be painted or colored on a surface, or may be impregnated with pigments or made translucent. For example, in some embodiments a flange includes voids to optimize a performance of adhesive, in which the voids are on an outside surface of the club and further filled to the surface with a translucent (or opaque or transparent) material, thereby allowing a golfer to understand why or how the club may exhibit certain playing properties or mass properties.

The disclosure herein includes description and discussion of methods and mechanism for assembling components such as inserts, sole plates, crown plates, and components of club heads, and bodies, to one another. The invention includes the insight that one or more of any of any mechanism of the invention, any component of the invention, or any feature of the invention can be combined in any number and in any combination. For example, any given flange arrangement and any given fastening mechanism may be combined—even if not shown together in a figure of the present disclosure—to provide a multi-component club head or club head with separable component or insert. Thus a club head of the present invention may include, for example, barbed posts designed to be broken off to remove a component as well as magnets for fastening components together.

It is an insight of the invention that a number of aspects of a club head can be uniquely selected with a variety of options and that this is well suited to customizing club heads to a customer's desires. It is a related insight that computer device technology provides a valuable tool for managing the complexity of manufacturing where customized orders are included. Accordingly, the invention provides systems and methods for providing a customized club head.

Providing a customized head can include offering options for one or more features that are available with a club head and receiving a selection from a consumer of an option.

Figure 116:
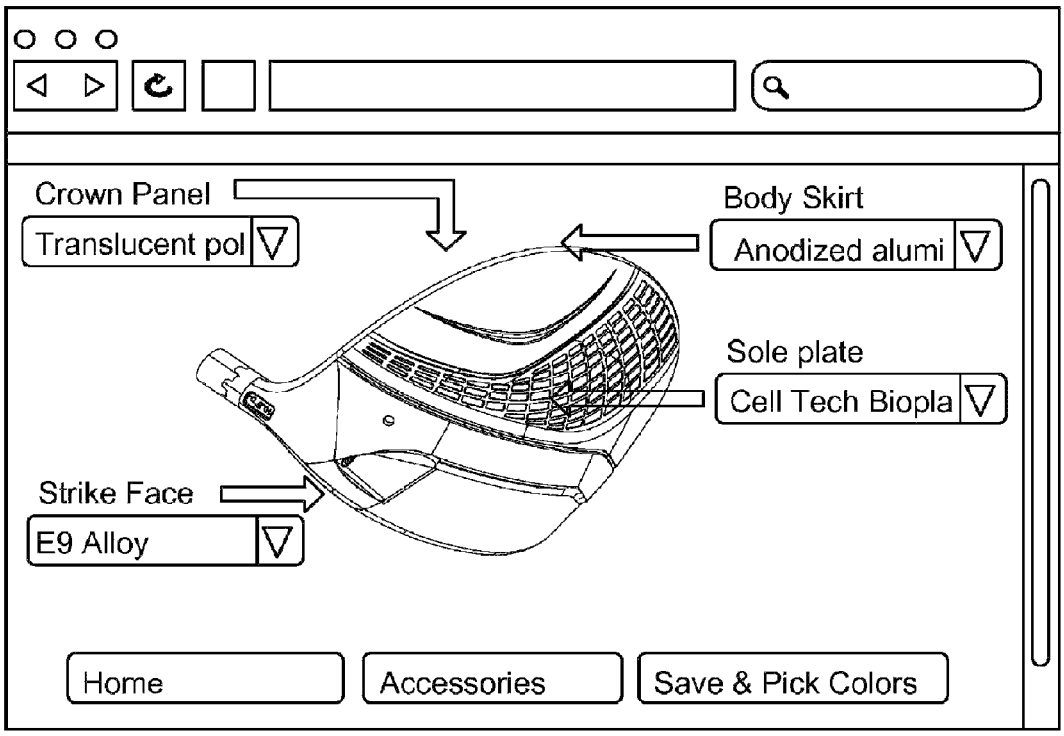
FIG. 116 shows a display for receiving option selections.

FIG. 116 depicts a display that can be used to receive a consumer's selection of one or more options for a club head. As shown in FIG. 116, a consumer could be given a display (e.g., in a web browser as presented via a graphical user interface (GUI)) that includes elements such as pull-down menus for choosing options. Any method of offering options and receiving selections is included, such as, for example, point-and-click selection, keyboard entry, radio buttons, and confirmation of suggested options. A selection of an option can include selecting a given option from a set of possibilities and it can also include selecting whether or not to include a certain feature at all. For example, a consumer can be offered whether or not they would like a removable crown panel on their club head and, if they choose so, they can then be offered a list. Options can be offered and selections received for any aspect of a club head including all of those discussed herein. As indicated in FIG. 116, a consumer could choose a material for a crown panel and suitable choices could include, for example, clear plastic, translucent plastic, composite, carbon fiber, titanium, aluminum, alloy.

A customer could be offered choices of bodies and body materials. Choices of certain bodies may govern the availability of certain other choices. For example, some bodies may have a forward member for supporting a strike face and a body skirt member upon which a crown panel and sole plate are to be installed. Where a customer chooses such a body, they may then be offered a choice of sole plate (e.g., with choice of style, material, color, etc.).

Other features a customer could choose options for include overall finish of surface (e.g., anodized, painted, decal set), strike face, removable/interchangeable weight members, reconfigurable shaft, setting indicator window, customer-uploaded photo printed on surface (e.g., as uploaded digitally), number of club heads (e.g., customer orders entire set or matching clubs/sets for whole families), etc.

FIG. 116 generally shows an exemplary display as could be shown on a screen, for example, of a computer or smartphone, discussed in more detail below. In certain embodiments, FIG. 116 represents a display rendered in a web browser (e.g., a web page being displayed by Internet Explorer or Google Chrome).

As shown in FIG. 116, receiving customer options can be done via a series of related screens. For example, a customer can choose materials for parts in a first screen, choose optional accessories in another screen, and save their choices and pick colors in another screen. However, in other embodiments, all choices are made on a single screen or a different combination of screens. In certain embodiments, choices are suggested based on inferences made according to computer program rules about a customer's likely preference. For example, if a customer orders a shaft in a given color (e.g., orange), a club head can be shown and suggested with a given matching or complementary color (e.g., orange main material with blue contrast finish details, or all green panels).

Given the variety of options a customer may choose and the variety of numbers a customer may order, the invention provides methods of receiving and preparing customized orders.

Figure 117:
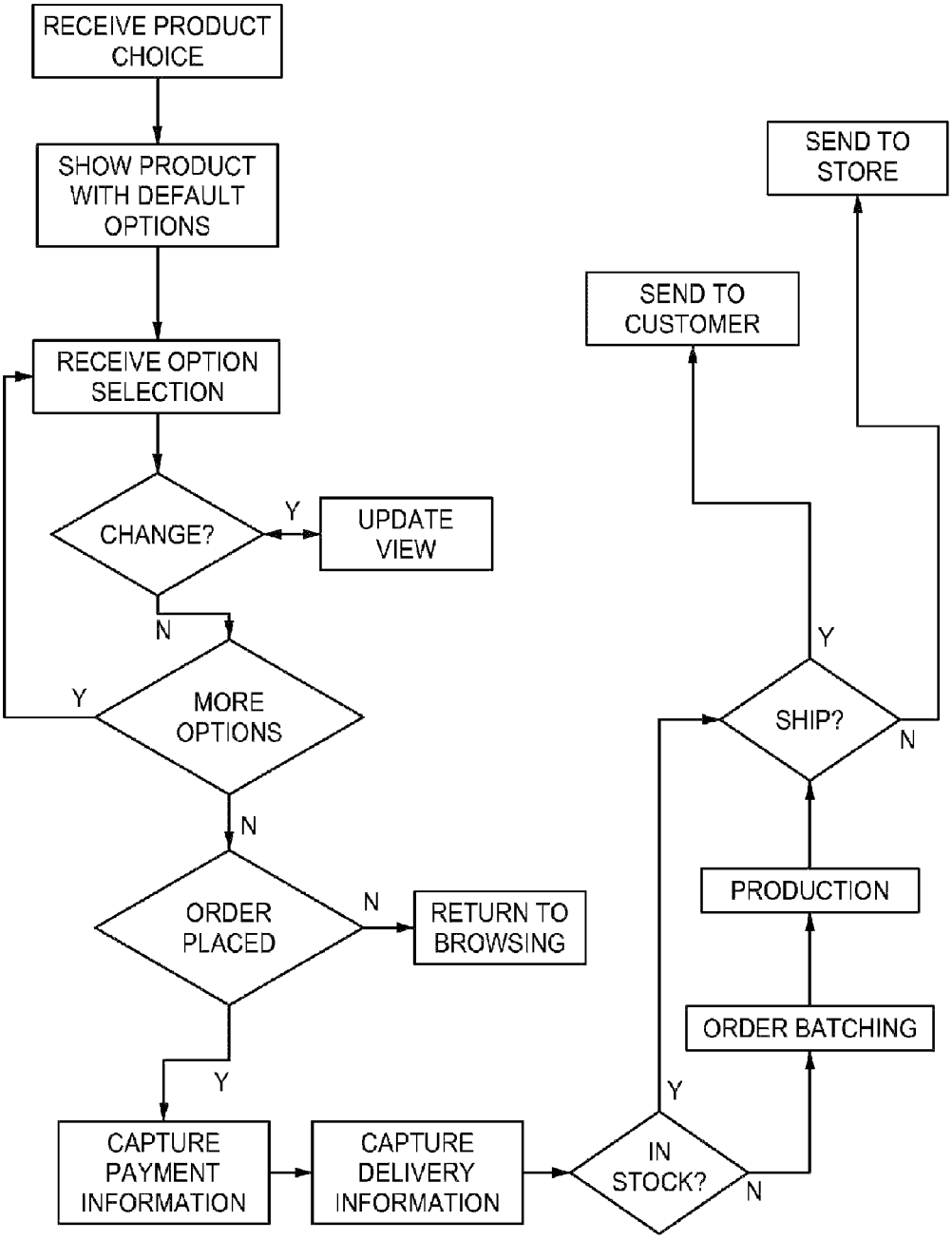
FIG. 117 is a block diagram of a method for providing a customized club head or golf club according to certain embodiments.

FIG. 117 gives a high-level block diagram of steps of a method of providing a customized club head according to certain embodiments of the invention. A method of providing a customized club head according to certain embodiments of the invention can include receiving a customer's choice of a product (e.g., AMP-product line driver club head) and showing the customer a product example (e.g., FIG. 116). A customer's selections of an option are received and saved in a memory. If the selection reflects a change from what was previously shown, the displayed product view can be updated to show what the customer has chosen. This can be repeated for as many features as are customizable or as many features as the customer chooses to select options for.

If the customer ends up not placing an order, they can be returned to browsing (e.g., shown a web page home screen or another product screen). Their choices can be saved and displayed to them at a later web page visit.

If the customer places an order, methods of the invention include capturing information from the customer about how they will pay for the product and how they will receive it. For example, a customer can provide a credit card number over a computer network (e.g., by typing into a payment web page), and then choose shipping by expedited mail and provide their home address. Or, alternatively, a customer can indicate that they wish to use a corporate account (e.g., they are purchasing a dozen club heads that are printed with a corporate logo which they have uploaded an image file such as a TIFF) and they can specify delivery to some site. A customer can also choose in-store pickup. In certain embodiments, a method of providing a customized club head is operable in conjunction with a special event, and methods include capturing delivery information about providing the club heads at the special event. For example, if Acme Golf Co is sponsoring and staffing a booth at Corporate Inc.'s charity fund-raiser, Acme Golf Co can collect information from a person at Corporate Inc. about a customized golf club (e.g., as a promotional item or prize) via methods of the invention, and Acme Golf Co can bring the golf club to the booth at the charity fund-raiser.

After delivery information is captured, it is determined whether the ordered item is already in stock, as-ordered. If it is, the ordered item is shipped or prepared for delivery according to the customer's delivery information. If the ordered item is not in stock, the order is batched.

Methods of the invention include organizing sets of orders for efficient production. A computer program, executed by a processor, can make reference to information about production facilities to organize a plurality of different orders and to coordinate production instructions so that production facilities include minimal down-time while components or parts are "switched out". For example, if regular production is scheduled for ten gross of aluminum club head bodies and ten gross of titanium club head bodies, and customized orders have been placed for one composite body, one aluminum body, one titanium body, and one alloy body, then order batching can include listing the order, for example, in the following order: 1441 aluminum; 1441 titanium; 1 composite; 1 alloy.

Order batching further includes scheduling production of individual batches, where a batch is a sub-set of all orders identified by a computer executing program instructions according to production criteria. Batches may be scheduled according to information about production times, steps, complexity, or interrelationships involved. For example, if a repositionable shaft connection is required to be added to a club head at an assembly workstation where a main body of a club head is painted, while a sole plate is added to a club head at a dedicated separate workstation and can only be added after a main body is painted, then a batch can be prepared that is all club heads with repositionable shaft connections batched with all club heads to be painted, while a separate batch is prepared that includes all club heads with a sole plate. Then, the second batch can be routed to the main assembly work station first, for example, to leave additional time for adding the repositionable shaft connection to that batch while the other batch is at the main assembly workstation so that the entire set of batches is completed at the same time.

After order batching, order information (e.g., info regarding batches, production schedules, and individual orders of club heads) is transmitted to a production system or facility, and the ordered club heads are produced.

After production, the club heads are sent. If a customer has ordered a club to be shipped to their home, the club is sent to the customer. If a customer has requested in-store pickup, the club is sent to the store. If a customer has requested another delivery option, it is so initiated.

The invention provides systems suitable for implementing methods of providing a customized golf club including the foregoing methods.

Figure 118:
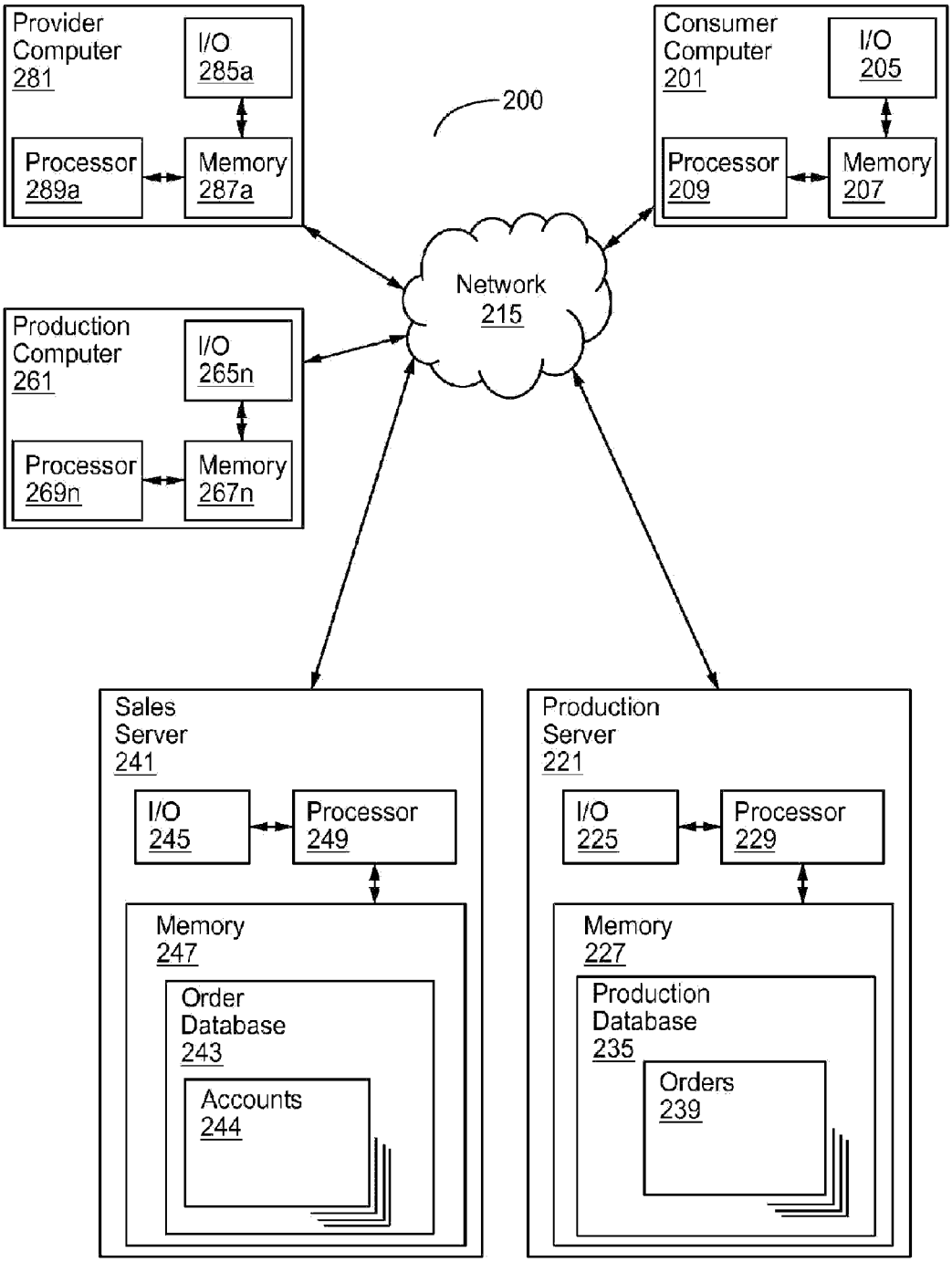
FIG. 118 is a block diagram of a system for providing a customized club head or golf club.

FIG. 118 shows components in an exemplary system for providing a customized golf club. As shown in FIG. 118, system 200 generally includes one or more computer, communicably coupled via network 215. Systems and methods of the invention may generally be implemented through the use of one or more computer such as any combination of a provider computer 281, a production computer 261, and a consumer computer 201 along with, for example, a sales server 241 and a production server 221. A computer generally includes a processor (e.g., 209, 289, 269, 249, 229) operably coupled to a memory (e.g., 207, 287, 267, 247, 227) and configured to send or receive information via input-output device (e.g., 205, 285, 265, 245, 225).

One of skill in the art will recognize that a processor may be provided by one or more processors including, for example, one or more of a single core or multi-core processor (e.g., AMD Phenom II X2, Intel Core Duo, AMD Phenom II X4, Intel Core i5, Intel Core i& Extreme Edition 980X, or Intel Xeon E7-2820). In certain embodiments, any of consumer computer 201, provider computer 281, production computer 261 may be a notebook or desktop computer sold by Apple (Cupertino, Calif.) or a desktop, laptop, or similar PC-compatible computer such as a Dell Latitude E6520 PC laptop available from Dell Inc. (Round Rock, Tex.). Such a computer will typically include a suitable operating system such as, for example, Windows 7, Windows 8, Windows XP, all from Microsoft (Redmond, Wash.), OS X from Apple (Cupertino, Calif.), or Ubuntu Linux from Canonical Group Limited (London, UK). In some embodiments, any of consumer computer 201, provider computer 281, production computer 261 may be a tablet or smart-phone form factor device and processor 281 can be provided by, for example, an ARM-based system-on-a-chip (SoC) processor such as the 1.2 GHz dual-core Exynos SoC processor from Samsung Electronics, (Samsung Town, Seoul, South Korea).

In some embodiments, either of sales server 241 or production server 221 can be a Hitachi Compute Blade 500 computer device sold by Hitachi Data Systems (Santa Clara, Calif.). Either of processor 249 or processor 229 can be, for example, a E5-2600 processor sold under the trademark Xeon by Intel Corporation (Santa Clara, Calif.).

Input-output devices generally includes one or a combination of monitor, keyboard, mouse, data jack (e.g., Ethernet port, modem jack, HDMI port, mini-HDMI port, USB port), Wi-Fi card, touchscreen (e.g., CRT, LCD, LED, AMOLED, Super AMOLED), pointing device, trackpad, microphone, speaker, light (e.g., LED), or light/image projection device.

In certain embodiments, a consumer's selection of options is received via the consumer's use of consumer computer 201 and the selection is received at sales server 241 and stored in memory 247. Sales server 241 uses a network card for input/output 245 to received data. Sales server 241 maintains order database 243 which may include accounts 244 where consumer information is stored (e.g., for payment and delivery information).

After orders are received and ready for production, digital files can be transferred via input/output 245 from sales server 241 to production server 221 via input/output 225, which may also be a network card or other data transfer mechanism. Order information (e.g., orders 239) is stored in production database 235 in memory 227. Processor 229 executes computer program instructions stored in memory 229 to perform order batching and to initiate production.

A production facility may be equipped with a production computer 261 which either automatically coordinates the operation of machines or provides information to production employees, e.g., via input/output 265, which could include, for example, a monitor or laser printer.

Many of the steps and functions described herein can be planned or coordinated by a provider personnel using provider computer 281. For example, engineers or sales personnel can prepare and upload information (e.g., digital files such as in a comma-separated values (CSV) format) that, for example, lists options for features for consumer selection. That is, in certain embodiments, provider personnel use provider computer 281 to "set up" what options are available, for example, within a display such as the one shown in FIG. 116. Such uploaded information may be saved in memory 247 on sales server 241 and can be used, for example, by processor 249 to cause a display to be rendered such as that shown in FIG. {44 on input/output 205 on consumer computer 201. Input/output 205 can include a monitor displaying a view of a web browser. A customer's selection of options can be stored in one of accounts 244 in order database 243 by writing a file in memory 247.

A memory generally refers to one or more storage devices for storing data or carrying information, e.g., semiconductor, magnetic, magneto-optical disks, or optical disks. Information carriers for a memory suitable for embodying computer program instructions and data include any suitable form of memory that is tangible, non-transitory, non-volatile, or a combination thereof. In certain embodiments, a device of the invention includes a tangible, non-transitory computer readable medium for memory. Exemplary devices for use as memory include semiconductor memory devices, (e.g., EPROM, EEPROM, solid state drive (SSD), and flash memory devices e.g., SD, micro SD, SDXC, SDIO, SDHC cards); magnetic disks, (e.g., internal hard disks or removable disks); magneto-optical disks; and optical disks (e.g., CD and DVD disks). The processor and the memory can be supplemented by, or incorporated in, special purpose logic circuitry.

The subject matter described herein can be implemented in a computing system that includes a back-end component (e.g., sales server 241 or production server 221), a middleware component (e.g., an application server or sales sever 241), or a front-end component (e.g., consumer computer 201 having a graphical user interface or a web browser through which a user can interact with an implementation of the subject matter described herein), or any combination of such back-end, middleware, and front-end components. The components of the system can be interconnected through network 215 by any form or medium of digital data communication, e.g., a communication network. Examples of communication networks include cell network (e.g., 3G or 4G), a local area network (LAN), and a wide area network (WAN), e.g., the Internet.

The subject matter described herein can be implemented as one or more computer program products, such as one or more computer programs tangibly embodied in an information carrier (e.g., in a non-transitory computer-readable medium) for execution by, or to control the operation of, data processing apparatus (e.g., a programmable processor, a computer, or multiple computers). A computer program (also known as a program, software, software application, app, macro, or code) can be written in any form of programming language, including compiled or interpreted languages (e.g., C, C++, Perl), and it can be deployed in any form, including as a stand-alone program or as a module, component, subroutine, or other unit suitable for use in a computing environment. Systems and methods of the invention can include instructions written in any suitable programming language known in the art, including, without limitation, C, C++, Perl, Java, ActiveX, HTML5, Python, Ruby on Rails, Visual Basic, or JavaScript. In certain embodiments, systems and methods of the invention are implemented through the use of a mobile app. As used herein, mobile app generally refers to a standalone program capable of being installed or run on a smartphone platform such as Android, iOS, Blackberry OS, Windows 8, Windows Mobile, etc.

Functionality of the invention can be implemented by a mobile app or a software application or computer program in other formats included scripts, shell scripts, and functional modules created in development environments.

A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

A file can be a digital file, for example, stored on a hard drive, SSD, CD, or other tangible, non-transitory medium. A file can be sent from one device to another over network 215 (e.g., as packets being sent between a server and a client, for example, through a Network Interface Card, modem, wireless card, or similar).

Writing a file according to the invention involves transforming a tangible, non-transitory computer-readable medium, for example, by adding, removing, or rearranging particles (e.g., with a net charge or dipole moment into patterns of magnetization by read/write heads), the patterns then representing new collocations of information about objective physical phenomena desired by, and useful to, the user (e.g., a physical arrangement of particles that indicates that a specific, new club head is to be constructed from a certain set of multiple components and sent to a customer). In some embodiments, writing involves a physical transformation of material in tangible, non-transitory computer readable media (e.g., with certain optical properties so that optical read/write devices can then read the new and useful collocation of information, e.g., burning a CD-ROM). In some embodiments, writing a file includes transforming a physical flash memory apparatus such as NAND flash memory device and storing information by transforming physical elements in an array of memory cells made from floating-gate transistors. Methods of writing a file can be invoked manually or automatically by a program or by a save command from software or a write command from a programming language.

As used herein, the word "or" means "and or or", sometimes seen or referred to as "and/or", unless indicated otherwise. Any documents referenced in the disclosure are hereby incorporated herein by reference in their entirety for all purposes.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

References and citations to other documents, such as patents, patent applications, patent publications, journals, books, papers, web contents, have been made throughout this disclosure. All such documents are hereby incorporated herein by reference in their entirety for all purposes.

What is claimed is:

1. A hollow, wood-type golf club head comprising:

a first body member and a second body member releasably coupleable to the first body member by a cantilever mechanism comprising a protruding tip on the first body member and a recess dimensioned to receive the protruding tip on the second body member, wherein the recess comprises a hole through the second body member;

the first and second body members releasably coupleable to create a playable club head that can be disassembled by pressing on the protruding tip, through the hole, to disengage the cantilever mechanism, the club head comprising:

a hollow body having a ball-striking face;

a crown extending aft from the face;

a hosel extending upwards from a heel side of the body when the club head is at address; and a sole extending aft from the face beneath the crown, wherein the cantilever mechanism is located in the playable club head.

2. The club head of claim 1, wherein the protruding tip is configured to be disengaged through the use of a tool.

3. The club head of claim 1 wherein the protruding tip includes a squared tip.

4. The club head of claim 1 wherein the protruding tip includes an angled tip.

5. A hollow, wood-type golf club system comprising:

a first body member and a second body member releasably coupleable to the first body member by a cantilever mechanism comprising a protruding tip on the first body member and a depression dimensioned to receive the protruding tip on the second body member;

the first and second body members releasably coupleable to create a playable club comprising:

a hollow body having a ball-striking face;

a crown extending aft from the face;

a hosel extending upwards from a heel side of the body when the club head is at address; and a sole extending aft from the face beneath the crown, wherein the second body member further comprises a decoupling hole to allow access to the protruding tip of the first body member to push the protruding tip out of the depression, allowing the first and second body members to be separated from one another once coupled.

6. The club head system of claim 5, further comprising a tool, the tool comprising a prong set dimensioned to be inserted into decoupling holes and push the protruding tip of the first body member out of the depression of the second body member once coupled.

* * * * *